US006949885B2

(12) United States Patent
Hamamoto et al.

(10) Patent No.: US 6,949,885 B2
(45) Date of Patent: Sep. 27, 2005

(54) DISCHARGE LAMP LIGHTING DEVICE AND LIGHTING APPARATUS

(75) Inventors: Katsunobu Hamamoto, Kadoma (JP); Katsumi Sato, Kadoma (JP); Toshiya Kanja, Kadoma (JP)

(73) Assignee: Matsushita Electric Works, Ltd., Osaka (JP)

( * ) Notice: Subject to any disclaimer, the term of this patent is extended or adjusted under 35 U.S.C. 154(b) by 13 days.

(21) Appl. No.: 10/791,907

(22) Filed: Mar. 4, 2004

(65) Prior Publication Data

US 2004/0212318 A1 Oct. 28, 2004

(30) Foreign Application Priority Data

Apr. 22, 2003 (JP) ..... 2003-116942

(51) Int. Cl.[7] ..... H05B 41/14; H05B 41/24

(52) U.S. Cl. ..... 315/200 R; 315/272; 315/291; 315/313

(58) Field of Search ..... 315/200 R, 205–207, 315/224–225, 272, 291, 302, 307–308, 313, 352, 360; H05B 41/14, 41/24

(56) References Cited

U.S. PATENT DOCUMENTS 5,068,570 A * 11/1991 Oda et al. ..... 315/128
5,142,203 A * 8/1992 Oda et al. ..... 315/308
5,295,036 A 3/1994 Yagi et al. ..... 361/79
6,127,788 A * 10/2000 Yamamoto et al. ..... 315/307
6,515,431 B2 * 2/2003 Moo et al. ..... 315/224
6,548,964 B2 * 4/2003 Kamata et al. ..... 315/209 R
6,747,422 B2 * 6/2004 Yamamoto et al. ..... 315/307
6,784,622 B2 * 8/2004 Newman et al. ..... 315/219
2002/0140376 A1 10/2002 Kamata et al. ..... 315/276

FOREIGN PATENT DOCUMENTS

EP 1235468 A2 8/2002 ..... H05B/41/36
WO 01/10175 A1 2/2001 ..... H05B/41/36
WO 01/98853 A1 12/2001 ..... G05F/1/00

* cited by examiner

*Primary Examiner*—Trinh Vo Dinh
(74) *Attorney, Agent, or Firm*—Bacon & Thomas PLLC

(57) ABSTRACT

A discharge lamp lighting device includes a discharge lamp that is lighted through an L-C resonance induced by an oscillation output of an inverter circuit. An on-off operation of switching elements of the inverter circuit is controlled by a control IC which includes a timer circuit for determining a timing of conversion between operation status signals, an inverter control circuit for outputting a driving signal to the switching elements, an output control circuit for controlling generation of the driving signal and an operation status output circuit for outputting a status signal corresponding at least to a lighting status. Further, the discharge lamp lighting device includes an operation setting circuit for inputting a status signal from the operation status output circuit and outputting a control signal to the output control circuit.

18 Claims, 45 Drawing Sheets

DISCHARGE LAMP LIGHTING DEVICE AND LIGHTING APPARATUS

FIELD OF THE INVENTION

The present invention relates to a device for lighting a discharge lamp with a high frequency power.

BACKGROUND OF THE INVENTION

Referring to FIG. 42, there is illustrated a conventional discharge lamp lighting device. The discharge lamp lighting device includes an AC power source AC employing a commercial power source; a noise-reducing filter chalk L3 connected in series to one end of the AC power source AC; a rectifier DB formed by a bridge connection of four diodes for the full-wave rectification of an output of the AC power source AC; a DC power source circuit 1 for converting the full-wave rectified output of the rectifier DB into a desired DC voltage; an inverter circuit 2 for converting the DC voltage outputted from the DC power source circuit 1 into a high frequency voltage; a load circuit 3 including at least one discharge lamp La and serving to light the discharge lamp La by using the high frequency voltage supplied from the inverter circuit 2; a chopper control integrated circuit (IC) (e.g., PFC control circuit) 400; an inverter control IC 4; and a control power source E1.

The DC power source circuit 1 includes a series circuit of an inductor L2 and a diode D1 coupled in series to a high-voltage output side of the rectifier DB; a capacitor C4 connected in parallel between the output terminals of the rectifier DB; a switching element Q3 coupled in parallel to the capacitor C4 via the inductor L2; and a smoothing capacitor C3 connected in parallel to the switching element Q3 via the diode D1. The DC power source circuit 1 configured as described serves as a boosting chopper circuit for obtaining the desired DC voltage by chopping the full-wave rectified voltage by way of on-off operating the switching element Q3.

The inverter circuit 2 is of a half-bridge type in which a series circuit of switching elements Q1 and Q2 formed of MOSFETs is connected between both ends of the smoothing capacitor C3. The inverter circuit 2 converts the DC voltage outputted from the DC power source circuit 1 into the high frequency voltage by turning the switching elements Q1 and Q2 on and off alternately.

The load circuit 3 includes a series circuit of a resonance inductor L1, a resonance capacitor C1 and a DC cutting capacitor C2 respectively coupled between a drain and a source of the switching element Q2 at a low voltage side; and the discharge lamp La coupled in parallel to the resonance capacitor C1. The load circuit 3 operates to light the discharge lamp La by using the high frequency voltage supplied from the inverter circuit 2.

The chopper control IC 400 is a PFC (power factor correction) control circuit serving to control an on-off operation of the switching element Q3. The chopper control IC 400 is capable of controlling an output voltage of the boosting chopper circuit regardless of variations in the input voltage or amount of a load and, at the same time, capable of converting a waveform of an input current of the rectifier DB to a sine wave analogous to a waveform of the input voltage. Employed as the chopper control IC 400 is, for example, a general-purpose power-factor improving IC such as MC33262 fabricated by Motorola, Inc.

The inverter control IC 4 includes an inverter (INV) control circuit 44 and a driving circuit 443 to serve as a so-called HVIC (High Voltage IC). The INV control circuit 44 outputs a control signal for controlling an on-off timing of the switching elements Q1 and Q2 of the inverter circuit 2 while the driving circuit 443 outputs a driving signal in response to the control signal provided from the INV control circuit 44 to directly drive the switching elements Q1 and Q2. By turning the switching elements Q1 and Q2 on and off alternately, a state in which power is supplied to the discharge lamp La from the smoothing capacitor C3 and a status in which power is supplied thereto from the DC cutting capacitor C2 are repeated alternately, so that the high frequency voltage is applied to the discharge lamp La, thereby allowing an alternating current of a high frequency to flow into the discharge lamp La.

Further, the inverter control IC 4 has an abnormality detection function for stopping an oscillation of the inverter circuit 2 in response to a detect signal S11 indicating expiration of the lifetime of the discharge lamp La and a dimming function for varying the output of the discharge lamp La in response to an external signal S10. The inverter control IC 4 is formed as a single chip incorporating therein these circuits.

Each of the chopper control IC 400 and the inverter control IC 4 employs a DC low voltage Vcc supplied from the DC voltage source E1 as a power source for operation thereof.

Referring to FIG. 43, there is illustrated a circuit configuration of another conventional discharge lamp lighting device, which is disclosed in Japanese Patent No. 3106592. The circuit configuration therein is substantially identical to that of the conventional device depicted in FIG. 42. Thus, explanations of like parts to those in FIG. 42 will be omitted, and like reference numerals will be used therefor.

In this prior art device, there are employed coils L2*a* and L2*b* magnetically coupled to an inductor L2 of a DC power source circuit 1, and source voltages Vcc1 and Vcc2 of a chopper control IC 400 and an INV control IC 4, respectively, are provided from voltages charged into capacitors C10 and C11 from the coils L2*a* and L2*b*.

Further, when the lifetime of a discharge lamp La is exhausted, the INV control IC 4 is reset (initialized) in response to a detect signal S11 serving as a reset signal to thereby stop an oscillation of an inverter circuit 2 while concurrently inputting the reset signal to a chopper control IC 400 as well via a reset circuit 46 to thereby stop a chopper operation of a DC power source circuit 1. As a result, the power consumption of the lighting device can be reduced during a time period when the oscillation is stopped while concurrently contributing to its safety improvement.

In the above-described conventional device, however, it is required to provide the separate ICs 400 and 4 for the control of the DC power source circuit 1 and the inverter circuit 2, respectively, thereby limiting the pattern wiring of a printed circuit board on which these circuit parts are formed. Furthermore, in case of stopping the DC power source circuit 1 when stopping the inverter circuit 2 at a time, e.g., when the lifetime of the discharge lamp La is nearly over, as in the conventional device shown in FIG. 43, a control part for controlling such an operation for stopping the DC power source circuit 1 is additionally required, thereby impeding the miniaturization of the discharge lamp lighting device. Consequently, it is likely that these control circuits are readily affected by external noises, resulting in a malfunctioning or an operational error thereof.

Disclosed in Japanese Patent No. 2001-401532 is a discharge lamp lighting device designed to provide a solution to the above problem. A detailed description of the circuit configuration and the operation thereof will be omitted since they are almost identical to those described with respect to the device shown in FIGS. 42 and 43. However, this third prior art device is distinguishable in that the INV control IC 4 and the chopper control IC 400 are formed as a single IC, thereby performing basic controls required in the discharge lamp lighting device through the use of just one single IC.

The basic controls required in the discharge lamp lighting device are specified as follows:

1) a PFC control for converting a waveform of an input current into a sine wave analogous to a waveform of an input voltage;
2) a timer control for determining an operation status conversion timing of a discharge lamp, e.g., from a preheating status to an ignition voltage application status and, finally, to a lighting status;
3) an inverter output control for determining an output of an inverter circuit in each of the operation statuses;
4) an output correction control for performing a dimming control for varying the output power of the discharge lamp or turning it off depending on a signal inputted from the exterior or by way of detecting a lighting status of the discharge lamp and then performing a feedback thereof; and
5) an abnormality detection control for changing an operational status of each of the above controls by way of detecting a failure of a power supply (or an instant surge of a voltage), an absence of the discharge lamp, and the remaining lifetime of the discharge lamp.

By implementing all these basic controls through the use of only one control IC, it becomes easier to mount each circuit element of the discharge lamp lighting device and form a pattern wiring on a printed circuit board. In addition, each control circuit of the lighting device can be protected against the external noises, so that a delay of an abnormality control signal that is provided as a control measure for an operational error can be prevented. Furthermore, an excessive stress imposed on each circuit element can be greatly reduced, thereby contributing to the miniaturization of the discharge lamp lighting device without causing any deterioration in functions required therein.

Recently, however, a further advanced control mechanism is required in a discharge lamp lighting device, and in a lighting apparatus and a lighting system employing the same. Japanese Patent Laid-open Publication No. 2001-15276 discloses one exemplary lighting apparatus employing such an improved control mechanism. FIG. 44 shows a circuit configuration thereof. A discharge lamp lighting device U1 illustrated in this apparatus employs a boosting chopper circuit and an inverter circuit, as in the above-described conventional examples, to thereby supply a high frequency power outputted from the inverter circuit to a discharge lamp La. Further, the power supplied to the discharge lamp La can be adjusted by varying an on/off cycle of switching elements Q1 and Q2. A unit U2 having a lighting period detecting unit 13 and an illumination correcting system 15 sends a dimming signal to the discharge lamp lighting device U1. The lighting period detecting unit 13 detects the voltage of an AC power source AC by a resistance type potential division and measures a time period during which the voltage of a smoothing capacitor C8 coupled to output terminals of a rectifier DB2 is maintained above a predetermined level by using a lighting timer 14. The illumination correcting system 15 and the lighting timer 14 may be implemented by employing a microcomputer. Incorporated in the microcomputer is a non-volatile memory 17, e.g., an EEPROM for reading and storing the time period measured by the lighting timer 14 and, further, storing therein a correction table employed by the illumination correcting system 15. The correction table defines an illumination rate for correction corresponding to duration of using the discharge lamp La. An illumination rate setting unit 18 included in the illumination correcting system 15 determines an illumination rate of the discharge lamp La by reading it from the non-volatile memory 17 by using the duration of use detected by the lighting timer 14.

FIG. 45 provides a flow chart for describing the above-described operations. Though the luminous flux of the discharge lamp La decreases due to the aging thereof as the duration of use increases as shown in FIG. 46A, the output power of the discharge lamp La can be maintained substantially constant as shown in FIG. 46C by way of performing a dimmed lighting for a certain period of time immediately after a replacement of the discharge lamp La and then gradually increasing the output power to a full lighting level while measuring the duration of use, as can be seen in FIG. 46B. Such an operation may prevent the output power of the discharge lamp La from being decreased due to the aging thereof and, further, an energy saving can be achieved, for the discharge lamp La is lighted dimly for the certain period after being replaced.

Hereinafter, there will be described a reset process of resetting data stored in the EEPROM for storing the time period measured by the lighting timer 14. The present example executes such resetting processes as follows:

(1) the data is reset when a result of detecting a voltage across both ends of the discharge lamp La reveals that the lifetime thereof has elapsed;

(2) the data is reset when it is found that the current status is a no-load status by detecting whether or not the discharge lamp La is connected to the lighting device;

(3) the data is reset when no AC power source AC is supplied to the lighting device and thus the current status is determined as a no-load status; and (4) the data is reset by a reset switch mechanically operated by a user of the lighting apparatus.

In the ensuing discussion, problems occurring when performing the above resetting processes will be described.

In the resetting process (1), resetting is performed when, by detecting the voltage across both ends of the discharge lamp La, it is found that the lifetime of the discharge lamp has elapsed. Since, however, the lighting time detecting circuit for detecting the lighting period of the discharge lamp La and the circuit for detecting whether or not the lifetime of the discharge lamp La has elapsed are implemented as separate circuit elements, the number of parts required is increased, hampering the size reduction of the discharge lamp lighting device.

Further, in case the control IC described above has a function for stopping an inverter operation by detecting the lifetime of the discharge lamp, the resetting of the memory data of the EEPROM should be completed before stopping the operation of the inverter at a point of time when the lifetime of the discharge lamp has almost exhausted. However, since respective criteria based on which the discharge lamp lighting device and the illumination rate correction device detect the lifetime of the discharge lamp are different from each other, the data of the EEPROM may be reset well in advance of the elapse of the lifetime. After the resetting of the data, the discharge lamp lighting device is lighted as in the initial stage of the lifetime (see FIG. 46B), which makes it difficult to control the output power of the discharge lamp lighting device to be constant.

Furthermore, in case the control IC described above has a function for stopping the inverter in a no-load status in which the discharge lamp is not connected to the lighting device, there is a likelihood that the time period measured by the lighting timer is stored as a wrong value since it is impossible to distinguish a state where the discharge lamp is lighted by the operation of the inverter circuit from the no-load status where the operation of the inverter is stopped. Accordingly, it is required to additionally install a circuit for detecting the no-load status in the lighting timer for detecting the lighting period in order to determine, based on a detect signal provided from the no-load status detecting circuit, whether to stop the timer operation or stop writing the lighting period into the EEPROM in the state where the operation of the inverter circuit is stopped. As a result, the number of parts required increases to thereby make a wiring complicated on the printed circuit board.

In the resetting process (2), resetting is carried out when the discharge lamp is found to be in a no-load status by checking a connection of the discharge lamp to the lighting device. However, as in the resetting process (1), since the lighting timer for detecting the lighting period and the circuit for detecting the no-load status are two separate circuits, the number of parts required increases, thereby impeding the size reduction of the discharge lamp lighting device.

Further, in case the control IC described above has a function to stop the operation of the inverter by detecting the lifetime of the discharge lamp, it is possible that the time period measured by the lighting timer is stored as a wrong value, as in the resetting process (1), since it is impossible to distinguish a state where the discharge lamp is lighted by the operation of the inverter circuit from a state where the operation of the inverter is stopped at a time when the lifetime of the discharge lamp has nearly elapsed.

Moreover, if the lamp is replaced with a new one while an AC power source is turned off, the data stored in the EEPROM cannot be reset and, thus, a predetermined output power of the discharge lamp may not be obtained. Further, since there is required a battery means for supplying a stable source voltage to the no-load detecting circuit and the illumination correcting system within the discharge lamp lighting device in order to reset the data of the EEPROM in a no-load state regardless of the supply from the AC power source, the size of the discharge apparatus and costs involved become increased.

In the resetting process (3), the data is reset when it is found that the current state is a no-load state where the AC power source AC is not provided to the lighting device. However, it also requires a battery means for supplying a stable source voltage to the no-load detecting circuit and the illumination correcting circuit within the discharge lamp lighting device, as in the case of the resetting process (2).

Meanwhile, the resetting process (4) is directed to performing a reset by using a mechanically operated reset switch. Japanese Patent Laid-Open Publication No. 2001-338783 discloses a lighting apparatus of this type, which is illustrated in FIG. 47. As shown therein, a reset switch S2 is installed on a surface of a main body 50 of the lighting apparatus and is connected to a discharge lighting device 54 via a wiring 53. Though using the reset switch S2 in the discharge lamp lighting device incorporating therein the control IC described above is advantageous in that the data of the EEPROM can be securely reset regardless of functions set in the control IC, there still remain problems related to, e.g., an installation of the switch S2, the wiring 53 between the switch S2 and the discharge lighting device 54, and a connection of the wiring 53 to the discharge lighting device 54.

SUMMARY OF THE INVENTION

It is, therefore, a primary object of the present invention to provide a small-sized discharge lamp lighting device capable of realizing a highly complicated control by mounting, e.g., a microcomputer, therein while minimizing the number of parts required.

In accordance with the present invention, there is provided a discharge lamp lighting device comprising: a rectifier for rectifying an AC power source; a DC power source circuit including at least one smoothing capacitor and connected to an output terminal of the rectifier; an inverter circuit, which includes two switching elements coupled in series to each other and is connected to an output terminal of the DC power source circuit, for turning the switching elements on and off alternately; a load circuit, which includes at least one resonance inductor, resonance capacitor and discharge lamp, for lighting the discharge lamp by a resonance generated by using a high frequency voltage inputted from the inverter circuit; a control IC for controlling operations of the switching elements of the inverter circuit; and a control power source circuit for supplying a control power to the control IC, wherein the control IC includes: a first timer unit for determining a status conversion timing for performing a shift from a preheating status, where a filament of the discharge lamp is preheated, to an ignition status, where an ignition voltage is applied to the discharge lamp, and finally to a lighting status, where the discharge lamp is lighted with a predetermined output power; a first control unit for determining an on/off timing of the switching elements of the inverter circuit based on a control signal provided from the first timer unit and outputting a driving signal to the switching elements of the inverter circuit; a second control unit for controlling a variation in the cycle of the driving signal and a generation of the driving signal provided from the first control unit based on a control signal inputted from an exterior of the control IC to perform a dimming control of the discharge lamp or a control of the inverter circuit; an operation status output unit for outputting a predetermined status signal corresponding to an operational status of the IC control circuit; and an operation setting circuit for inputting the status signal provided from the operation status output unit and outputting a control signal to the second control unit, wherein the operation status output unit outputs a status signal corresponding to at least said lighting status.

BRIEF DESCRIPTION OF THE DRAWINGS

The above and other objects and features of the invention will become apparent from the following description of preferred embodiments given in conjunction with the accompanying drawings, in which.

DETAILED DESCRIPTION OF THE PREFERRED EMBODIMENTS

Figure 1:
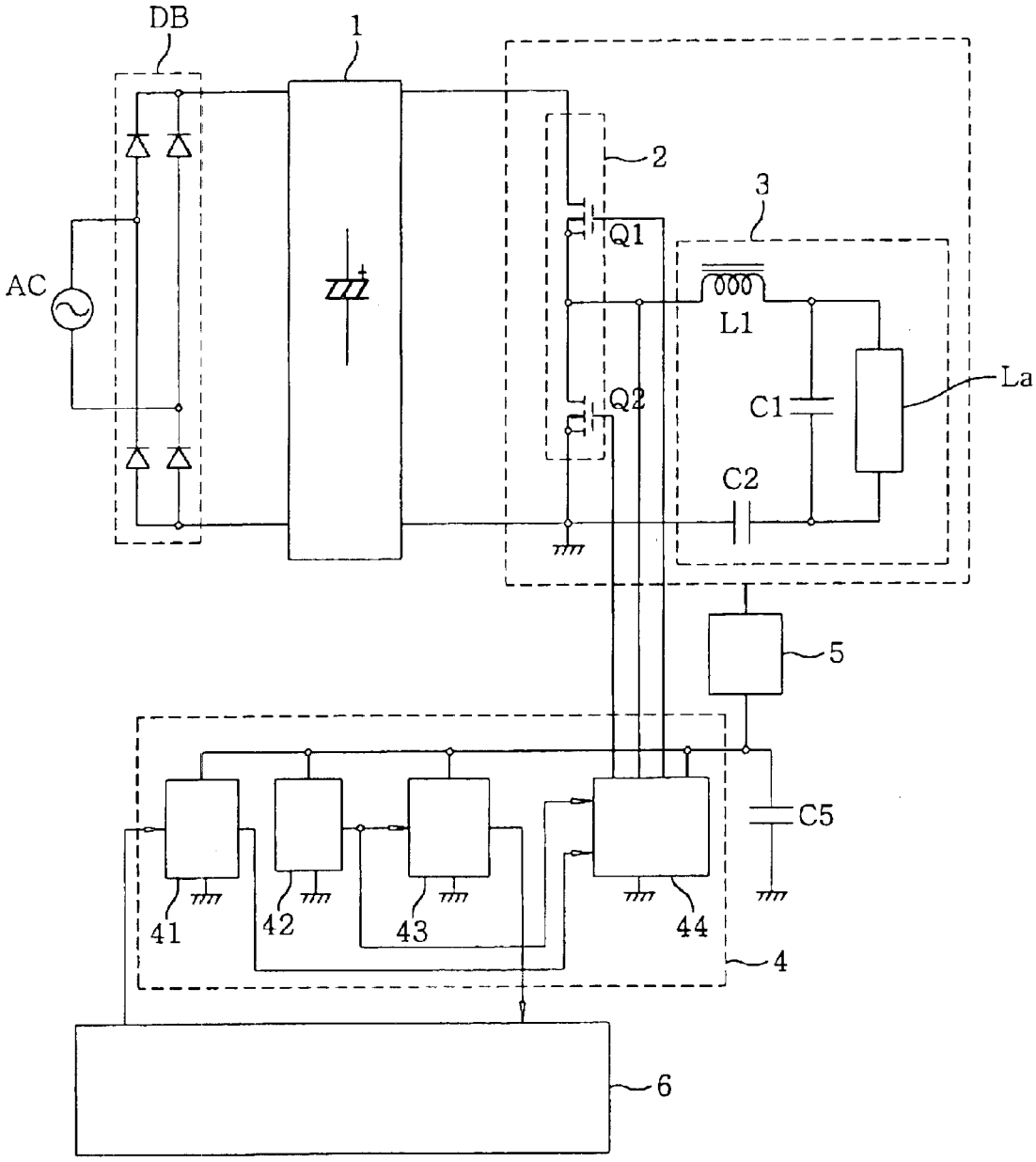
FIG. 1 illustrates a circuit diagram of a discharge lamp lighting device in accordance with a first preferred embodiment of the present invention.

Referring to FIG. 1, there is described a basic configuration of a discharge lamp lighting device in accordance with the present invention. The basic configuration thereof is almost identical to those of the conventional examples. That is, the discharge lamp lighting device includes an AC power source AC; a rectifier DB for rectifying an AC source power inputted from the AC power source AC; a DC power source circuit 1 for smoothing an output of the rectifier DB; an inverter circuit 2 having a series circuit of switching elements Q1 and Q2 connected to respective output terminals of the DC power source circuit 1; a load circuit 3 having at least one resonance inductor L1, resonance capacitor C1 and discharge lamp La; a control power source circuit 5 coupled to either one of the inverter circuit 2 and the load circuit 3 to supply a control power to a control IC 4; and the control IC 4 for controlling an on-off timing of the switching elements Q1 and Q2 by using a driving signal outputted from a terminal incorporated therein. The lighting device lights the discharge lamp La by turning the switching elements Q1 and Q2 on and off alternately. A control signal outputted from an operation setting circuit 6 is inputted to the control IC 4 and, in turn, a status signal corresponding to an operational status of the control IC 4 is inputted to the operation setting circuit 6.

In the following, there will be provided detailed descriptions of respective configurations of the control IC 4 and the operation setting circuit 6 and operations thereof.

First Preferred Embodiment

Figure 2:
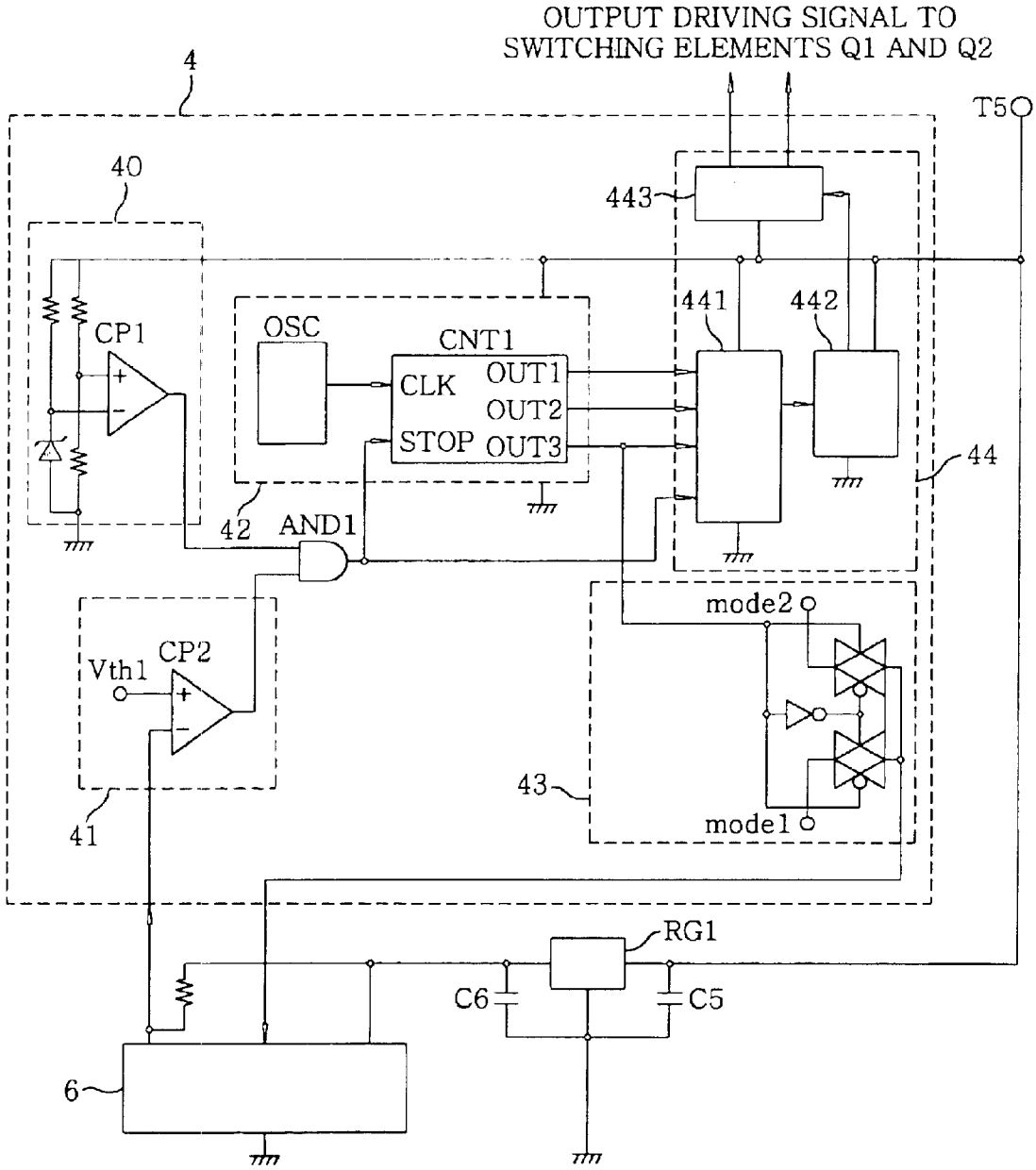
FIG. 2 describes a circuit diagram of a control IC in accordance with the first preferred embodiment of the present invention.

FIG. 2 shows a detailed circuit diagram of the control IC 4. The control IC 4 in the first embodiment includes a control power terminal T5 to which a control power voltage provided from the control power source circuit 5 is inputted; a control power detecting circuit 40 for detecting a control power level inputted from the control power source terminal T5; a timer circuit 42 having an oscillator OSC for generating a basic clock signal and a counter circuit CNT1 for counting such clock signals and outputting a signal when a count number thereof reaches a predetermined value; an inverter (INV) control circuit 44 for determining an on/off timing of the switching elements Q1 and Q2 of the inverter circuit 2 based on the signal from the counter circuit CNT1 and outputting respective driving signals to the switching elements Q1 and Q2; an operation status output circuit 43 for outputting a predetermined signal to the operation setting circuit 6 in response to the signal inputted from the counter circuit CNT1; and an output control circuit 41 for outputting a signal to the INV control circuit 44 in response to a signal inputted from the operation setting circuit 6 to thereby control the on-off timing of the switching elements Q1 and Q2 of the inverter circuit 2.

First, a basic operation of the INV control circuit 44 is as follows. The INV control circuit 44 includes a status converting circuit 441 for outputting a cycle conversion signal for converting an on-off cycle of the switching elements Q1 and Q2 in response to the signal outputted from the counter circuit CNT1; an inverter (INV) cycle setting circuit 442 for determining the on-off cycle of the switching elements Q1 and Q2 by receiving the signal inputted from the status converting circuit 441; and a driving circuit 443 for outputting a driving signal for controlling on off operations of the switching elements Q1 and Q2 based on the cycle determined by the INV cycle setting circuit 442.

Figure 3:
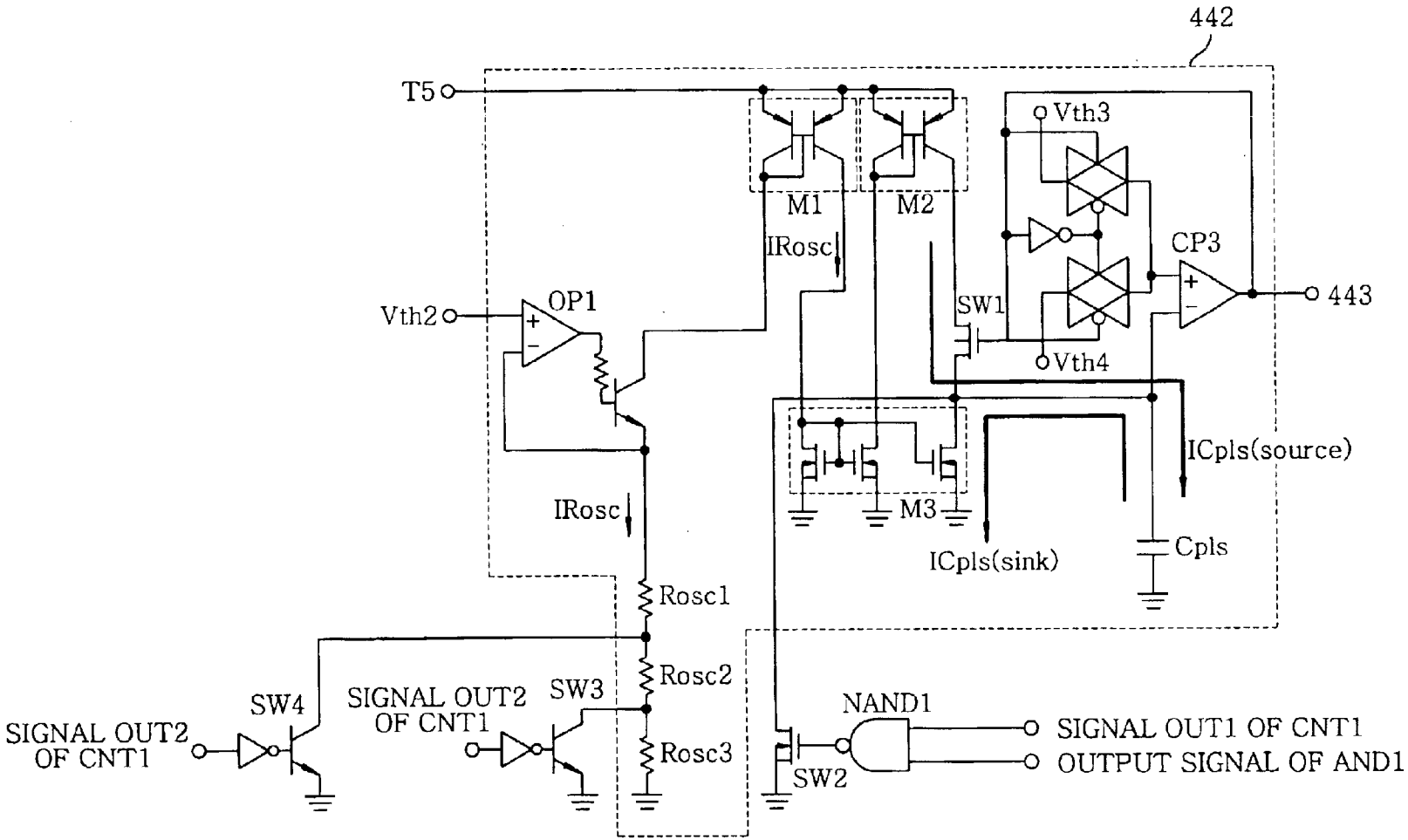
FIG. 3 shows an example of an INV control circuit in accordance with the first preferred embodiment of the present invention.

FIG. 3 illustrates a detailed exemplary configuration of the INV control circuit 44. The INV control circuit 44 determines the on-off cycle of the switching elements Q1 and Q2 based on respective resistance values of resistors Rosc1, Rosc2 and Rosc3 connected inside or outside the control IC 4 and a capacity of a capacitor Cpls. The resistors Rosc1, Rosc2 and Rosc3 are preferably coupled to an output terminal of a buffer circuit having an operational amplifier OP1 (the buffer circuit controls a base potential of a transistor serving as an emitter follower based on an output of the operational amplifier OP1 such that a voltage Vth2 at a plus (+) input terminal of the operational amplifier OP1 and an emitter potential of the transistor are same). An output voltage of the buffer circuit is almost identical to the input threshold voltage Vth2. Thus, a current IRosc flowing through the resistors Rosc1, Rosc2 and Rosc3 can be approximately calculated by using the following equation.

$$IRosc=Vth2/(Rosc1+Rosc2+Rosc3)$$

The current IRosc determines respective values of a charging current and a discharging current of the capacity of the capacitor Cpls through mirror circuits M1, M2 and M3. If a switch element SW1 is on, a charging current ICpls (source) flows into the capacitor Cpls via the mirror circuit M2. If the switch element SW1 is off, on the other hand, a discharging current ICpls (sink) flows through the mirror circuit M3, for a charging path is cut by a turning-off of the switching element SW1.

Figure 4:
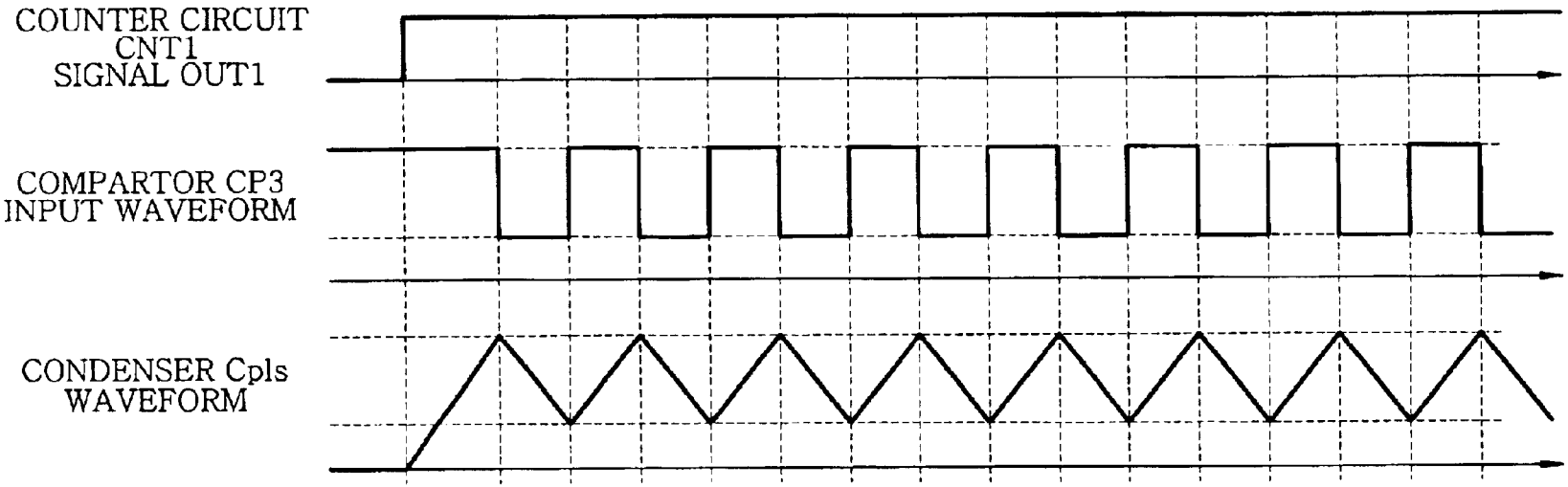
FIG. 4 provides a chart showing waveforms representing charging and discharging operations of a condenser included in an inverter cycle setting circuit in accordance with the first preferred embodiment of the present invention.

Respective waveforms of a charging voltage and a discharging voltage of the capacitor Cpls are inputted to a minus (−) terminal of a comparator CP3. On the other hand, either threshold value Vth3 or Vth4 is inputted to a plus (+) terminal thereof by an analog switch circuit. Accordingly, a voltage waveform of the capacitor Cpls is found to be of a chopping wave as shown in FIG. 4. Further, an output signal of the comparator CP3 is of a rectangular waveform having a cycle identical to a cycle of charging and discharging the capacitor Cpls and is provided to the driving circuit 443 to thereby drive the switching elements Q1 and Q2 of the inverter circuit 2.

If the switch element SW2 is on, the charging current flowing toward the capacitor Cpls is introduced into the switch element SW2, so that the voltage waveform of the capacitor Cpls is maintained at about 0 V. As a result, the signal outputted to the driving circuit 443 is kept in an "L" state (low level state) and, thus, the switching elements Q1 and Q2 of the inverter circuit 2 are turned off.

Figure 5:
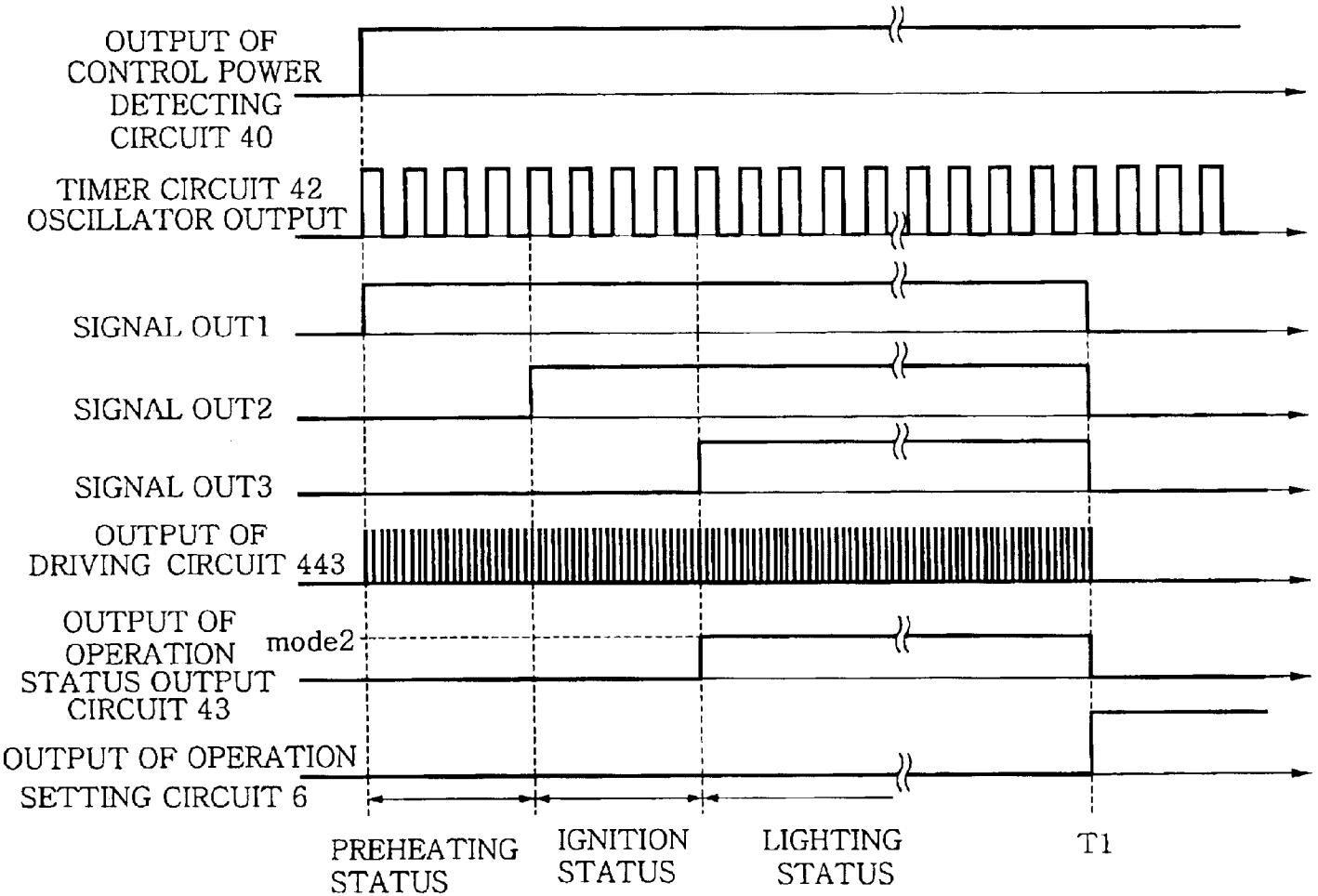
FIG. 5 charts operational waveforms to describe an operation of the control IC in accordance with the first preferred embodiment of the present invention.

Next, a basic operation of the control IC 4 will be described with reference to a timing chart shown in FIG. 5. As the control power is supplied from the control power source circuit 5 to the control IC 4, the control power level of the control IC 4 increases. The control power is supplied to each circuit part and, at the same time, a signal obtained by a resistance type potential division of the control power is inputted to a plus (+) terminal of the comparator CP1 (See FIG. 2). Meanwhile, a reference voltage generated by the resistors and a zener diode is inputted to a minus (−) terminal of the comparator CP1 to be compared with the signal inputted through the plus (+) terminal thereof. If a voltage of the signal obtained by the resistance type potential division becomes higher than the reference voltage due to the increase of the control power level, an output of the comparator CP1 is inverted into an "H" state (high level state).

Then, the output signal of the comparator CP1 is inputted to the counter circuit CNT1 and the status converting circuit 441 via an AND element AND1. In the first embodiment, in case a STOP input of the counter circuit CNT1 is "L", its counting operation is stopped and the counter circuit CNT1 is reset into an initial state. Accordingly, when the control power level is low, the operation of the counter circuit CNT 1 is stopped and then, if the control power level is increased high, the counting operation for counting clock signals inputted from the oscillator OSC to the counter circuit CNT 1 is resumed. Though a detailed circuit diagram of a circuit positioned at an output signal terminal of the counter circuit CNT1 is not provided, a data latch can be performed by inputting to a flip-flop circuit a signal representing a count number, which is generated by a combinational circuit employing logic elements such as an AND gate and an OR gate. By such a configuration, output signals OUT1, OUT2 and OUT3 of the counter circuit CNT1 will have waveforms described in FIG. 5.

Herein, it is assumed that the inverter circuit starts its operation and turns into a 'preheating status' when OUT1="H" while OUT2=OuT3="L"; an operational frequency of the inverter circuit is changed and turned into an 'ignition status' when OUT1=OUT2="H" while OUT3="L"; and the operational frequency of the inverter circuit is changed again and turned into a 'lighting status' when OUT1=OUT2=OUT3="H".

Though the basic operation of the INV control circuit 44 has been described with reference to FIGS. 3 and 4, a frequency conversion of the inverter circuit 2 in the preheating, the ignition and the lighting status may be preferably carried out as described in FIG. 5. That is, the operation of the inverter circuit 2 is initiated as follows. The output signal OUT1 of the counter circuit CNT1 and an output signal of the AND element AND1 are inputted to an NAND element NAND1, and an output of the NAND element (NAND1) becomes "L" when the two signals inputted thereto are both "L". As a result, the switch element SW2 is turned off, thereby allowing for the charging and the discharging operation of the capacitor Cpls described above.

At this time, the output signal OUT2 of the counter circuit CNT1 is inputted to a switch element SW4 via an inverting element (NOT circuit) while the output signal OUT3 of the counter circuit CNT1 is inputted to a switch element SW3 via the inverting element (NOT circuit). Therefore, when OUT2=OUT3="L", the switch elements SW3 and SW4 are both turned on. When both of them are in on state, in an equivalent circuit of the circuit shown in FIG. 3, the current IRosc flowing through the Rosc1 is determined by taking a resistance value of only the resistor Rosc1 into consideration. If the current IRosc has a large value, the cycle of the chopping wave of the voltage across both ends of the capacitor Cpls (See FIG. 4) is shortened, thereby making the inverter circuit 2 operate at a higher frequency. The operation of the inverter circuit 2 in such a case is defined as an operation in the preheating status.

Then, the switch SW3 is still remained to be turned on while the switch SW4 is turned off in the ignition status. Therefore, the operational frequency of the inverter circuit 2 is determined based on a value of a current flowing through a serial resistor including Rosc1 and Rosc2. The operational frequency thus obtained is found to be lower than that in the preheating status.

Further, in the lighting status, both the switch elements SW3 and SW4 are kept in off states, and the operational frequency of the inverter circuit 2 is determined based on a value of a current flowing through a serial resistor including Rosc1, Rosc2 and Rosc3. The operational frequency in this status is lower than that in the ignition status.

By carrying out such controls as described above, a preheating of the discharge lamp La is first conducted by a resonance between the resonance inductor L1 and the resonance capacitor C1 of the load circuit 3 and, then, a predetermined ignition voltage is applied to thereby light the discharge lamp La with a preset output power.

Next, the operation status output circuit 43 will be described. The operation status output circuit 43 includes a plurality of analog switches. In the example provided in FIG. 2, the output signal OUT3, which is outputted from the timer circuit 42 to convert the operational status of the inverter circuit 2 into the lighting status, is inputted to the operation status output circuit 43. An analog switch circuit including the plurality of analog switches is turned on or off depending on the signal OUT3 to output a predetermined threshold value mode2 in case of OUT3="H" or a predetermined threshold value mode1 in case of OUT3="L". By this operation, an output signal from the operation status output circuit 43 is determined as mode1 (0 V in FIG. 5) in the preheating status and the ignition status while it is outputted as mode2 in the lighting status, as shown in FIG. 5. The outputs of the analog switch circuit are inputted to the operation setting circuit 6 through a single line arranged at the exterior of the control IC 4.

The operation setting circuit 6 can have any configuration only if it has, e.g., a microcomputer, as described in the conventional examples. Once the control power is supplied to the control. IC 4, it is delivered to the operation setting circuit 6 via a voltage regulator (RG1), thereby initiating the operation of the operation setting circuit 6. The operation setting circuit 6 operates as follows, for example. By measuring and storing a lighting period, the operation setting circuit 6 outputs an "L" signal while the lighting period does not reach a predetermined time T1, and outputs an "H" signal when the lighting period reaches the predetermined time T1.

The output signal of the operation setting circuit 6 is inputted to the output control circuit 41 of the control IC 4. The output control circuit 41 includes a comparator CP2 and serves to compare the predetermined threshold value Vth1 with the output signal of the operation setting circuit 6. In case the output signal of the operation setting circuit 6 is "H", an output of the comparator CP2 is found to be "L". The output of the comparator CP2 is inputted to a terminal of the AND element AND1 and the output of the AND element AND1 is set to be "L" when the output of the comparator CP2 is "L". As described before, if the STOP input of the counter circuit CNT1 of the timer circuit 42 is "L", the counter circuit CNT1 stops its operation and is reset to its initial state. As a result, the output signal OUT1 of the counter circuit CNT1 is set as "L" and the switching elements Q1 and Q2 of the inverter circuit 2 are turned off. Thus, the inverter circuit 2 maintains the stop status in accordance with the output of the operation setting circuit 6.

In the first embodiment, by providing the operation status output circuit 43 in the control IC 4 and outputting through a single line a predetermined threshold signal corresponding to an operational status determined by the timer circuit 42, a unit for detecting a lighting status of the discharge lamp and a wiring of a detect signal are not required anymore unlike in the conventional cases. Therefore, the number of parts involved decreases, and a part of wirings on a printed circuit board, on which circuit elements are mounted, can be eliminated or simplified, thereby making it possible to further reduce the size of the discharge lamp lighting device.

Figure 44:
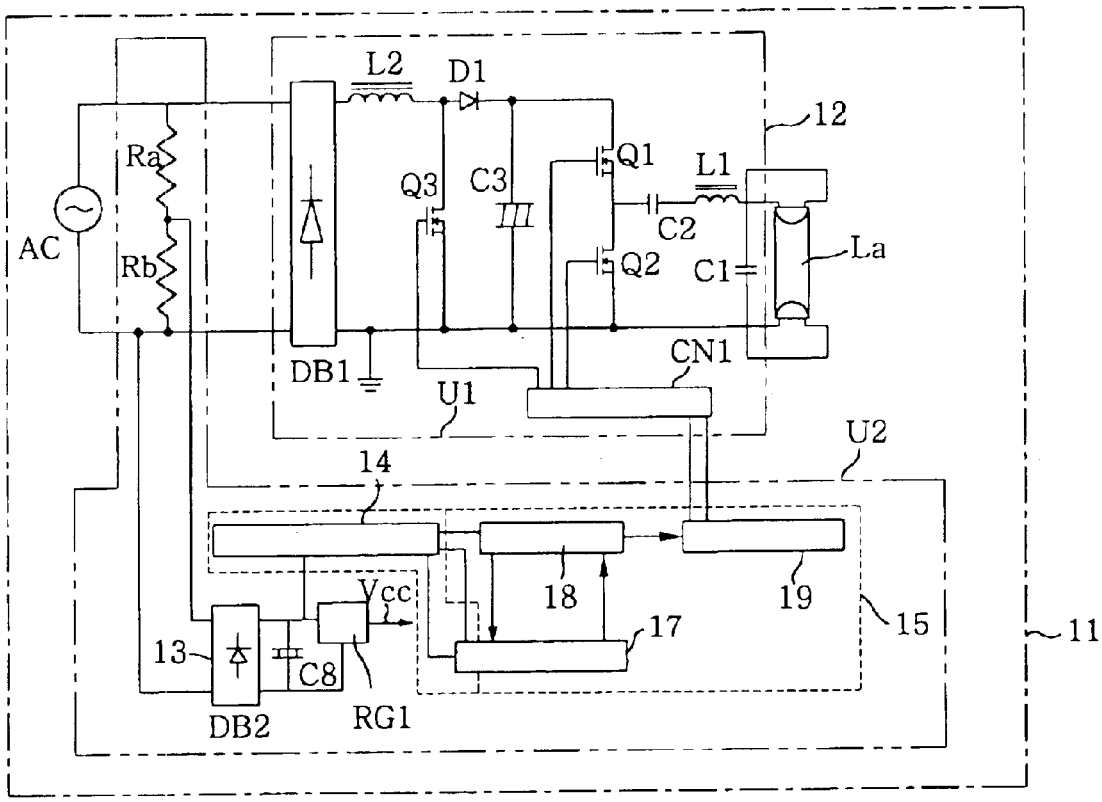
FIG. 44 (PRIOR ART)
FIG. 44 is a circuit diagram of a third example of a discharge lamp lighting device in accordance with the prior art.
Figure 45:
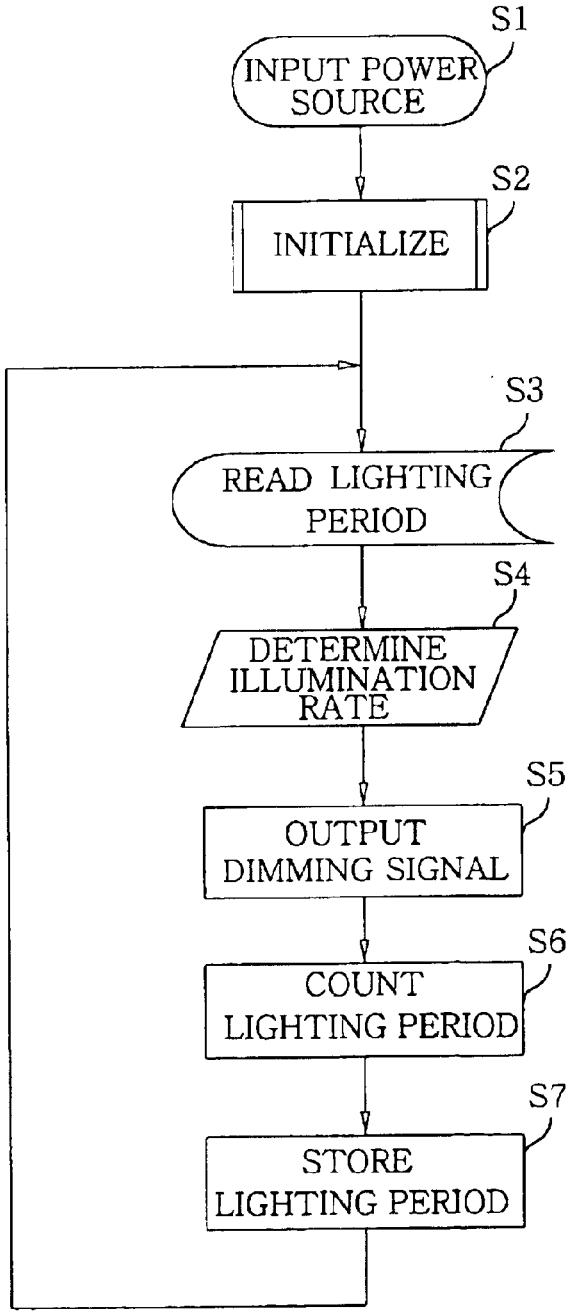
FIG. 45 (PRIOR ART)
FIG. 45 describes a flowchart showing an operation of the third example of the discharge lamp lighting device in accordance with the prior art.
Figure 46A:
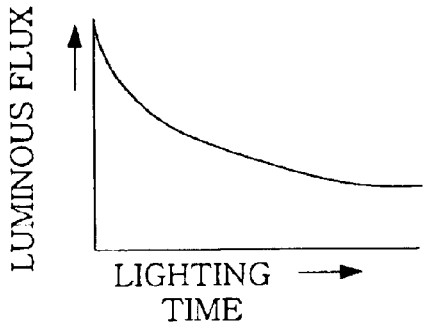
FIGS. 46A to 46C are graphs showing status of the third example of the discharge lamp lighting device in accordance with the prior art when an intensity of illumination is corrected at an initial stage of its lifetime.
Figure 46B:
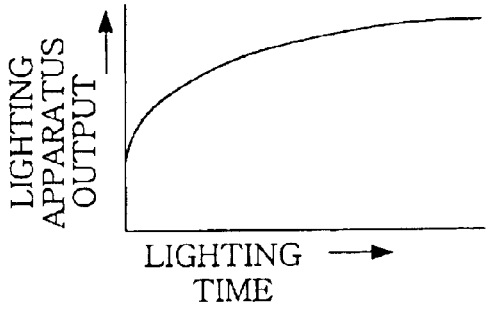
Figure 46C:
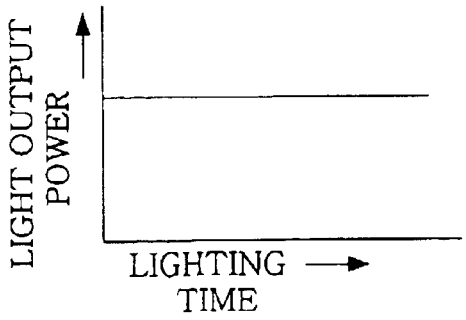

Furthermore, though the inverter circuit 2 has been described to be stopped by an operation of measuring and storing a lighting time period in the operation setting circuit 6 in the first embodiment, a control scheme identical to that described in the conventional example with reference to FIG. 46 can be employed instead in case of utilizing a control IC having a function of varying the operational frequency of the inverter circuit 2, e.g., a microcomputer and EEPROM as in the conventional examples described in FIGS. 44 and 45.

Second Preferred Embodiment

Figure 6:
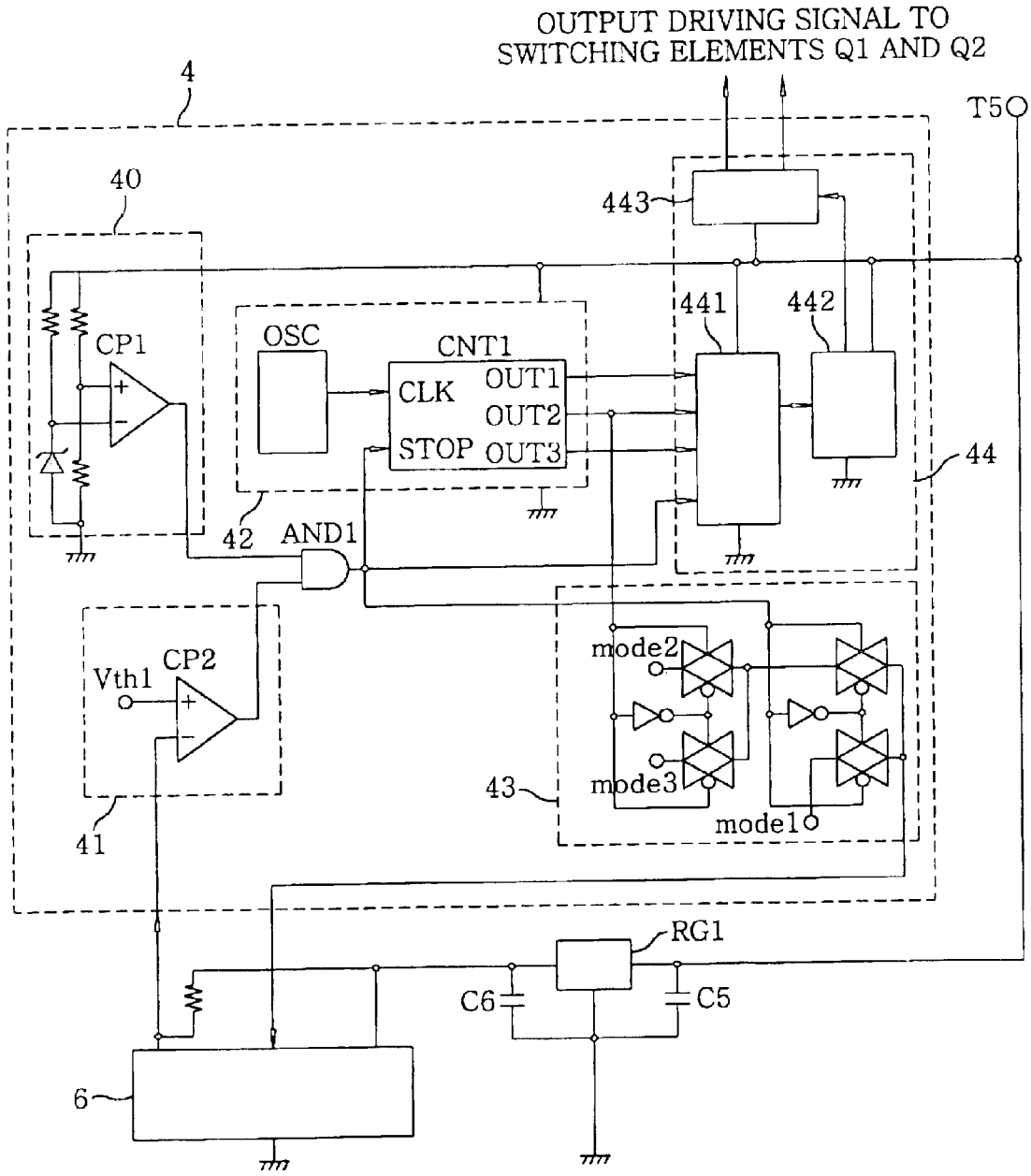
FIG. 6 presents a circuit diagram of a control IC in accordance with a second preferred embodiment of the present invention.
Figure 7:
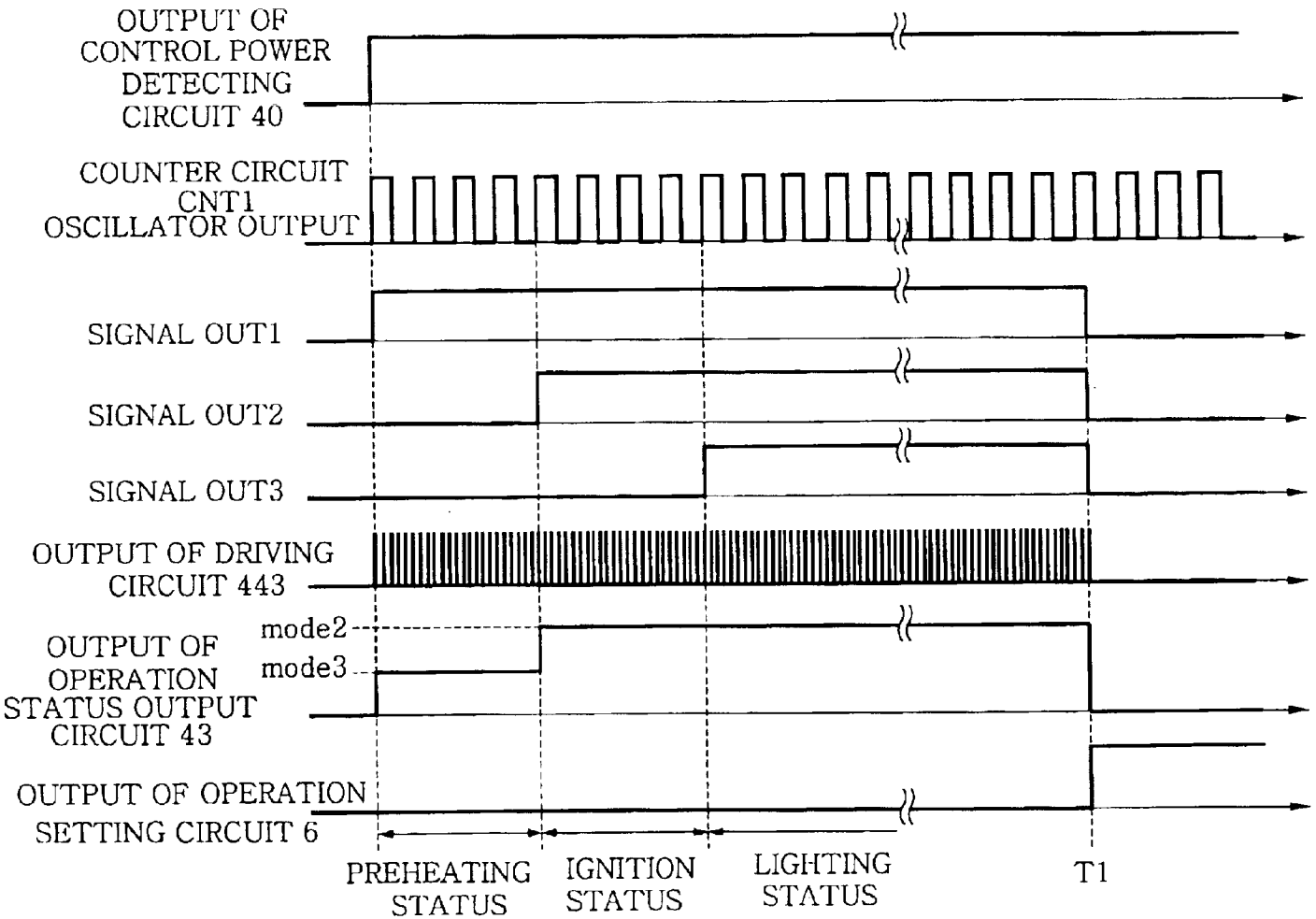
FIG. 7 provides operational waveforms to describe an operation of the control IC in accordance with the second preferred embodiment of the present invention.

FIG. 6 shows a circuit diagram of a control IC 4 in accordance with a second preferred embodiment and FIG. 7 charts operational waveforms thereof. The control IC 4 in the second embodiment includes a control power terminal T5 to which a control power voltage provided from the control power source circuit 5 is inputted; a control power detecting circuit 40 for detecting a control power level inputted from the control power terminal T5; a timer circuit 42 having an oscillator OSC for generating basic clock signals and a counter circuit CNT1 for counting the clock signals and outputting a signal when a count thereof reaches a predetermined value; an inverter (INV) control circuit 44 for determining an on/off timing of the switching elements Q1 and Q2 of the inverter circuit 2 depending on the signal from the counter circuit CNT1 and outputting respective driving signals to the switch elements Q1 and Q2; an operation status output circuit 43 for outputting a predetermined signal to the operation setting circuit 6 in response to the signal inputted from the counter circuit CNT1; and an output control circuit 41 for outputting a signal to the INV control circuit 44 in response to a signal inputted from the operation setting circuit 6 to thereby control the on-off timing of the switching elements Q1 and Q2 of the inverter circuit 2. Such configuration of the control IC 4 in the second embodiment is identical to that described in the first embodiment except that the configuration of the operation status output circuit 43 is different from that in the first embodiment. Basic operations of the timer circuit 42 and the INV control circuit 44 are the same as described in the first embodiment, and signals OUT1, OUT2 and OUT3 for converting the operational status of the discharge lamp La into one of a preheating status, an ignition status and a lighting status are outputted from the counter circuit CNT1.

The operation status output circuit 43 is an analog switch circuit including a plurality of analog switches. Inputted to this analog switch are an output signal of an AND element AND1, to which outputs of the control power detecting circuit 40 and the output control circuit 41 are inputted, and the signal OUT2 outputted from the counter circuit CNT1 to serve to convert the operation of the inverter circuit 2 into the ignition status. Further, operation status output circuit 43 operates to output a predetermined threshold value mode1 (0 V in FIG. 7) when the output signal of the AND element AND1 and the signal OUT2 are both "L"; output a preset threshold value mode3 when the output signal of the AND element AND1 is "H" while the signal OUT2 is "L"; and output a prescribed threshold value mode2 when the output signal of the AND element AND1 and the signal OUT2 are both "H". The output signals of the operation status output circuit 43 are inputted to the operation setting circuit 6 as in the first embodiment.

In this embodiment, the operation setting circuit 6 operates to count an accumulated number of the preheating statuses performed so far when the output signal of the operation status output circuit 43 is mode3, i.e., in case the inverter circuit 2 is in the preheating status. Further, the operation setting circuit 6 operates to measure and store a lighting period when the output signal of the operation status output circuit 43 is mode2, i.e., in case the inverter circuit 2 is in the ignition and the lighting status.

Further, the signal outputted from the operation setting circuit 6 to the output control circuit 41 of the control IC 4 is actually provided from a data table which is set in accordance with the accumulated number of the preheating status and the lighting period described above. The data table is stored in the EEPROM and, when a predetermined condition between the accumulated number of the preheating statuses and the lighting period is satisfied, the signal of the operation setting circuit 6 is outputted as "H". In such a case, the inverter circuit 2 maintains its stop state, as in the first embodiment.

In the second embodiment, by providing the operation status output circuit 43 in the control IC 4 and outputting through a single line a preset threshold value signal corresponding to an operational status determined by the timer circuit 42, a part of wirings formed on a printed circuit board on which circuit parts are mounted can be eliminated or simplified, as in the first embodiment. Furthermore, since the operation setting circuit 6 can detect the operational status of the inverter circuit 2, i.e., whether the inverter circuit is in the preheating status, the ignition status or the lighting status, it is possible to execute a complicated control based on the operational status of the inverter circuit 2.

Third Preferred Embodiment

Figure 8:
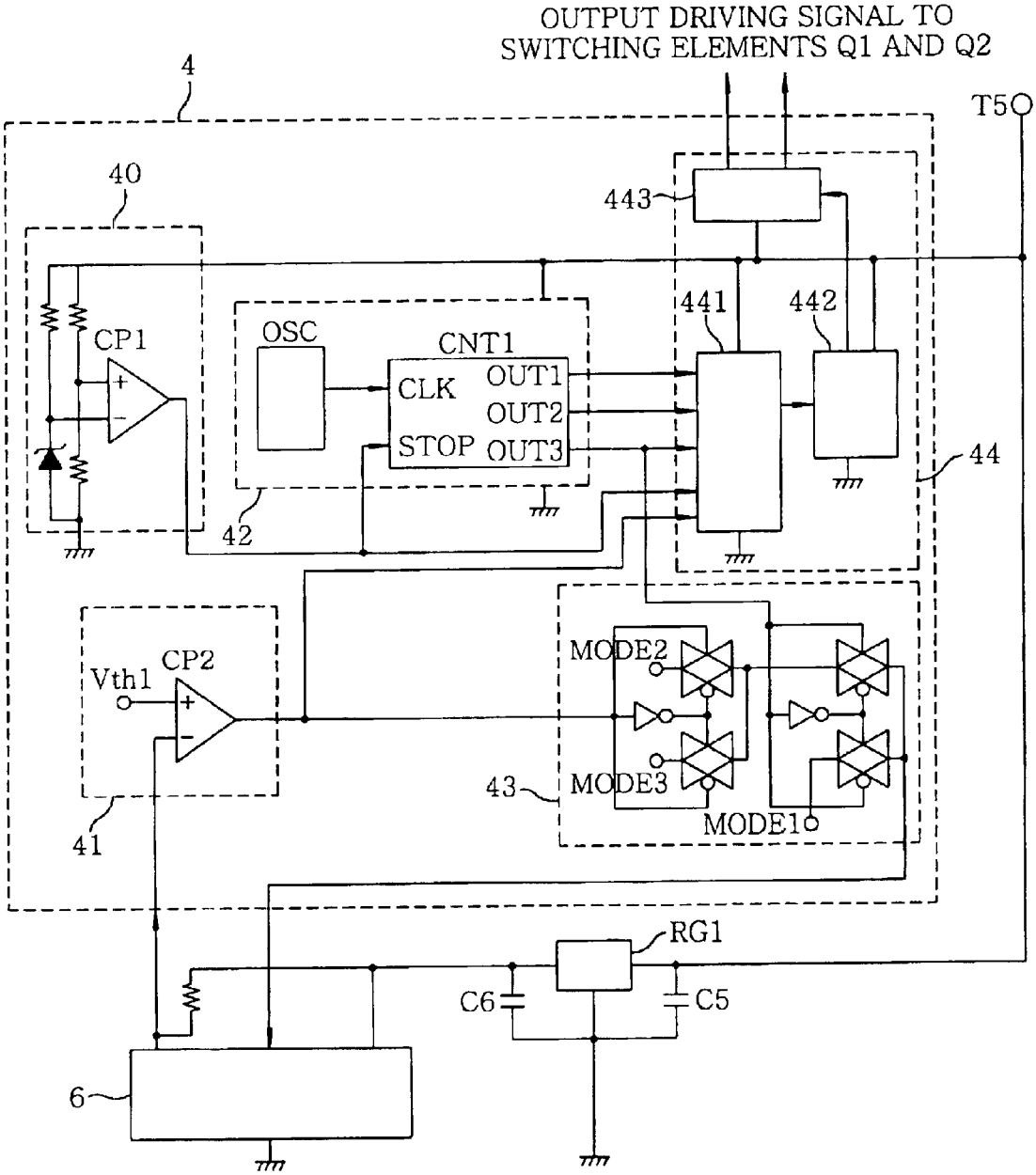
FIG. 8 is a circuit diagram of a control IC in accordance with a third preferred embodiment of the present invention.
Figure 9:
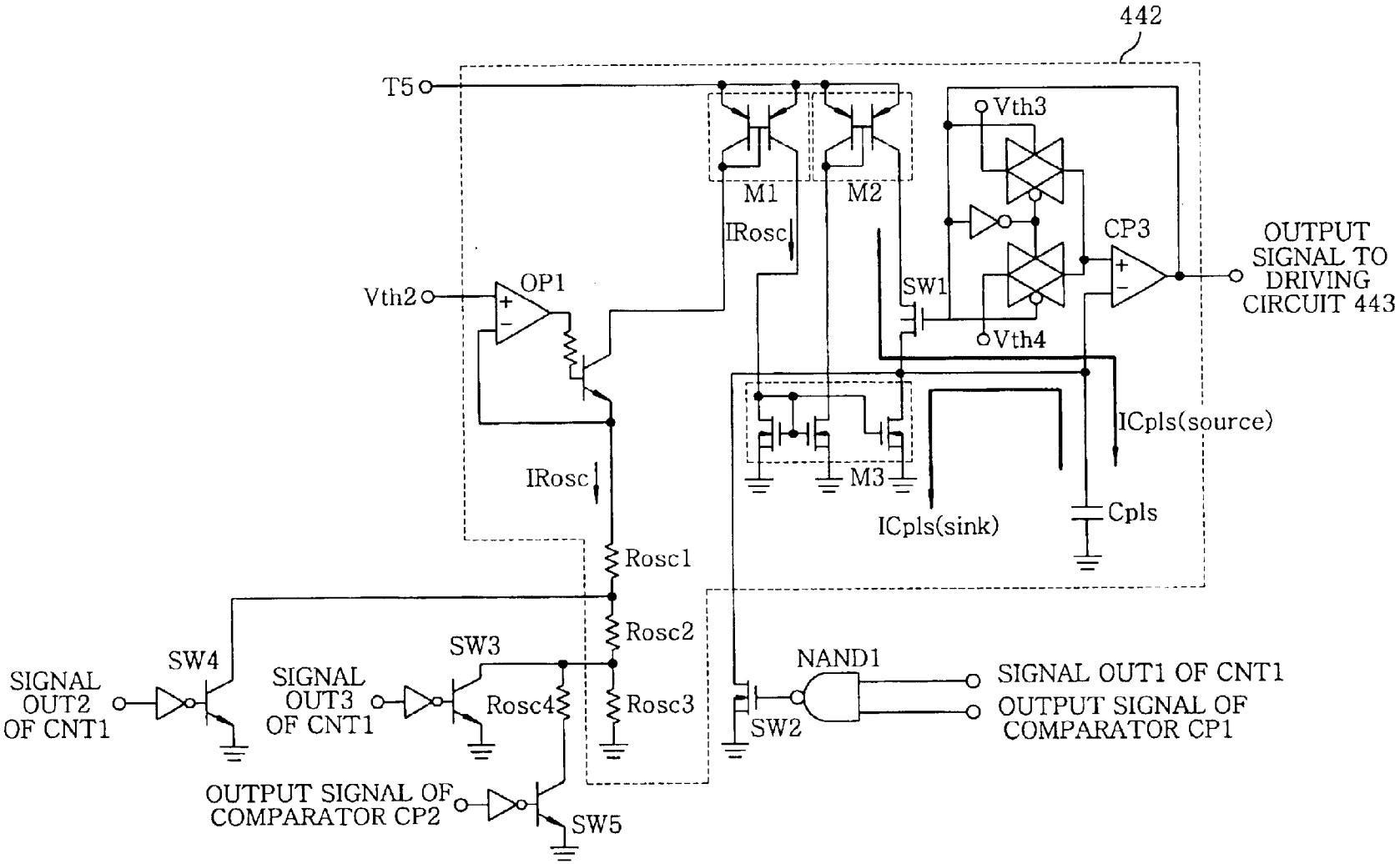
FIG. 9 shows a circuit diagram showing an example of an INV control circuit in accordance with the third preferred embodiment of the present invention.

FIG. 8 shows a circuit diagram of a control IC 4 in accordance with a third preferred embodiment of the present invention and FIG. 9 exemplifies an inverter (INV) control circuit 44 employed therein. The INV control circuit 44 in FIG. 9 is of the same configuration as that of the INV control circuit 44 described in the first embodiment with reference to FIG. 3 excepting that a resistor Rosc3 is connected in parallel to a serial circuit of a resistor Rosc4 and a switch element SW5.

An output signal of a comparator CP2 of an output control circuit 41 is inputted to the switch element SW5 via an inverting element (NOT circuit). Therefore, when the output of the comparator CP2 is "H", the switch element SW5 is turned off while the switch element SW5 is turned into an on state when the output of the comparator CP2 is "L". In case the switch element SW5 is in the on state in the circuit shown in FIG. 9, a resistor Rosc3 is regarded as being connected in parallel to the resistor Rosc4 and the operational frequency of the switching elements Q1 and Q2 of the inverter circuit 2 becomes increased. As a result, a value of a current flowing through the discharge lamp La by a resonance between the resonance inductor L1 and the resonance capacitor C1 gets lowered, thereby executing a dimming control for reducing an output power of the lamp.

The operation status output circuit 43 in the third embodiment is also an analog switch circuit including a plurality of analog switches. Inputted to this operation status output circuit 43 are an output of the output control circuit 41 and a signal OUT3 outputted from the counter circuit CNT1 to convert the operational status of the inverter circuit 2 into a lighting status. The operation status output circuit 43 outputs a predetermined threshold value mode1 in case the output of the output control circuit 41 and the signal OUT3 are both "L"; outputs a preset threshold value mode3 when the output of the output control circuit 41 is "L" while the signal OUT3 is "H"; and outputs a prescribed threshold value mode2 when the output of the output control circuit 41 and the signal OUT3 are both "H". Accordingly, if the inverter circuit 2 is in the preheating or the ignition status, the output of the operation status output circuit 43 becomes mode1 while it becomes mode2 when the operational status of the inverter circuit 2 is found to be in a lighting status. Further, when the inverter circuit 2 is in a dimming status, the output of the operation status output circuit 43 is set as mode3. The output signals of the operation status output circuit 43 are inputted to the operation setting circuit 6 through a single line, as in the first and the second embodiment.

An output of the operation setting circuit 6 is set as "H" in order to have a dimmed lighting for a certain time period immediately after the replacement of the discharge lamp La. At this time, the operation status output circuit 43 outputs a status signal of mode3 and the operation setting circuit 6 measures and stores a lighting period in the dimming status. If the lighting period in the dimming status reaches a predetermined value T1, the output signal of the operation setting circuit 6 is converted into "L", thereby making the lighting device operate in a full lighting status. At this time, the status signal outputted from the operation status output circuit 43 is changed into mode2, and the operation setting circuit 6 operates to measure and store a lighting period in the full lighting status. If an accumulated time period of the dimmed lighting status and the full lighting status reaches a preset value T2, the output signal of the operation setting circuit 6 is converted into "H", thereby performing a dimmed lighting again. Further, it is preferable to stop the timing operation of the operation setting circuit 6 in the preheating and the ignition status though the status signals outputted from the operation status output circuit 43 are mode1 during those statuses.

Though the inverter circuit 2 is stopped depending on a signal outputted from the operation setting circuit 6 in the first and the second embodiment, the third embodiment employs such a dimming control mechanism instead of stopping the inverter circuit 2. Further, in the third embodiment, a signal of a predetermined threshold value corresponding to the dimming status is outputted through a single line from the operation status output circuit 43 of the control IC 4. Therefore, the same effects obtained in the first and the second embodiment can also be attained and, further, it becomes possible to execute a complicated control in a dimming operation status.

Fourth Preferred Embodiment

Figure 10:
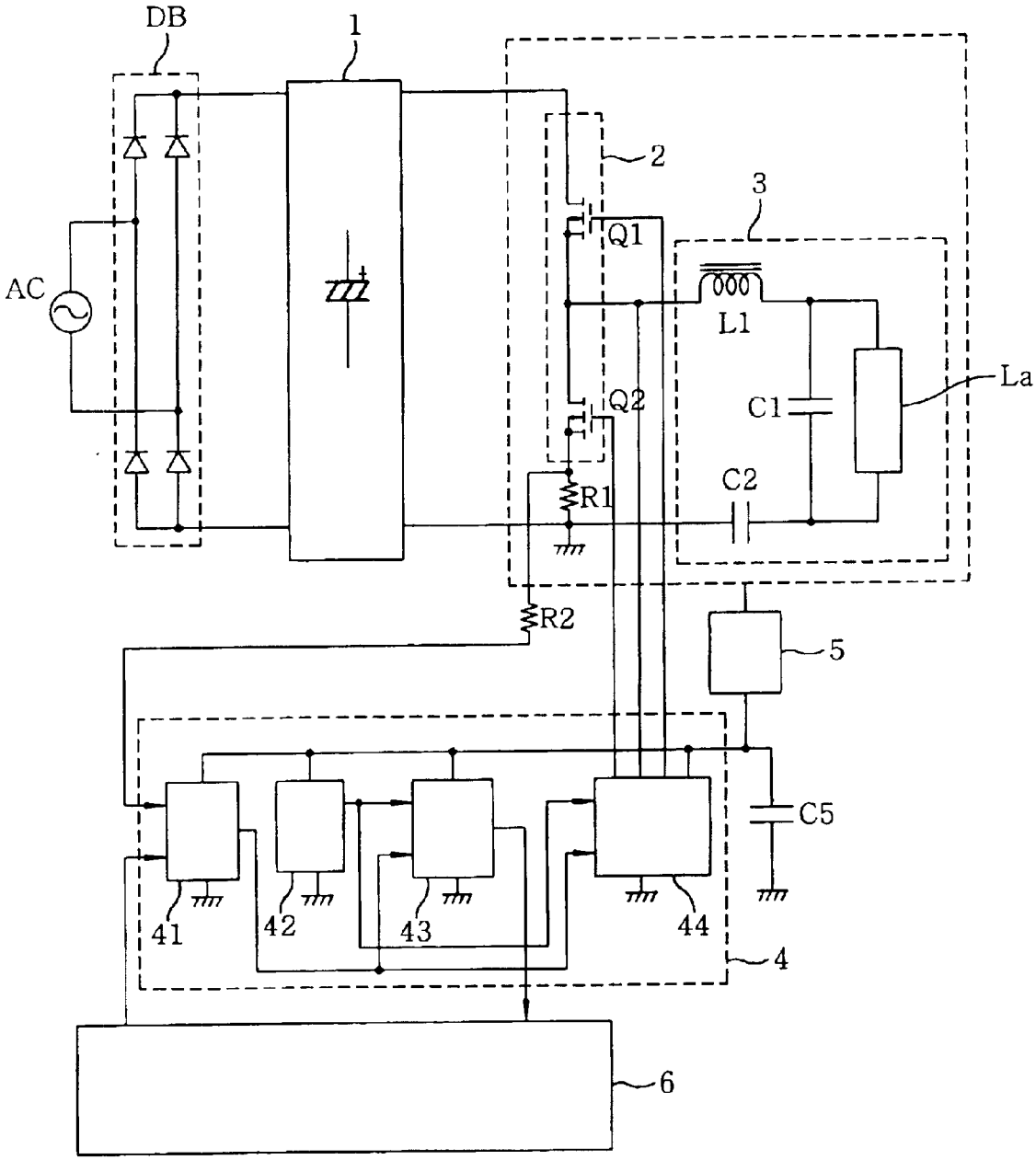
FIG. 10 illustrates a circuit diagram of a discharge lamp lighting device in accordance with a fourth preferred embodiment of the present invention.

Referring to FIG. 10, there is provided a discharge lamp lighting device in accordance with a fourth preferred embodiment of the present invention. The difference between the discharge lamp lighting device in FIG. 10 and that shown in FIG. 1 lies in that a switching current detecting resistor R1 is inserted between the switching element Q2 of the inverter circuit 2 and the ground to input a signal detected at the resistor R1 to an output control circuit 41 of a control IC 4 via a resistor R2 in FIG. 10. The other configuration including the inverter circuit 2 and the load circuit 3 and their operations are same as in the first embodiment shown in FIG. 1.

Figure 11:
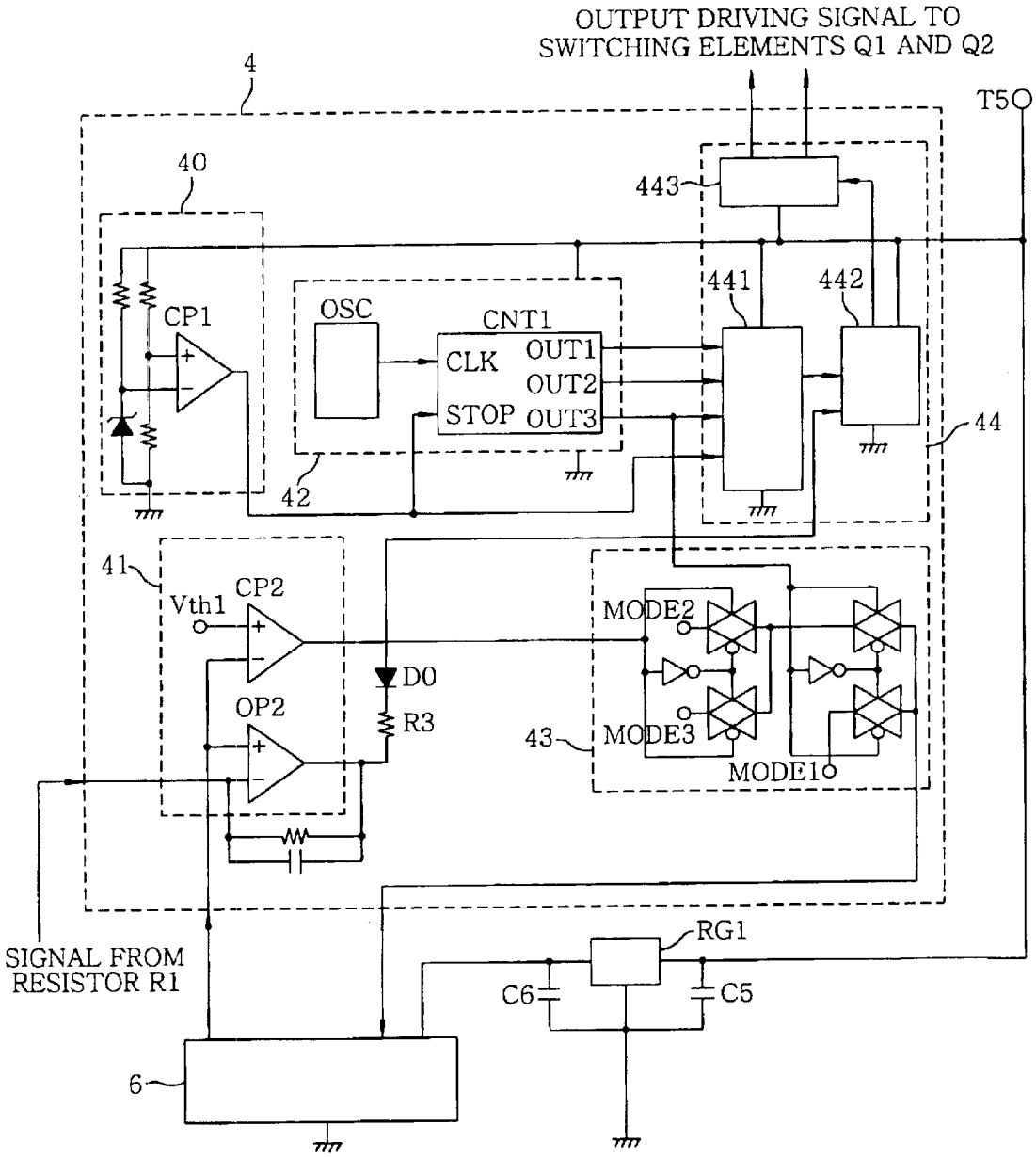
FIG. 11 presents a circuit diagram of a control IC in accordance with the fourth preferred embodiment of the present invention.

FIG. 11 describes a detailed configuration of the control IC 4 in the fourth embodiment. The control IC 4 in this embodiment is distinguished from the control IC 4 in the third embodiment shown in FIG. 8 in that the output control circuit 41 employed therein is of a different configuration. That is, the output control circuit 41 in the fourth embodiment includes a comparator CP2 and an operational amplifier OP2, wherein inputted to a minus (−) input terminal of the operational amplifier OP2 is a detect signal provided from the resistor R1 while inputted to a plus (+) input terminal thereof is a signal outputted from the operation setting circuit 6. Connected between an output terminal and the minus (−) input terminal of the operational amplifier OP2 is an integration circuit coupled to an interior or an exterior of the control IC 4 and serving as a feedback impedance by incorporating therein a resistor and a capacitor connected in parallel to each other.

Figure 12:
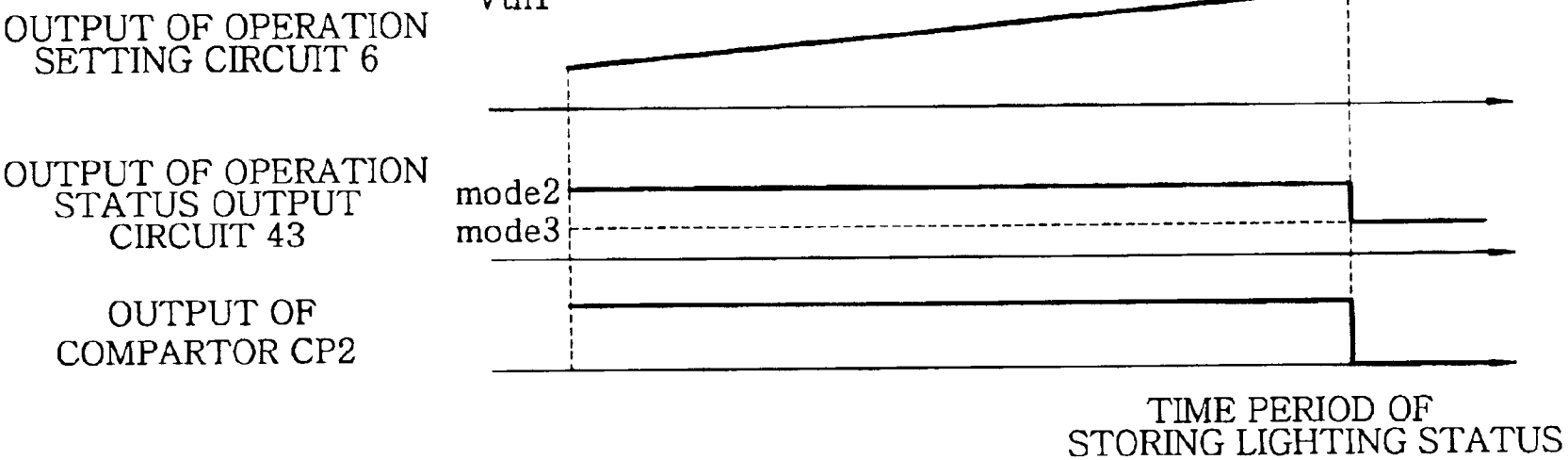
FIG. 12 charts operational waveforms representing an operation of an operation setting circuit in accordance with the fourth preferred embodiment of the present invention.
Figure 13:
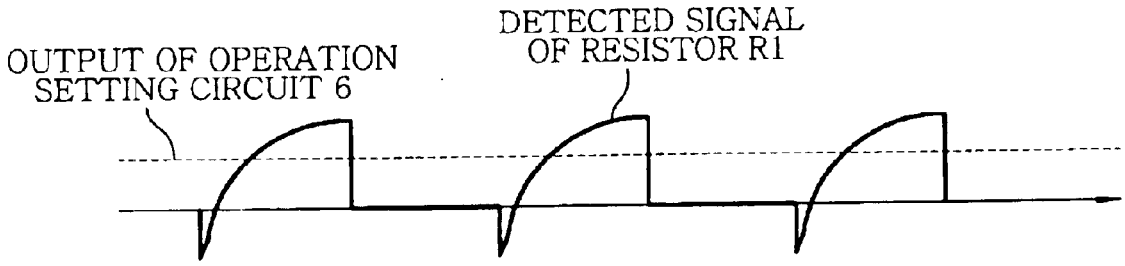
FIG. 13 charts operational waveforms representing an operation of an output control circuit in accordance with the fourth preferred embodiment of the present invention.

The output signal of the operation setting circuit 6 in the fourth embodiment has a waveform shown in FIG. 12, which changes gradually depending on the lighting period of the discharge lamp La that is measured and stored by the operation setting circuit 6. There is found a correlation, as shown in FIG. 13, between the detect signal inputted from the resistor R1 to the minus (−) input terminal of the operational amplifier OP2 and the output signal of the operation setting circuit 6 inputted to the plus (+) input terminal of the operational amplifier OP2. By changing a level of the signal outputted from the operation setting circuit 6, i.e., the DC signal inputted to the plus (+) input terminal of the operational amplifier OP2, an output voltage of the integration circuit including the operational amplifier OP2 is varied. The output terminal of the operational amplifier OP2 is led to an inverter cycle setting circuit 442 via a resistor R3 and a diode D0. Specifically, an anode of the diode (D0) may be connected to a serial circuit of Rosc1, Rosc2 and Rosc3 of the INV control circuit 44 shown in FIG. 3 or 9. Meanwhile, an output voltage of a buffer circuit including the operational amplifier OP1 is applied to the serial circuit of Rosc1, Rosc2 and Rosc3 of the INV control circuit 44, and the applied voltage is substantially identical to a predetermined threshold value Vth2. Accordingly, when the output voltage of the operational amplifier OP2 of the output control circuit 41 is lower than the threshold value Vth2, the current IRosc flowing within the INV control circuit 44 increases, which in turn increases the operational frequencies of the switching elements Q1 and Q2 of the inverter circuit 2, thereby enabling such a dimming control as described in the third embodiment.

In the fourth embodiment, by setting the signal outputted from the operation setting circuit 6 to have the waveform shown in FIG. 12 and varying the signal depending on the lighting period of the discharge lamp La, an output power of the discharge lamp La can be controlled to be kept at a constant level regardless of a duration of use of the discharge lamp La, as in the conventional example provided in FIG. 46. Further, the output signal of the operation setting circuit 6 is inputted to a minus (−) input terminal of the comparator CP2 of the output control circuit 41 to be compared with a preset threshold value Vth1 inputted through a plus (+) input terminal of the comparator CP2. Accordingly, if the output signal of the operation setting circuit 6 is varied depending on the lighting period of the discharge lamp La and, finally, gets higher than the threshold value Vth1, an output signal of the comparator CP2 becomes "L".

The operation status output circuit 43 in the fourth embodiment is also an analog switch circuit including a multiplicity of analog switches, as shown in FIG. 11. In this embodiment, inputted to the operation status output circuit 43 are the output signal of the comparator CP2 of the output control circuit 41 and a signal OUT3 outputted from the counter circuit CNT 1 for converting the operation of the inverter circuit 2 into a lighting status. The operation status output circuit 43 outputs a signal of a predetermined threshold value mode1 when the output of the comparator CP2 is "H" while the signal OUT3 is "L"; outputs a signal of a preset threshold value mode2 when the output of the comparator CP2 and the signal OUT3 is both "H"; and outputs a signal of a prescribed threshold value mode3 when the output of the comparator CP2 is "L" while the signal OUT3 is "H". Accordingly, the output signal of the operation status output circuit 43 is set as mode1 when the operational status of the inverter circuit 2 is a preheating or an ignition status while the output signal thereof is set as mode2 when the inverter circuit 2 is in a lighting status including a dimming status. Further, the output signal of the operation setting circuit 6 is varied depending on the lighting period of the discharge lamp La as described above. If the level of the output signal of the operation setting circuit 6 becomes higher than the threshold value Vth1, the output signal of the operation status output circuit 43 is changed into mode3.

In the fourth embodiment, the operation setting circuit 6 can additionally operate to inform a user to replace the discharge lamp La by, for example, changing an illumination rate for a specific period of time whenever the discharge lamp La is converted from an ignition status into a lighting status in case the lighting period of the discharge lamp La is found to have reached a predetermined value, i.e., in case the status signal mode3 is inputted to the operation setting circuit 6 from the control IC 4 in addition to its conventional operation for varying an input voltage provided to the output control circuit 41 of the control IC 4 depending on the lighting period of the discharge lamp La to thereby maintain the output power of the discharge lamp La substantially constant regardless of use thereof.

Since a predetermined threshold value corresponding to a lighting status is outputted from the operation status output circuit 43 of the control IC 4 through a single line in the fourth embodiment as well, a size reduction of the discharge lamp lighting device can be achieved as in the other embodiments described above and, further, an effective control mechanism can be provided as in the conventional examples.

Fifth Preferred Embodiment

Figure 14:
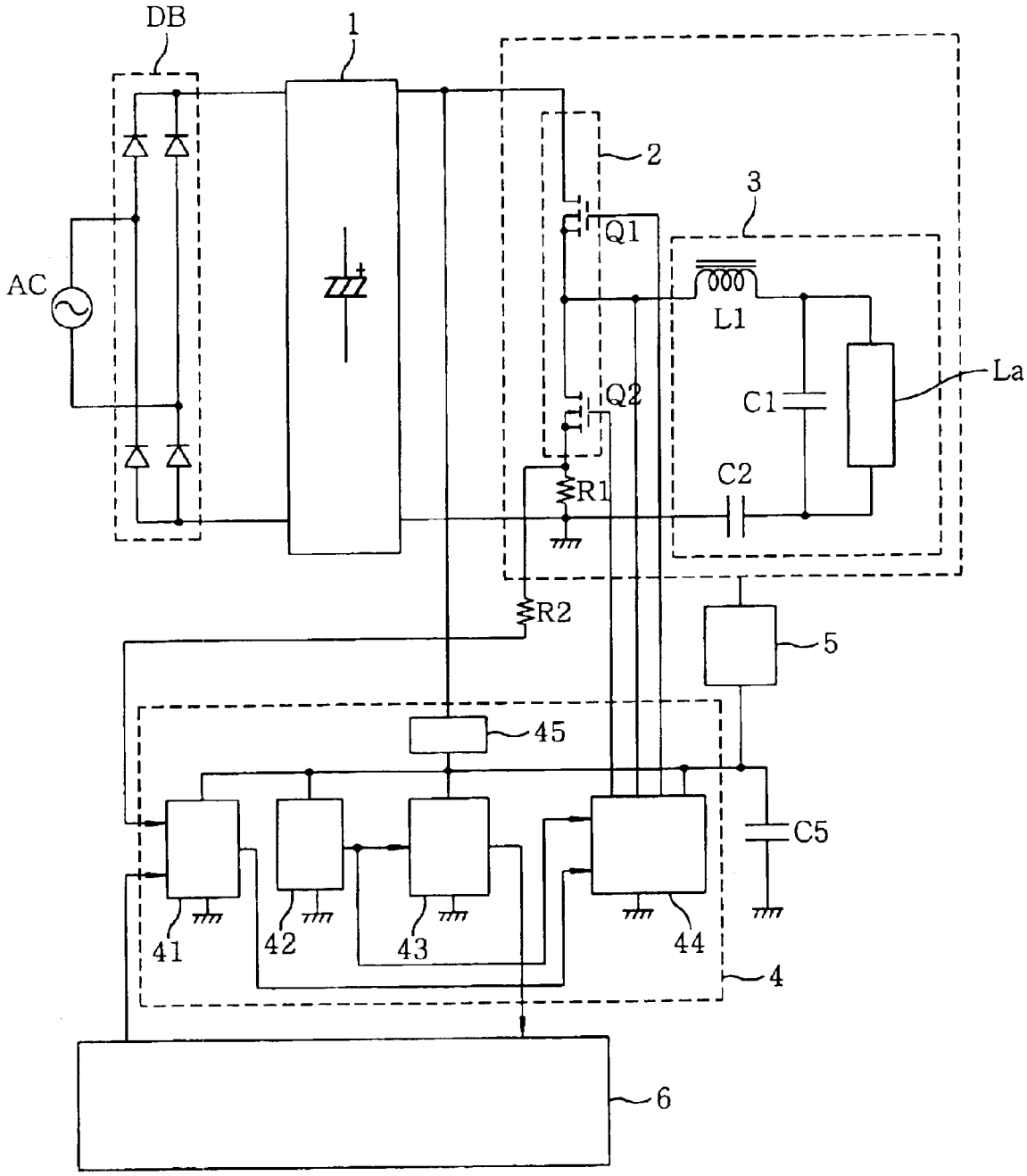
FIG. 14 provides a circuit diagram of a discharge lamp lighting device in accordance with a fifth preferred embodiment of the present invention.

FIG. 14 illustrates a configuration of a discharge lamp lighting device in accordance with a fifth embodiment of the present invention. The fifth embodiment is different from the fourth embodiment shown in FIG. 10 in that an output terminal of the DC power source circuit 1 is connected to a control IC 4. The configurations and operations of the inverter circuit 2, the load circuit 3 and the control IC 4 are substantially identical to those described in the fourth embodiment.

Figure 15:
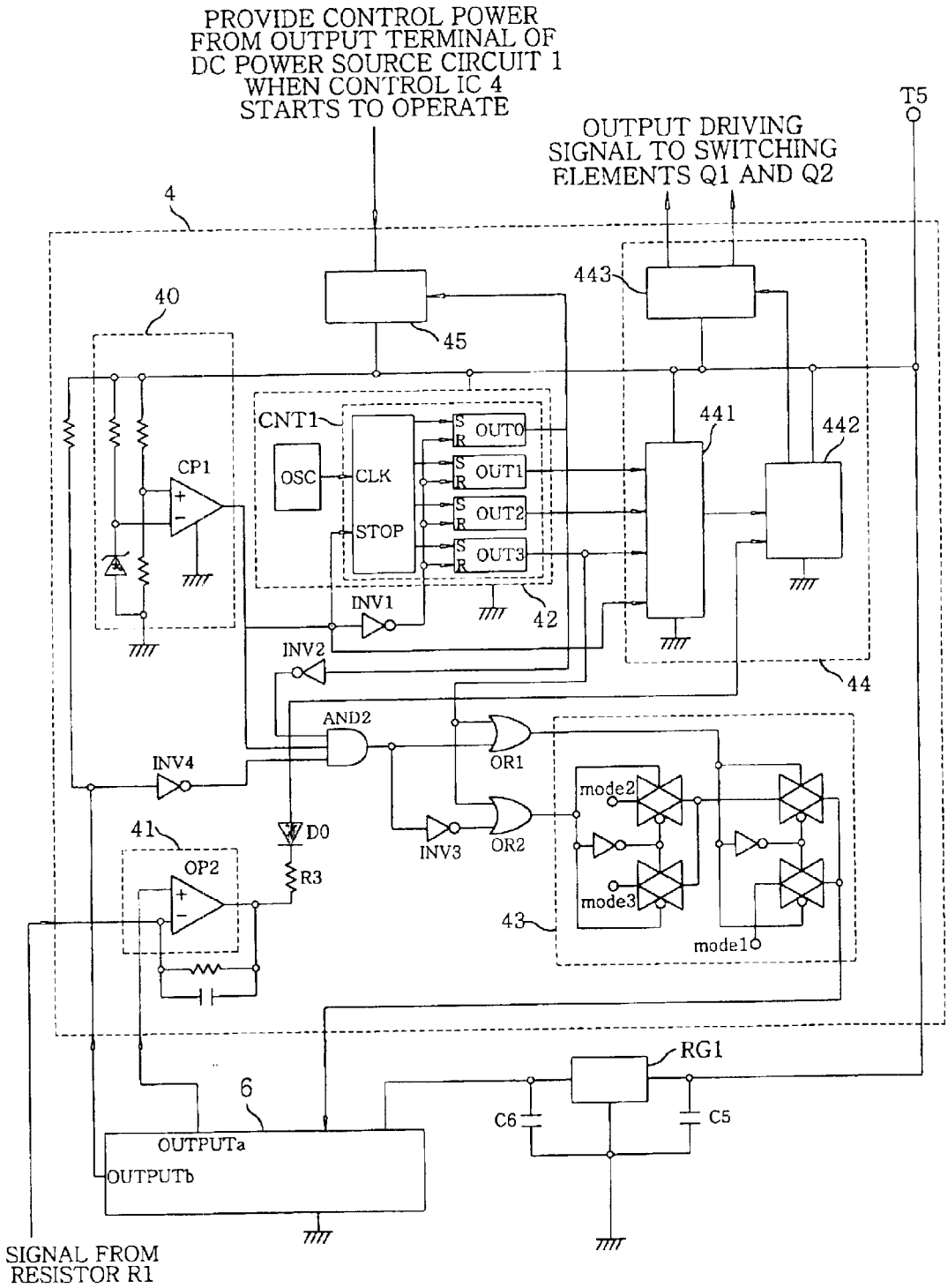
FIG. 15 shows a circuit diagram of a control IC in accordance with the fifth preferred embodiment of the present invention.

Referring to FIG. 15, there is provided a detailed circuit diagram of the control IC 4 in accordance with the fifth embodiment. The control IC 4 in this embodiment is different from the control IC 4 in the fourth embodiment in that it has an additional driving circuit 45 connected to the output terminal of the DC power source circuit 1. The driving circuit 45 preferably includes a highly pressure-resistant switch element and a control circuit for on-off operating the switch element. The driving circuit 45 serves to supply a current to a control power source by being turned on in response to an output signal OUT0 (="L") sent from a timer circuit 42. An inverted signal of the output OUT0 of the timer circuit 42 (i.e., an output of an inverting element INV2), an output of a control power detecting circuit 40 and an inverted signal of an output signal b of an operation setting circuit 6 (i.e., an output of an inverting element INV4) are inputted to three respective input terminals of a 3-input AND element AND2. An output of the AND element AND2 is inputted to an operation status output circuit 43 via a logic circuit employing OR elements OR1 and OR2 and an inverting element INV3.

Further, an output control circuit 41 of the fifth embodiment includes an operational amplifier OP2. As in the fourth embodiment, a detect signal provided from a resistor R1 is inputted to a minus (−) input terminal of the operational amplifier OP2 while an output signal a transmitted from an operation setting circuit 6 is inputted to a plus (+) input terminal thereof. Furthermore, by connecting an output terminal of the operational amplifier OP2 to an inverter cycle setting circuit 442 via a resistor R3 and a diode D0, a dimming control can be executed by way of varying a DC level of the output signal a provided from the operation setting circuit 6.

Figure 16:
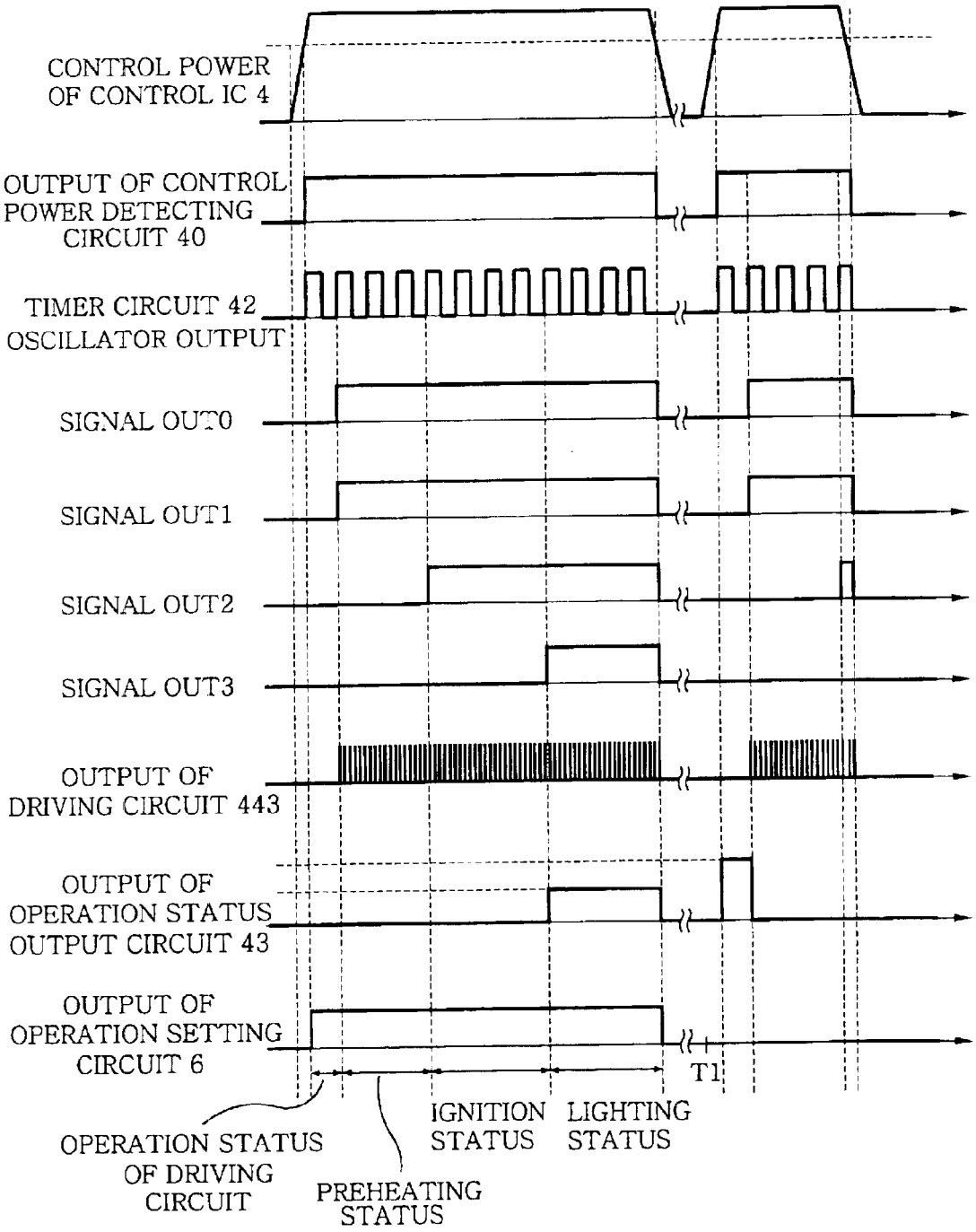
FIG. 16 charts operational waveforms representing an operation of the control IC in accordance with the fifth preferred embodiment of the present invention.

FIG. 16 is a timing chart for describing an operation of the control IC 4 in accordance with the fifth embodiment. Immediately after the discharge lamp La is replaced with a new one, a time measured by the operation setting circuit 6 is reset. Let's assume that output signal b of the operation setting circuit 6 at the moment is "H". When an AC power is applied to the lighting device, a smoothing capacitor of the DC power source circuit 1 is charged to a predetermined level of a voltage. Accordingly, the driving circuit 45 is turned on to thereby initiate a power supply to the control power source of the control IC 4. Since a control power level is low right after the beginning of the power supply to the control power source, an output of a comparator CP1 of the control power detecting circuit 40 is set to be "L". Since the counter circuit CNT1 of the timer circuit 42 is reset at this time, output signals OUT0, OUT1, OUT2 and OUT3 of the timer circuit 42 are all set to be "L". Further, since an output (="L") of the OR1 is inputted to an analog switch circuit of the operation status output circuit 43, the operation status output circuit 43 outputs a predetermined threshold value mode1. In FIG. 16, it is assumed that the threshold value mode1 is 0 V.

As the power supply is continued via the driving circuit 45, the control power level increases. Then, if the control power level reaches a level predetermined by the control power detecting circuit 40, the output of the comparator CP1 of the control power detecting circuit 40 is turned into "H", thereby allowing the counter circuit CNT 1 of the timer circuit 42 to initiate its operation. If the output signals OUT0 and OUT1 increase simultaneously, the output of the AND element becomes "L" regardless of the level of the output signal OUT0, for the output signal b of the operation setting circuit 6 is "H" and the output of the inverting element INV4 is "L" at an early stage of the operation of the counter circuit CNT1. Accordingly, by maintaining the output (="L") of the OR element OR1, the output of the operation status output circuit 43 is controlled to maintain the predetermined threshold value mode1. If the operation of the counter circuit CNT1 progresses and, thus, the output signal OUT 3 becomes "H", the outputs of the OR elements OR1 and OR2 both become "H", so that the output of the operation status output circuit 43 is set as a predetermined threshold value mode2.

Next, there will be described a control power which is supplied to the control IC 4 at a time when the output OUT0 of the counter circuit CNT1 is converted into "H" from "L" to thereby render the driving circuit 45 to be turned off. An INV control circuit 44 initiates a preheating status as in the first to fourth embodiments at the moment the highly pressure-resistant switch element included in the driving circuit 45 is turned off.

Figure 17:
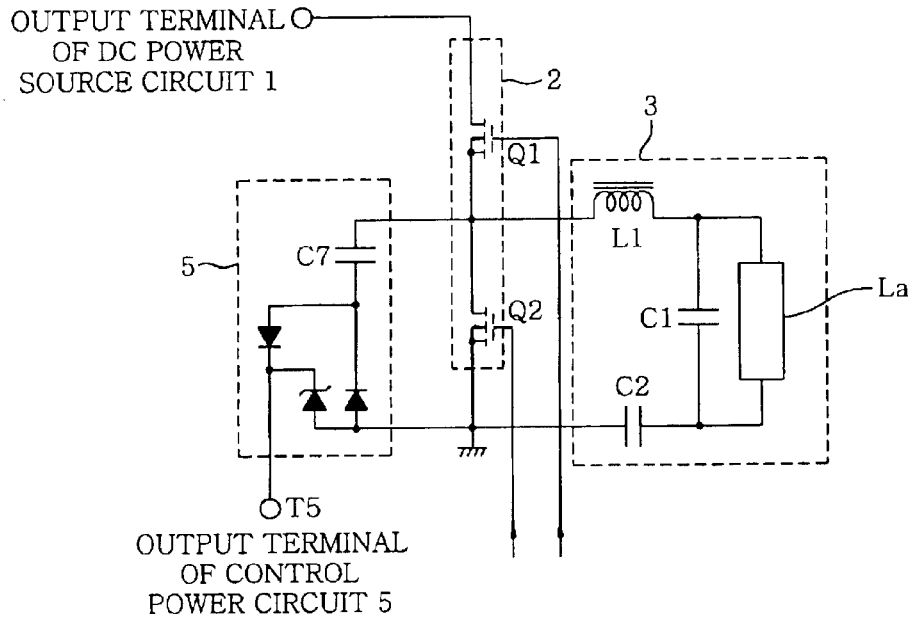
FIG. 17 is a circuit diagram of an example of a control power source circuit in accordance with the fifth preferred embodiment of the present invention.
Figure 18:
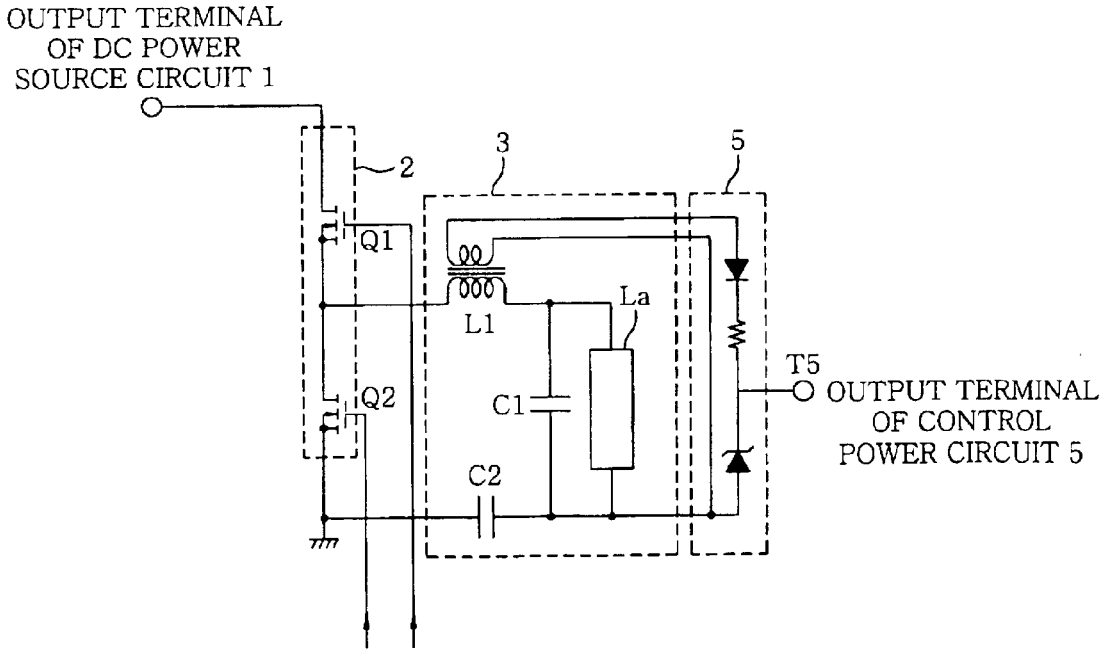
FIG. 18 is a circuit diagram of another example of a control power source circuit in accordance with the fifth preferred embodiment of the present invention.

FIGS. 17 and 18 respectively describe examples of the control power source circuits 5. In FIG. 17, by on-off operating switching elements Q1 and Q2 of an inverter circuit 2, a control power is supplied via a capacitor C7 coupled in parallel to the switching element Q2. Referring to FIG. 18, a resonance current flows into a load circuit 3 by an operation of the inverter circuit 2, so that a voltage induced at a second coil of a resonance inductor L1 is supplied as the control power. Whichever is employed among the above circuits shown in FIGS. 17 and 18, the control power is supplied to the control IC 4 from the control power source circuit 5 when the inverter circuit 2 starts to operate in the preheating status and the control power can be stably supplied even though the driving circuit 45 is turned off.

In this embodiment, if the time measured by the operation setting circuit 6 reaches a predetermined time T1, the output signal b of the operation setting circuit 6 is controlled to be "L". At this time, the output of the comparator CP1 of the control power detecting circuit 40 becomes "L", for the control power level is low immediately after the control power starts to be supplied to the control power source via the driving circuit 45. As described above, the counter circuit CNT1 of the timer circuit 42 is then reset and the outputs OUT0, OUT1, OUT2 and OUT3 of the timer circuit 42 are all set to be "L". Since an OR1 output (="L") is inputted to the analog switch circuit of the operation status output circuit 43, a predetermined threshold value mode1 is outputted therefrom.

As the power supply is continued via the driving circuit 45, the control power level increases. Then, the output of the comparator CP1 of the control power detecting circuit 40 becomes "H" and the counter circuit CNT1 of the timer circuit 42 starts its operation. At this time, however, since the output signal b of the operation setting circuit 6 is "L" while the output of the inverting element INV4 is "H", the output of the AND element AND2 is set to be "H" when the output signal OUT0 of the counter circuit CNT1 and the output of the inverting element INV2 are "L" and "H", respectively. As a result, the outputs of the OR elements OR1 and OR2 become "H" and "L", respectively, and the operation status output circuit 43 outputs a predetermined threshold value mode3.

The operation setting circuit 6 in the fifth embodiment is capable of storing a duration period of use of the discharge lamp La, as in the conventional examples and the fourth embodiment, to control an output power of the discharge lamp La to be substantially constant regardless of its duration period of use. Furthermore, if the measured lighting period of the discharge lamp La reaches the predetermined time T1, a status signal mode3 outputted from the control IC 4 is inputted to the operation setting circuit 6 whenever the AC power is supplied. Accordingly, the supply of the AC power is repeatedly performed, i.e., the control IC 4 enters a lighting status, until a status signal mode2 is outputted from the control IC 4. In this way, if the status signal mode 3 is inputted to the operation setting circuit 6 more than, e.g., three times consecutively, the measured lighting period may be reset to the initial state.

Figure 47:
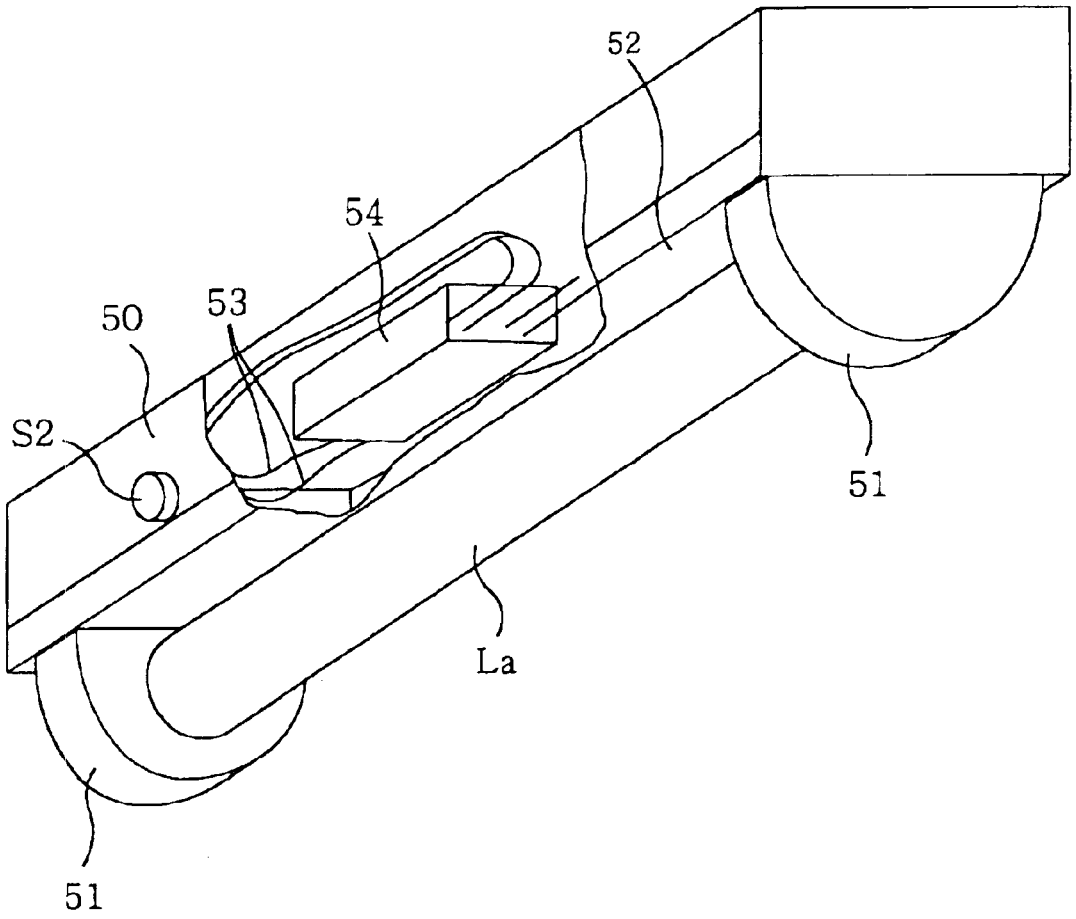
FIG. 47 (PRIOR ART)
FIG. 47 depicts a lighting apparatus in accordance with the prior art on which a reset switch is installed.

In this embodiment, since a predetermined threshold value corresponding to a lighting status is outputted from the operation status output circuit 43 of the control IC 4 through a single line as well, the size reduction of the discharge lamp lighting device can be accomplished as in the preferred embodiments described above. In addition, since a reset control can be readily performed, a reset switch S2 (See, for example, FIG. 47) added in a lighting status can be eliminated.

Sixth Preferred Embodiment

Figure 19:
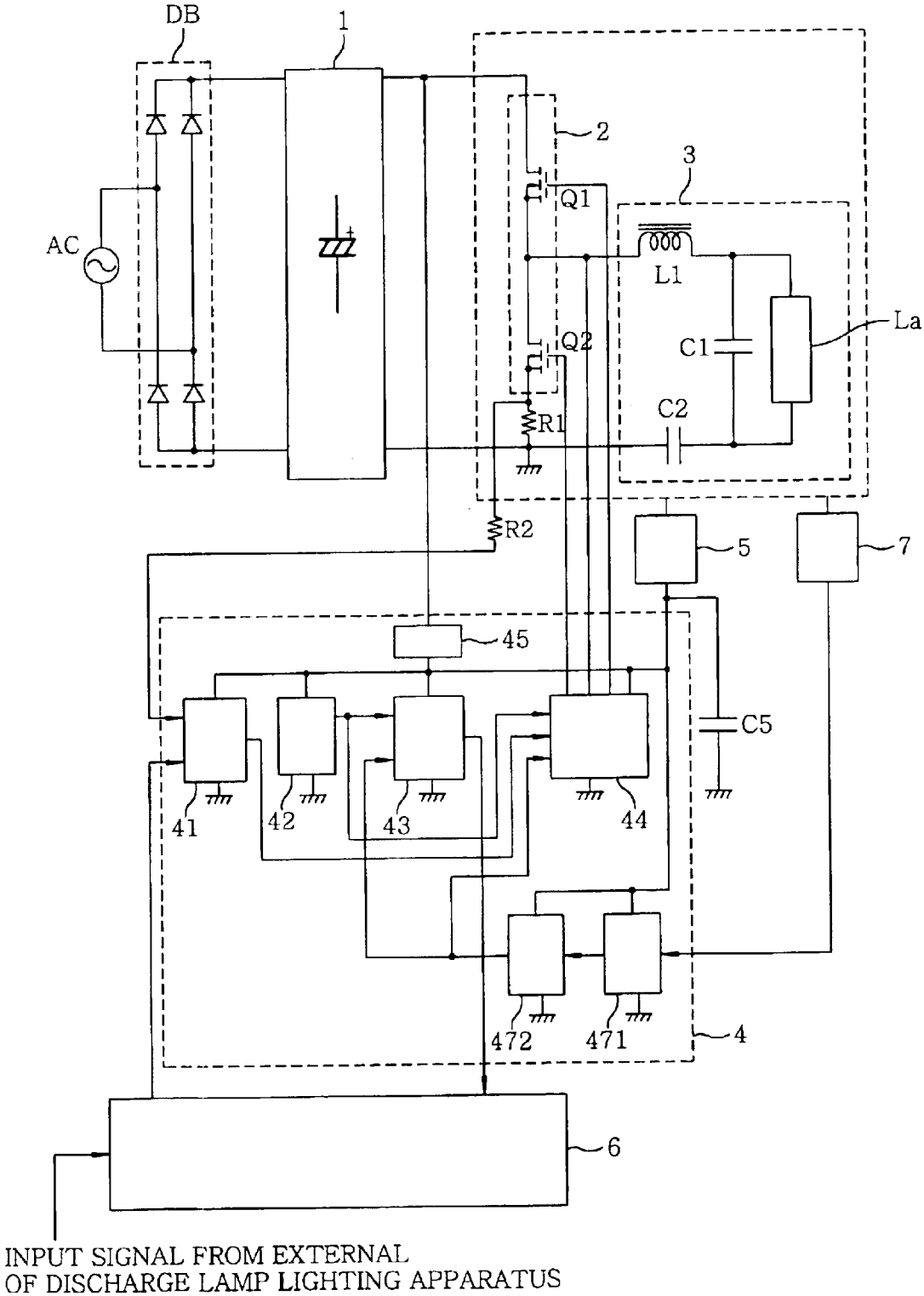
FIG. 19 illustrates a circuit diagram of a discharge lamp lighting device in accordance with a sixth preferred embodiment of the present invention.

FIG. 19 illustrates a configuration of a discharge lamp lighting device in accordance with a sixth preferred embodiment of the present invention. The difference between this embodiment and the fifth embodiment shown in FIG. 14 resides in the fact that the sixth embodiment additionally employs a no-load detecting circuit 7 for detecting a presence or an absence of the discharge lamp La; an operation setting circuit 6 receives a signal inputted from an exterior of the discharge lamp lighting device; and, further, a control IC 4 additionally includes a no-load determination circuit 471 to which an output signal of the no-load detecting circuit 7 is inputted and a no-load suppression circuit 472 for stopping the operation of the inverter circuit 2 in response to an output of the no-load determination circuit 471.

Figure 20:
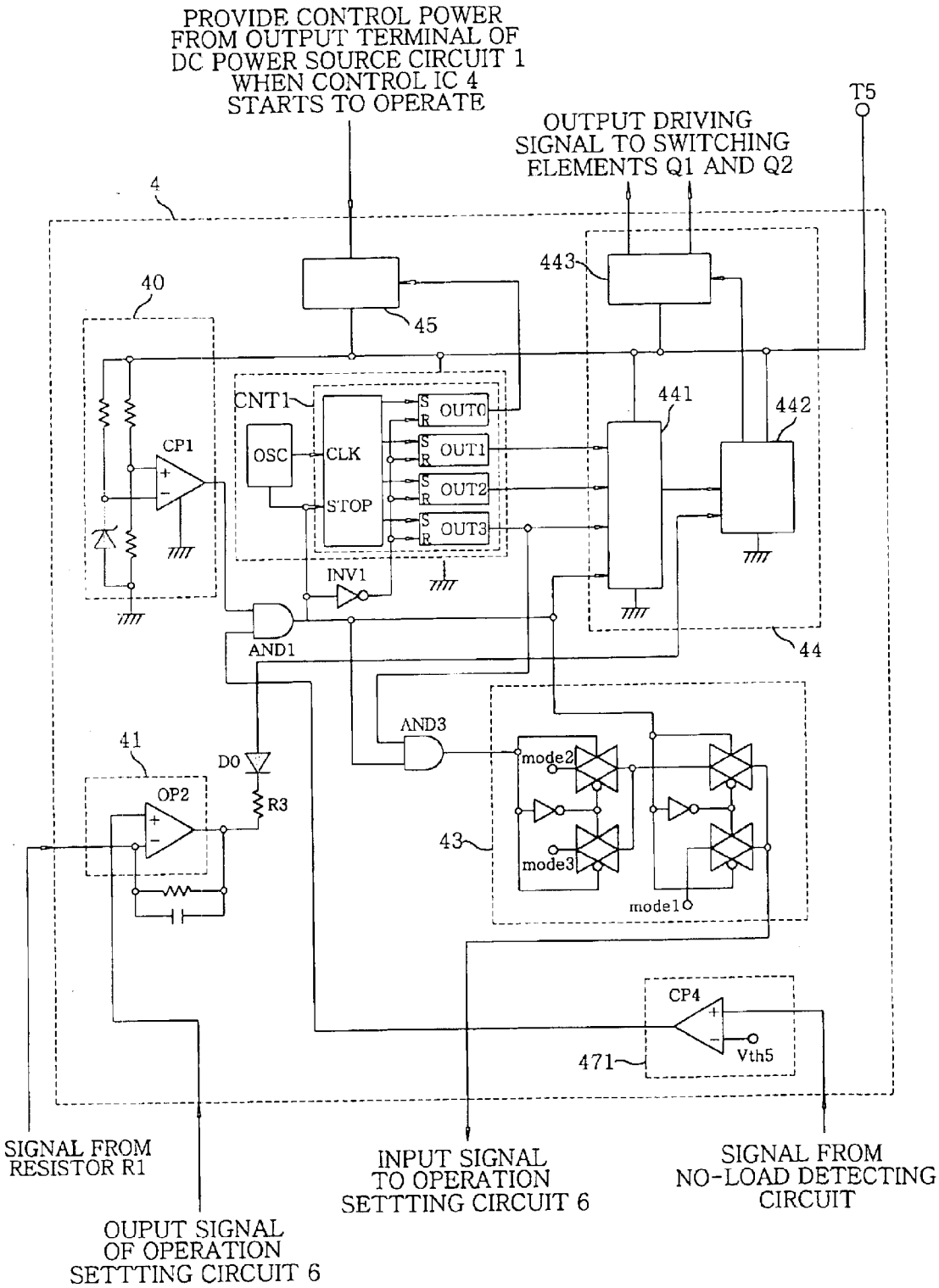
FIG. 20 presents a circuit diagram of a control IC in accordance with the sixth preferred embodiment of the present invention.

Referring to FIG. 20, there is described the control IC 4 in accordance with the sixth embodiment. The basic operation of the control IC 4 therein is almost identical to that described in the fifth embodiment. That is, a driving circuit 45 is activated by a signal outputted from a timer circuit 42 to thereby control a preheating, an ignition and a lighting operation of an inverter circuit 2. Moreover, a dimming control is conducted on the basis of a signal level outputted from the operation setting circuit 6 to an output control circuit 41 of the control IC 4. The signal outputted from the no-load detecting circuit 7 is inputted to the no-load determination circuit 471 having a comparator CP4. When the discharge lamp La is normally connected and the signal outputted from the no-load detecting circuit 7 has a value higher than a preset threshold value Vth5, an output of the comparator CP4 is set as "H". Since the output of the comparator CP4 and an output of a control power detecting circuit 40 are inputted to a 2-input AND element AND1, an output of the AND element AND1 is set to be "H" when the discharge lamp is connected, so that the timer circuit 42 starts its counting operation. In case the discharge lamp La is not connected, the signal inputted from the no-load detecting circuit 7 becomes lower than the threshold value Vth5, so that the output of the comparator CP4 is turned into "L". Accordingly, the output of the 2-intput AND element AND1 is also set to be "L" and the timer circuit 42 stops its operation in response to a reset signal inputted thereto. In the sixth embodiment, the output of the AND element AND1 serves to stop the inverter circuit 2 when the discharge lamp La is not connected.

Inputted to an operation status output circuit 43 in this embodiment are an output signal of the AND element AND1, to which the outputs of the control power detecting circuit 40 and the no-load determination circuit 471 are inputted, and an output signal of an AND element AND3 to which an output OUT3 of the timer circuit 42 is inputted. The operation status output circuit 43 outputs a predetermined threshold value mode1 (0 V in FIG. 21) when the outputs of the AND elements AND1 and AND3 are both "L"; outputs a preset threshold value mode3 when the outputs of the AND elements AND1 and AND3 are "H" and "L", respectively; and outputs a prescribed threshold value mode2 when respective outputs of the AND elements AND1 and AND2 are both "H". That is, the operation status output circuit 43 outputs the output signal mode3 in case the inverter circuit 2 is in a preheating and an ignition status while outputting the output signal mode2 when the inverter circuit 2 is in a lighting status. Further, in a no-load status where the discharge lamp La is not connected, the output signal of the operation status output circuit 43 is set as mode1.

The signal inputted from the exterior of the discharge lamp lighting device may be, for example, a dimming signal for controlling an output power of the discharge lamp La to be a predetermined level. In case the inverter circuit is controlled to be in the preheating and the ignition status by the control IC 4, it is preferable that an appropriate preheating current value and an ignition voltage value are determined on the basis of a type of the discharge lamp La employed such that a constant operation of the inverter circuit is performed regardless of a dimming signal inputted.

Figure 21:
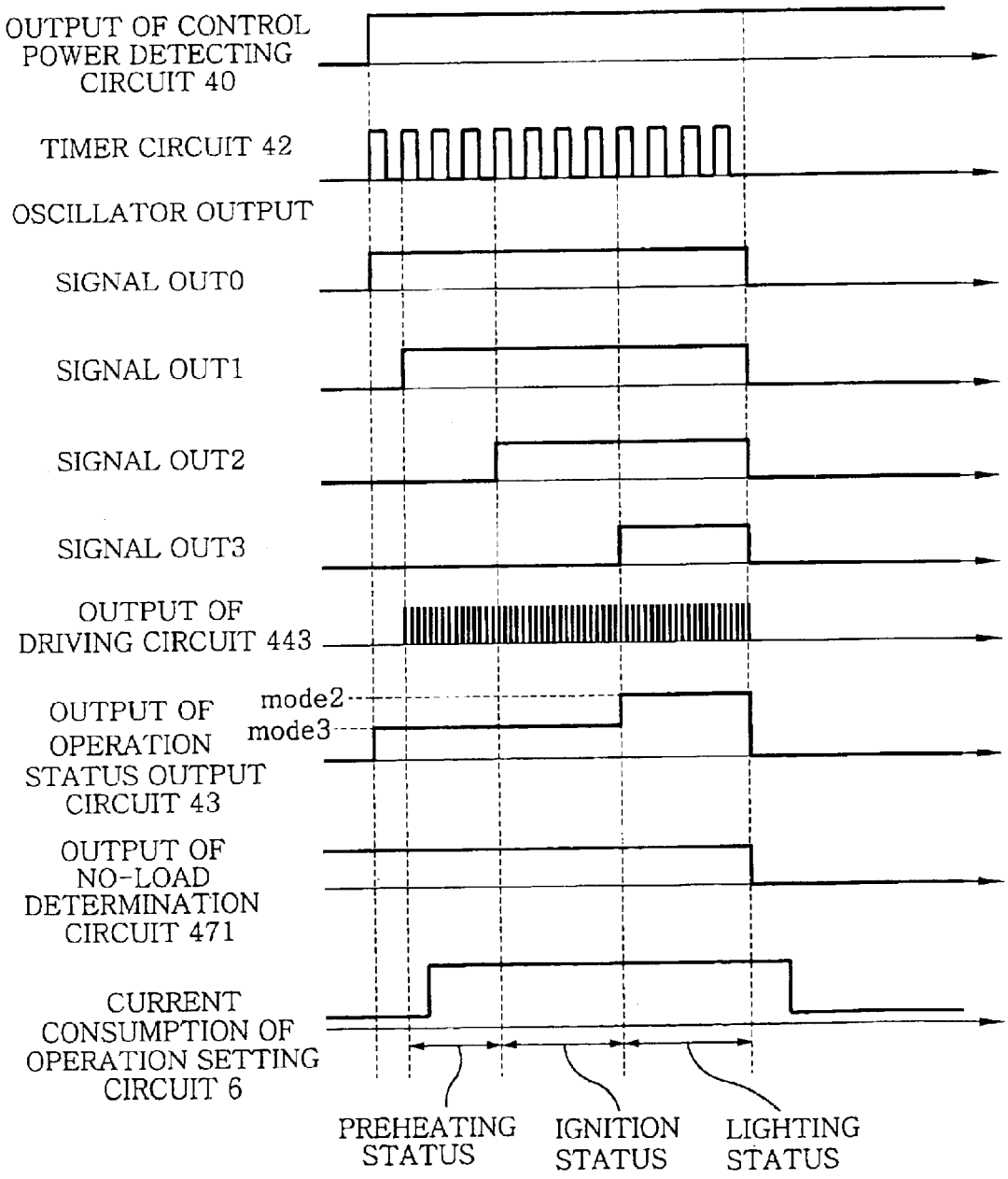
FIG. 21 charts operational waveforms representing an operation of the control IC in accordance with the sixth preferred embodiment of the present invention.

Accordingly, as can be seen from a timing chart in FIG. 21, the operation setting circuit 6 should suppress an output of a dimming signal into the output control circuit 41 in the preheating and the ignition status, i.e., while the status signal mode3 is being inputted thereto. And, in the lighting status, i.e., while the status signal mode2 is being inputted to the operation setting circuit 6, the operation setting circuit 6 should control a dimming signal to be inputted to the output control circuit 41. Further, in case the discharge lamp La is not connected, it is preferable to turn, e.g., a microcomputer of the operation setting circuit 6 into a sleep state, thereby reducing a current consumption.

In the configuration of the control power source circuit 5 in accordance with the fifth embodiment described above, a comparatively large amount of current can be supplied as a control source power only while the inverter circuit 2 is operating and, thus, the power should be supplied via the driving circuit 45 of the control IC 4 when the inverter circuit 2 is stopped. If the microcomputer of the operation setting circuit 6 keeps operating while consuming a large amount of current when the inverter circuit 2 is stopped, it is required for the highly pressure-resistant switch element of the control IC 4 to have a comparatively large amount of current capacity, which in turn results in a size increase of a package of the control IC 4. However, if the current consumption of the microcomputer is controlled to be reduced when the inverter circuit 2 is stopped in accordance with the sixth embodiment, there occurs no such a problem that might be caused in the fifth embodiment, and the size reduction of the discharge lamp lighting device can be achieved as in the other embodiments described before.

In addition, since the control IC 4 for controlling the inverter circuit 2 outputs a status signal corresponding to a detection of a no-load status, the control IC 4 and the operation setting circuit 6 may detect almost simultaneously the no-load status. Accordingly, it is unlikely that the no-load status is confused with other status in the operation setting circuit 6. Further, the signal inputted from the exterior of the discharge lamp lighting device may be an output signal of a sensor of various types for sensing a person or an intensity of light.

Seventh Preferred Embodiment

Figure 22:
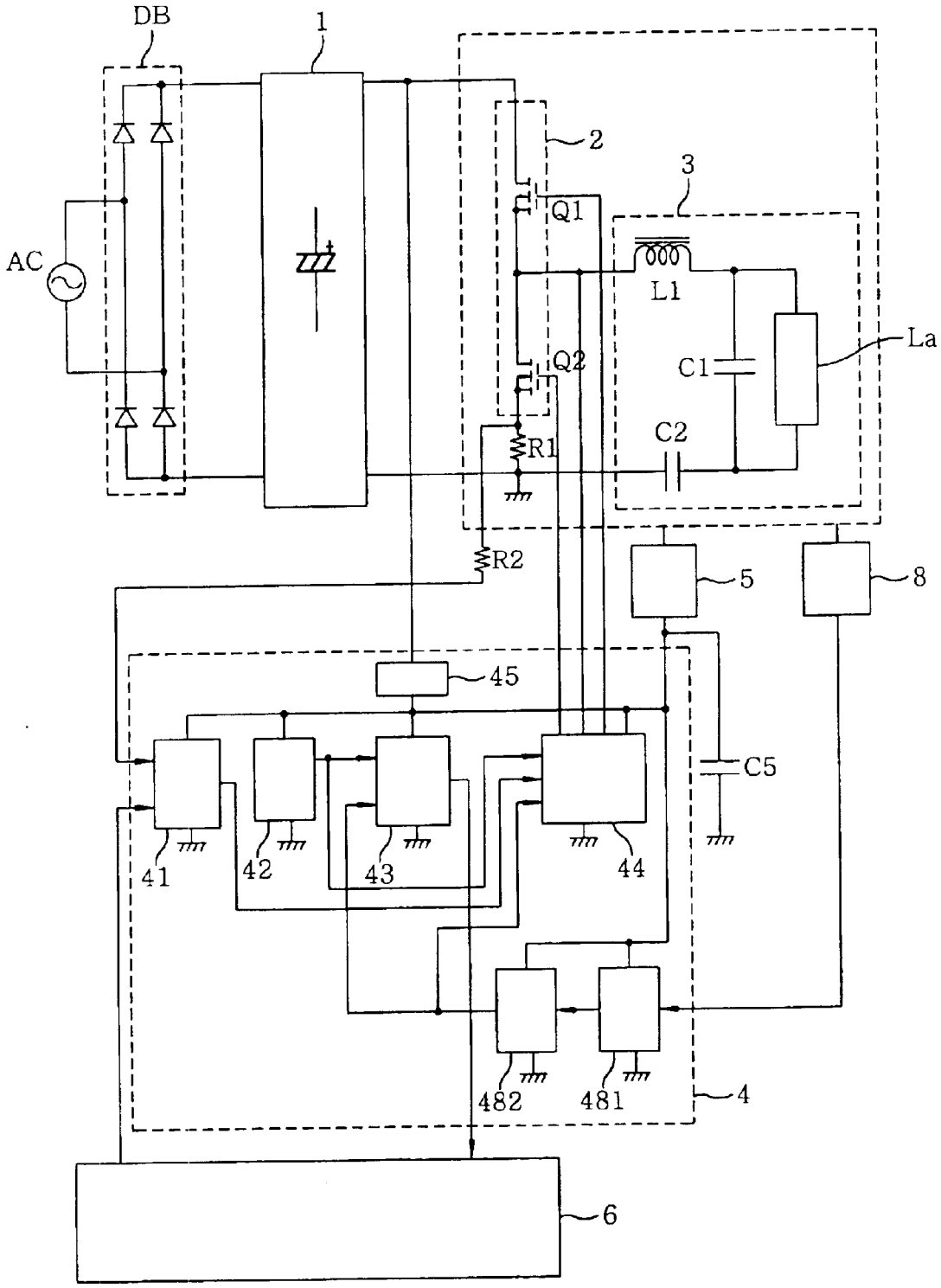
FIG. 22 is a circuit diagram of a discharge lamp lighting device in accordance with a seventh preferred embodiment of the present invention.

Referring to FIG. 22, there is described a configuration of a discharge lamp lighting device in accordance with a seventh preferred embodiment of the present invention. The seventh embodiment is different from the fifth embodiment shown in FIG. 14 in that it includes a lamp lifetime detecting circuit 8 for detecting a lifetime of a discharge lamp La and a control IC 4 employed therein additionally includes a lifetime determination circuit 481 for receiving an output signal inputted from the lamp lifetime detecting circuit 8 and a lifetime exhaustion suppressing circuit 482.

Figure 23:
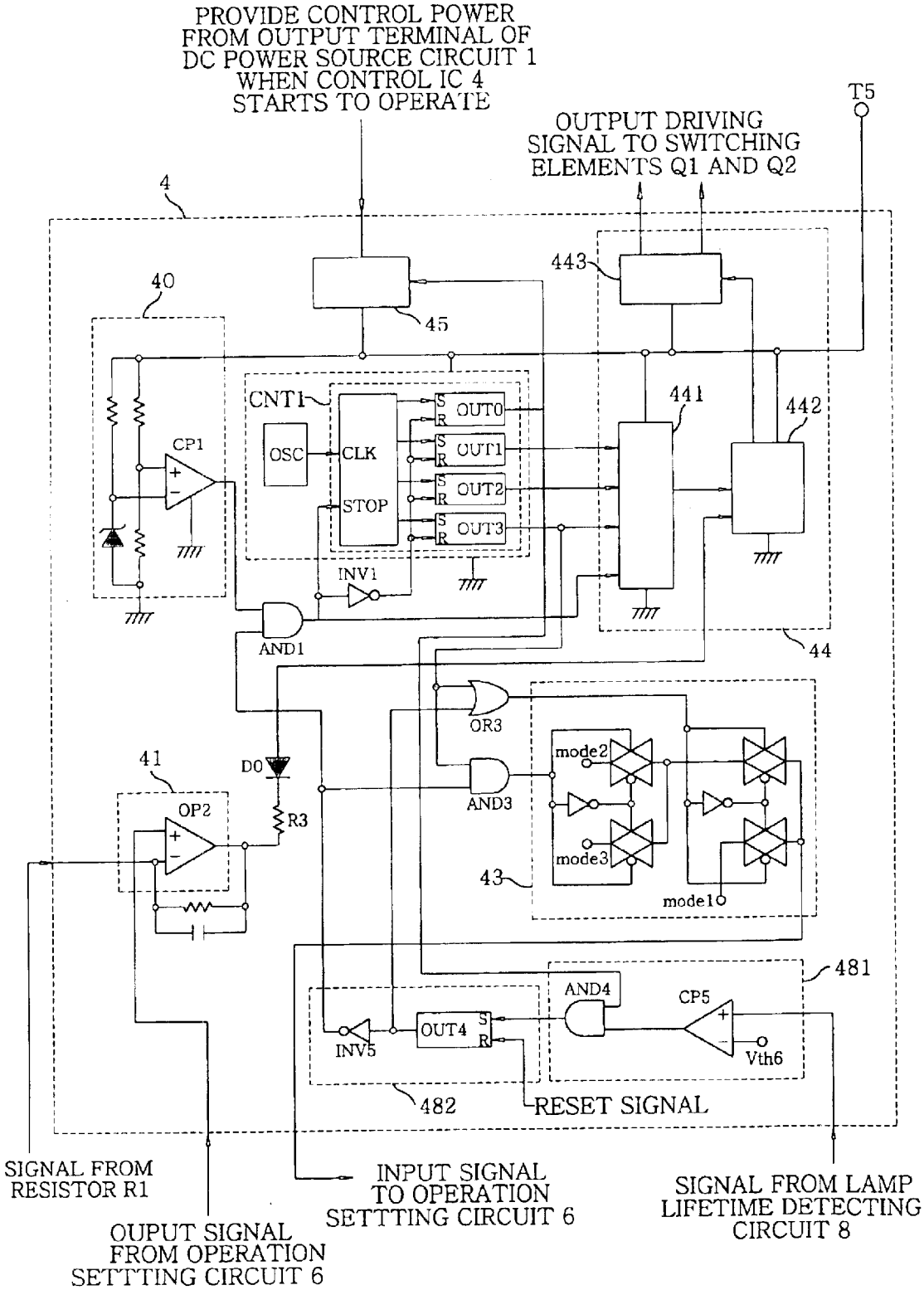
FIG. 23 provides a circuit diagram of a control IC in accordance with the seventh preferred embodiment of the present invention.

FIG. 23 shows a configuration of the control IC 4 in accordance with the seventh embodiment. The basic operation thereof is identical to that described in the fifth and the sixth embodiments. That is, the driving circuit 45 operates in response to a signal outputted from a timer circuit 42 to thereby drive an INV control circuit 44 to control a preheating, an ignition and a lighting operation of an inverter circuit 2. Further, a dimming control is conducted on the basis of a signal level outputted from an operation setting circuit 6 to an output control circuit 41. The signal outputted from the lamp lifetime detecting circuit 8 is proportional to, e.g., a voltage across both ends of a discharge lamp La and is inputted to the lifetime determination circuit 481 including a comparator CP5. An output of the comparator CP5 and an output OUT3 of a timer circuit 42 are inputted to an AND element AND4, whose output is in turn inputted to the lifetime exhaustion suppressing circuit 482.

As described in the sixth embodiment, the discharge lamp La is not lighted yet when the control IC 4 operates in a preheating or an ignition status. At that time, it is likely that the voltage across both ends of the discharge lamp La is higher than that in a lighting status. Therefore, in order to prevent the lifetime determination circuit 481 from misrecognizing a current status as a status other than a preheating or an ignition status, the output of the AND element AND4 is set to be "L" when the output OUT3 of the timer circuit 42 is "L". The output of the AND element AND4 becomes "L" since the output of the comparator CP5 is "L" in case a signal inputted thereto from the lamp lifetime detecting circuit 8 is lower than a predetermined threshold value Vth6 and the discharge lamp La is in a state of a normal operation after it enters a lighting status. The output of the AND element AND4 is inputted to a set input terminal S of a latch circuit of the lifetime exhaustion suppressing circuit 482. Accordingly, when the output of the AND element AND4 is "L", an output signal OUT4 of the latch circuit is also set to be "L", which is inverted into an "H" signal via an inverting element INV5.

When the lifetime of the discharge lamp La has elapsed, the voltage across both ends of the discharge lamp La increases, so that the outputs of the comparator CP5 and the AND element AND4 both become "H". Since the output of the AND element AND4 is inputted to the set input terminal S of the latch circuit of the lifetime exhaustion suppression circuit 482, the output OUT4 of the latch circuit also becomes "H", which is inverted into an "L" signal via the inverting element INV5.

Since the outputs of the lifetime exhaustion suppression circuit 482 and the control power detecting circuit 40 are inputted to the 2-input AND element AND1, the operations of the timer circuit 42 and the INV control circuit 44 are stopped as in the sixth embodiment.

Further, though a circuit configuration at a reset input terminal S of the latch circuit of the lifetime exhaustion suppressing circuit 482 is not shown in FIG. 23, the latch circuit may be reset by inputting to the terminal R depending on the output signal of the no-load determination circuit 471.

In this embodiment, inputted to the operation status output circuit 43 are an output of an OR element OR3, to which the output OUT4 of the latch circuit of the lifetime exhaustion suppressing circuit 482 and the output OUT1 of the timer circuit 42 are inputted, and an output of an AND element AND3 to which the output of the lifetime exhaustion suppressing circuit 482 and the output OUT1 of the timer circuit 42 are inputted. The operation status output circuit 43 outputs a predetermined threshold value mode1 when respective outputs of the OR element OR3 and the AND element AND3 are both "L"; outputs a preset threshold value mode2 when respective outputs of the OR element OR3 and the AND element AND3 are both "H"; and outputs a prescribed threshold value mode3 when respective the outputs of the OR element OR3 and the AND element AND3 are "H" and "L", respectively.

That is, when the inverter circuit 2 operates in the preheating status and the ignition status, the output signal of the operation status output circuit 43 is set as mode1 while it is set as mode2 in the lighting status. Further, at the moment when the lifetime of the discharge lamp La has elapsed, the output of the operation status output circuit 43 becomes mode3.

In this preferred embodiment, the operation setting circuit 6 stores a duration period of use of the discharge lamp La while the status signal mode2 is being inputted thereto, as in the conventional examples and the fourth and the fifth preferred embodiment, and, at the same time, controls an output power of the discharge lamp La to be maintained constant regardless of the duration of use of the discharge lamp La. Further, once the lifetime of the discharge lamp La has elapsed, i.e., at a time when the operation setting circuit 6 outputs the status signal mode3, the measured duration period of use can be reset to an initial value. The INV control IC 4 for controlling the inverter circuit 2 detects the lifetime of the lamp La and, if the lifetime thereof is found to have expired, outputs a status signal corresponding thereto. Therefore, the control IC 4 and the operation setting circuit 6 can detect the expiration of the lamp lifetime almost simultaneously, and it is unlikely that the operation setting circuit 6 misrecognizes the current status as other status. For example, though a no-load status detection by a no-load detecting circuit 7 is also performed, as described in the sixth embodiment, it is unlikely that the operation setting circuit 6 fails to distinguish a no-load status from a lifetime expiration status if a status signal representing the no-load status is set to be at a different level from that of the status signal indicating the lamp lifetime expiration.

Since a predetermined threshold value is outputted from the operation status output circuit 43 of the control IC 4 through a single line in the seventh embodiment as well, a size reduction of the discharge lamp lighting device can also be achieved as in the other embodiments described above. Furthermore, since a reset control can be readily executed as in the conventional examples, the reset switch S2 (See FIG. 47) added in the conventional lighting apparatus becomes unnecessary.

Eighth Preferred Embodiment

Figure 24:
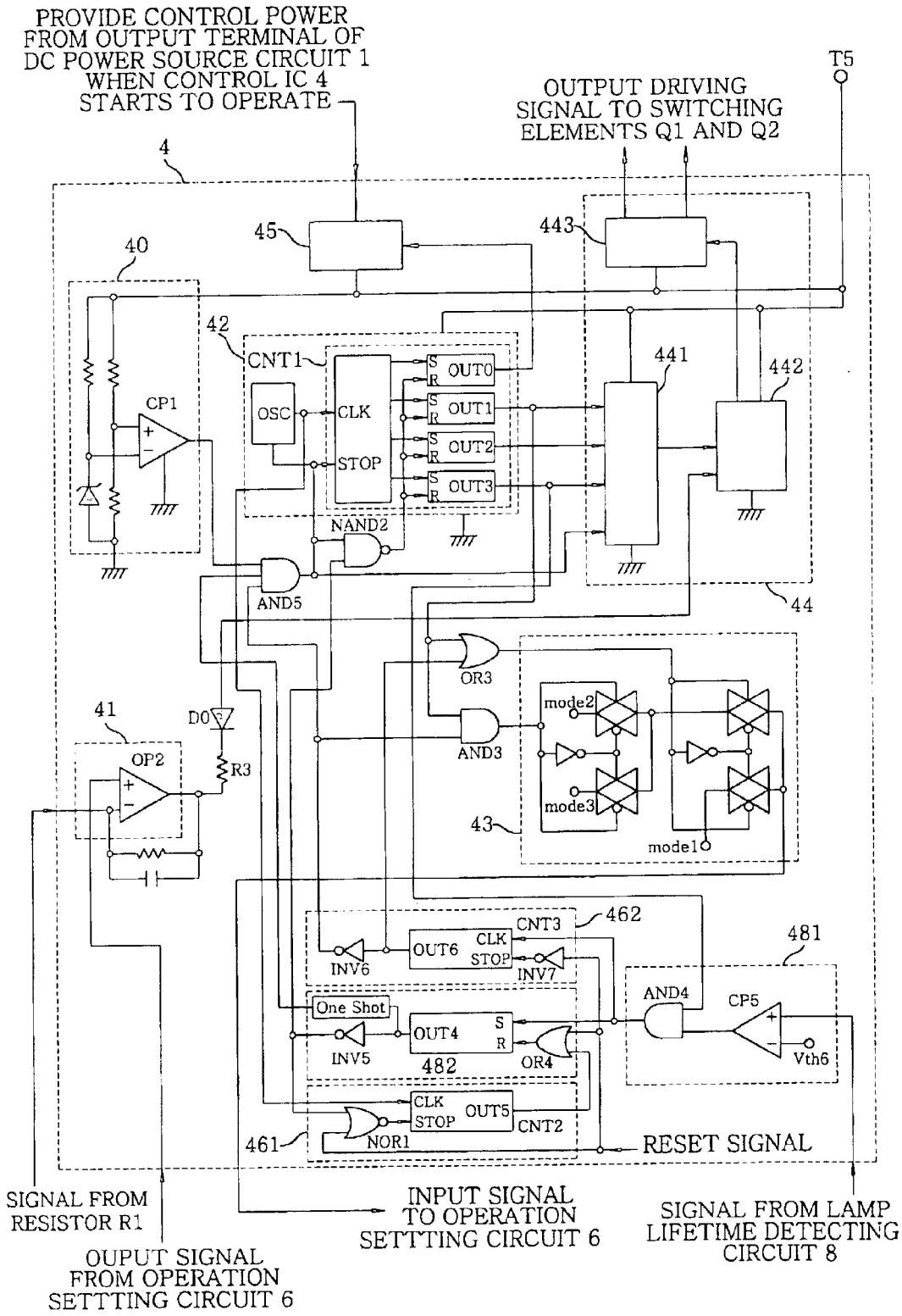
FIG. 24 describes a circuit diagram of a control IC in accordance with an eighth preferred embodiment of the present invention.
Figure 25:
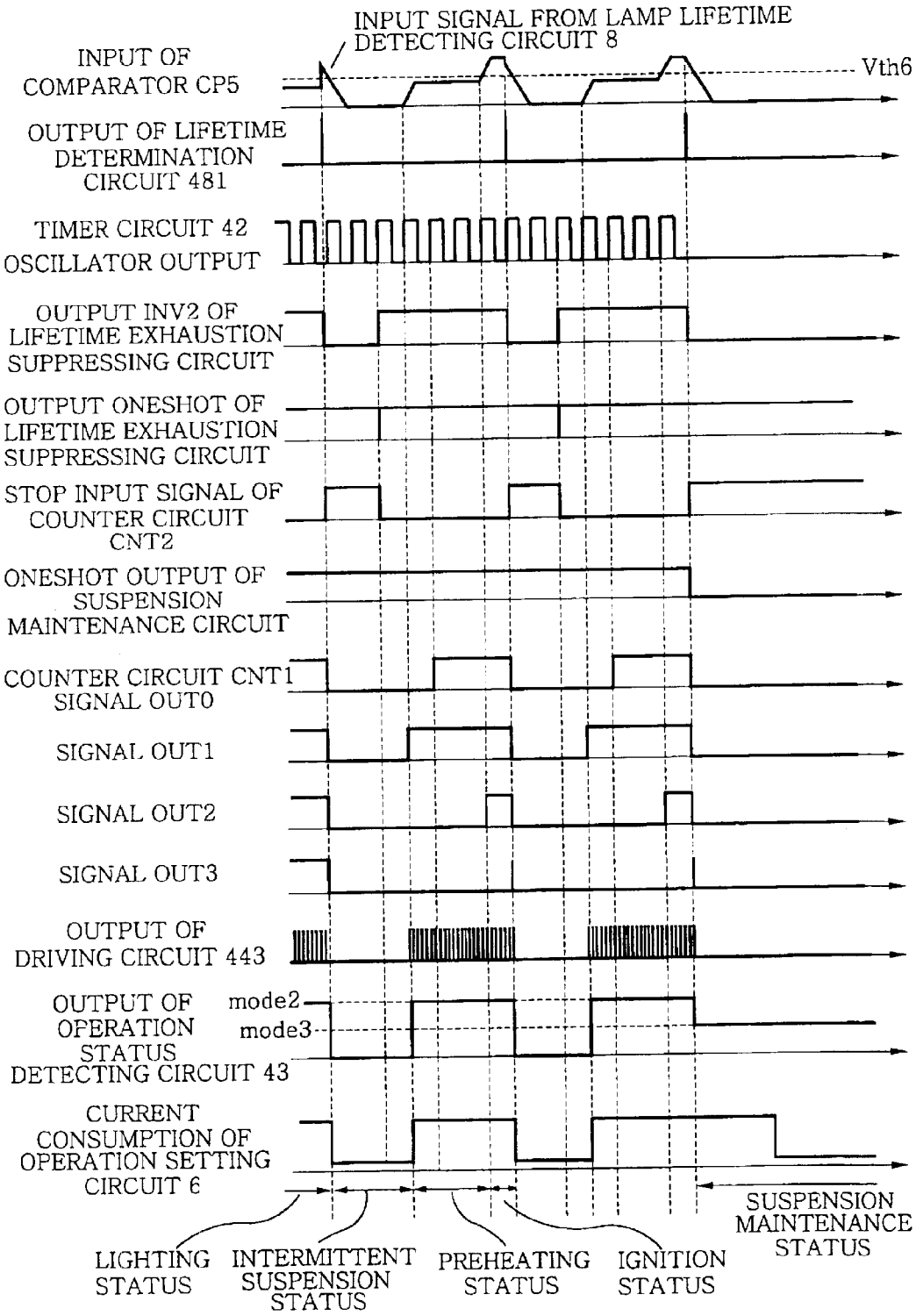
FIG. 25 charts operational waveforms describing an operation of the control IC in accordance with the eighth preferred embodiment of the present invention.

Referring to FIG. 24, there is provided a control IC 4 in accordance with an eighth preferred embodiment of the present invention. FIG. 25 shows operational waveforms thereof. It is preferred in this embodiment that the discharge lamp lighting device includes a lamp lifetime detecting circuit 8 as in the seventh embodiment in FIG. 22. A basic operation of the eighth embodiment is identical to that of the seventh embodiment. Specifically, a driving circuit 45 is operated based on a signal outputted from a timer circuit 42, so that an INV control circuit 44 controls an inverter circuit 2 to operate in a preheating, an ignition and a lighting status. Further, a dimming control is conducted based on a signal level outputted from an operation setting circuit 6 to an output control circuit 41 of the control IC 4.

A signal outputted from the lamp lifetime detecting circuit 8 is proportional to a voltage across both ends of a discharge lamp La, as in the seventh embodiment, and is inputted to a lifetime determination circuit 481 having a comparator CP5. An output of the comparator CP5 and an output OUT3 of the timer circuit 42 are inputted to an AND element AND4. When the output OUT3 of the timer circuit 42 is "L", the output of the AND4 element AND4 also becomes "L". If the signal inputted from the lamp lifetime detecting circuit 8 is lower than a predetermined threshold value Vth6 when the discharge lamp La normally operates after being turned into a lighting status, an output of the comparator CP5 is set to be "L". As a result, the output of the AND element AND4 is also determined as "L". The output of the AND element AND4 is inputted to a set input terminal S of a latch circuit of a lifetime exhaustion suppressing circuit 482, as in the sixth embodiment. When the output of the AND element AND4 is "L", an output OUT4 of the latch circuit is also set as "L", which is inverted into an "H" signal in an inverting element INV5. When the lifetime of the discharge lamp La has elapsed, respective outputs of the comparator CP4 and the AND element AND4 are both turned into "H". Consequently, the output OUT4 of the latch circuit of the lifetime exhaustion suppressing circuit 482 is also set as "H", which is inverted into an "L" signal in the inverting element INV5.

An output of the inverting element INV5 is inputted to a NAND element NAND2 and a NOR element NOR1 of a timer circuit 461. When an output of the lifetime exhaustion suppressing circuit 482, i.e., the output of the inverting element INV5, is "L", an output of the NAND element NAND2 is set as "H" and serves to reset all latch circuits at an output terminal of the timer circuit 42. Therefore, outputs OUT0, OUT1, OUT2 and OUT3 of the timer circuit 42 are all set as "L", and the INV control circuit 44 stops the generation of signals for driving switching elements Q1 and Q2.

Meanwhile, if an "L" reset signal is inputted to the timer circuit 461, the NOR element NOR1, to which the output of the lifetime exhaustion suppressing circuit 482 and a reset signal are inputted, outputs an "H" signal. A counter circuit CNT2 of the timer circuit 461 has the same configuration as that of a counter circuit CNT1 of the timer circuit 42. The counter circuit CNT2 initiates its counting operation when a STOP signal is "H" and serves to obtain a counting number of inputted clock signals. When the counting number reaches a predetermined value, an output OUT5 thereof becomes "H". Since the output OUT5 is maintained as "L" during the counting operation of the counter circuit CNT2, a reset input terminal R of the latch circuit of the lifetime exhaustion suppressing circuit 482 is set as "L". Upon the completion of the counting operation of the counter circuit CNT2, the output OUT5 becomes "H" and while the reset input terminal R of the latch circuit of the lifetime exhaustion suppressing circuit 482 is set as "H", and the output of the latch circuit thereof becomes "H". Accordingly, the lifetime exhaustion suppressing circuit 482 becomes to output an "H" signal while the output of the NAND element NAND2 is turned into "L", thereby releasing a reset status of the latch circuits of the timer circuit 42.

Further, from the moment when the output of the lifetime exhaustion suppressing circuit 482 is turned into "H", an output of an AND element AND5 is maintained as "L" for a short period time by an output of a one shot circuit which serves to output an "L" signal for the short period time. The "L" output of the AND element AND5 is then inputted to a STOP input of the counter circuit CNT1, thereby allowing the timer circuit 42 to resume its operation from an initial state.

An output signal of the lifetime determination circuit 481 is inputted to a clock input terminal CLK of a counter circuit CNT3 in a suspension maintenance circuit 462. The counter circuit CNT3 of the suspension maintenance circuit 462 has the same configuration as that of the counter circuit CNT1 of the timer circuit 42 and serves to output a signal OUT6 of an "H" state when output signals of the lifetime determination circuit 481 are inputted, for example, three times.

Since the output OUT6 of the counter circuit CNT3 of the suspension maintenance circuit 462 is inputted to the AND element AND5 via an inverting element INV 6, an output of the AND element AND5 is set as "L" when the output OUT6 of the counter circuit CNT3 is "H". As a result, the timer circuit 42 and the INV control circuit 44 stop their operation. The INV control circuit 44 maintains its stop status as long as the output OUT6 of the counter circuit CNT3 of the suspension maintenance circuit 462 is not reset.

In this embodiment, inputted to an operation status output circuit 43 are an output of an OR element OR3, to which the outputs OUT6 and OUT1 of the counter circuit CNT3 and the timer circuit 42 are inputted, respectively, and the output of the AND element AND3 to which the output of the suspension maintenance circuit 462 and the output OUT1 of the timer circuit 42 are inputted. The operation status output circuit 43 outputs a predetermined threshold value mode1 when the outputs of the OR element OR3 and the AND element AND3 are both "L"; outputs a preset threshold value mode2 when respective outputs of the OR element OR3 and the AND element AND3 are "H"; and outputs a prescribed threshold value mode3 when the output of the OR element OR3 is "H" while the output of the AND element AND3 is "L".

That is, the operation status output circuit 43 outputs the signal mode3 when the inverter circuit 2 operates in a preheating, an ignition and a lighting status while it outputs the signal mode1 while the lifetime exhaustion suppressing circuit 482 is operating. Further, for a time period during which the operation of the INV control circuit 44 is stopped by the operation of the suspension maintenance circuit 462, the operation status output circuit 43 outputs the signal mode3.

It is preferable to control the operation setting circuit 6 to reset its measured lighting period when the status signal mode3 is inputted, as in the seventh embodiment. Since a predetermined threshold value corresponding to a lighting status is outputted from the operation status output circuit 43 of the control IC 4 through a single line in accordance with the eighth embodiment as well, a size reduction of the discharge lamp lighting device can be achieved as in the other embodiments described before.

Further, as in the conventional examples, a reset control can be readily executed. In the seventh embodiment, the measured lighting period was reset to the initial state after determining the expiration of the lifetime of the discharge lamp only one time. Thus, it is highly likely that the measured lighting period is unintentionally reset. In the eighth embodiment, however, a reset processing is conducted after the inverter circuit 2 is operated several times. Accordingly, it can be prevented the reset processing from being wrongly performed.

Figure 26:
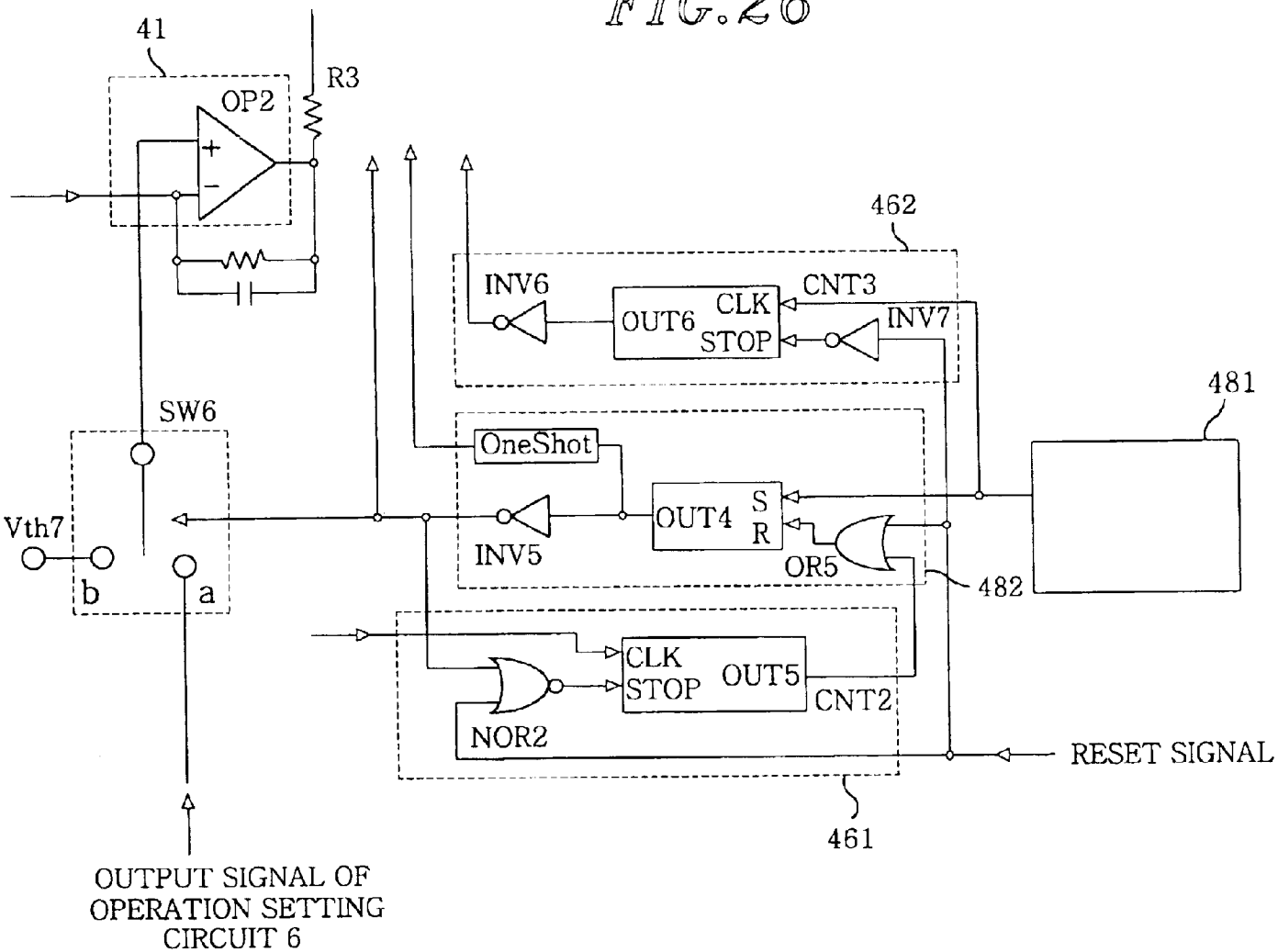
FIG. 26 is a circuit diagram showing a main part of an exemplary control IC in accordance with the eighth preferred embodiment of the present invention.

Further, though there is employed a control mechanism for stopping the operation of the INV control circuit 44 at a time when the lifetime of the discharge lamp La is expired in the seventh embodiment, it is also preferable to adopt a control mechanism for on-off operating the switch element SW6 on the basis of an output of the lifetime exhaustion suppressing circuit 482, i.e., delivering an output signal of the operation setting circuit 6 to the output control circuit 41 in case the output of the lifetime exhaustion suppressing circuit 482 is "H" while transferring a preset threshold value Vth7 to the output control circuit 41 in case the output of the lifetime exhaustion suppressing circuit 482 is "L", as shown in FIG. 26. By using such a control mechanism, the on-off cycle of the inverter circuit 2, which is controlled by the INV control circuit 44, may be set to be shortened during the operation of the lifetime exhaustion suppressing circuit 482, thereby controlling the output of the inverter circuit 2 to be of a low power.

Ninth Preferred Embodiment

Figure 27:
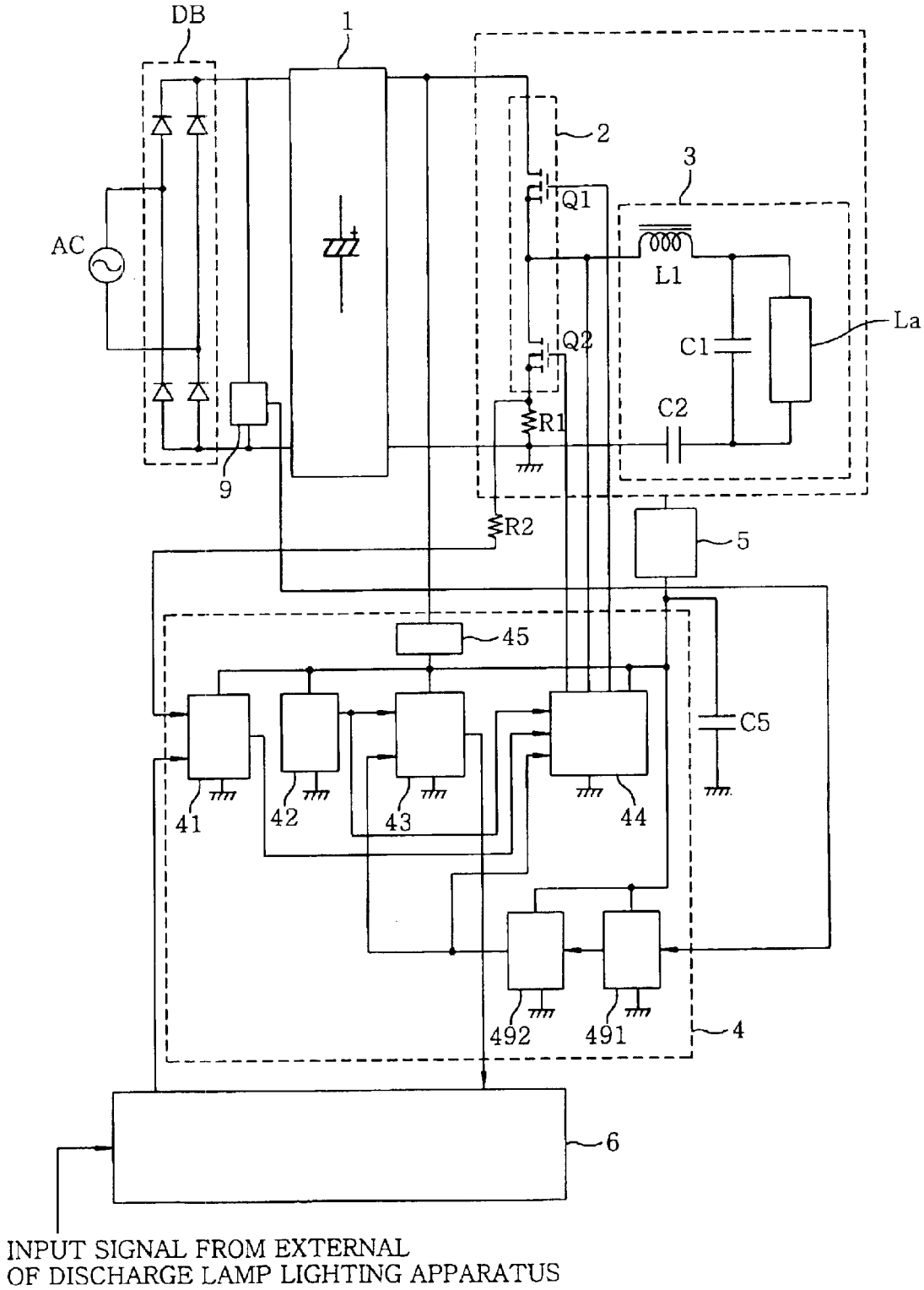
FIG. 27 illustrates a circuit diagram of a discharge lamp lighting device in accordance with a ninth preferred embodiment of the present invention.

FIG. 27 shows a configuration of a discharge lamp lighting device in accordance with a ninth preferred embodiment of the present invention. The ninth embodiment is different from the sixth embodiment shown in FIG. 19 in that a low power detecting circuit 9 is additionally installed at an output terminal of a rectifier DB and a control IC 4 employed therein includes a low power determination circuit 491 for receiving an output signal inputted from the low power detecting circuit 9 and a low power suppressing circuit 492 for stopping an operation of an inverter circuit on the basis of an output of the low power determination circuit 491. A detailed configuration of the control IC 4 is identical to that described in the sixth embodiment. Preferably, the output signal of the low power detecting circuit 9 is compared with a predetermined threshold value by a comparator, and an operation of an INV control circuit 44 is stopped on the basis of an output of the comparator, thereby converting a status signal outputted from an operation status output circuit 43. When an input voltage of an AC power source AC is reduced, a power supplied from a control power source circuit 5 tends to be reduced as well and, thus, an enough power may not be kept supplied from a driving circuit 45 of the control IC 4. In such a case, there is likelihood, for example, that a malfunctioning of the operation setting circuit 6 is caused due to a shortage of a control power supplied thereto during a process of writing or reading data in a microcomputer or an EEPROM of the operation setting circuit 6. For the reason, it is preferable to control the operation setting circuit 6 to stop its operation in case a status signal indicating a reduction of a power level of the AC power source AC is inputted from the low power detecting circuit 9.

Tenth Preferred Embodiment

Figure 28:
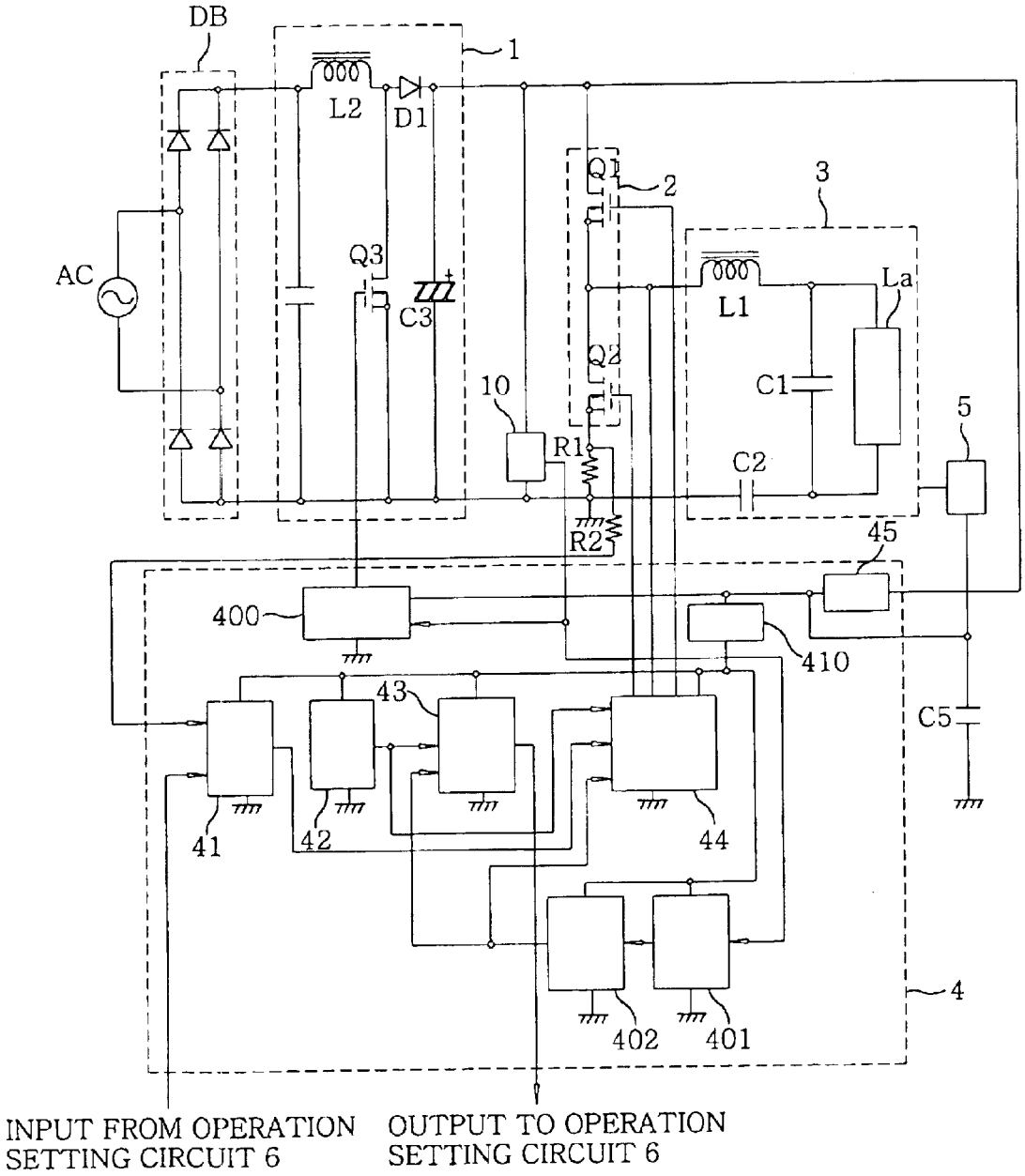
FIG. 28 provides a circuit diagram of a discharge lamp lighting device in accordance with a tenth preferred embodiment of the present invention.

Referring to FIG. 28, there is provided a discharge lamp lighting device in accordance with a tenth preferred embodiment of the present invention. In this embodiment, a DC power source circuit 1 employs a configuration of a boosting chopper and a control IC 4 includes a PFC control circuit 400 for outputting a driving signal to a switching element Q3 incorporated in the DC power source circuit 1. Further, connected to an output terminal of the DC power source circuit 1 is a smoothed output detecting circuit 10 for detecting an output voltage of the DC power source circuit 1. An output signal of the smoothed output detecting circuit 10 is inputted to an output decrease determination circuit 401 of the control IC 4.

Figure 29:
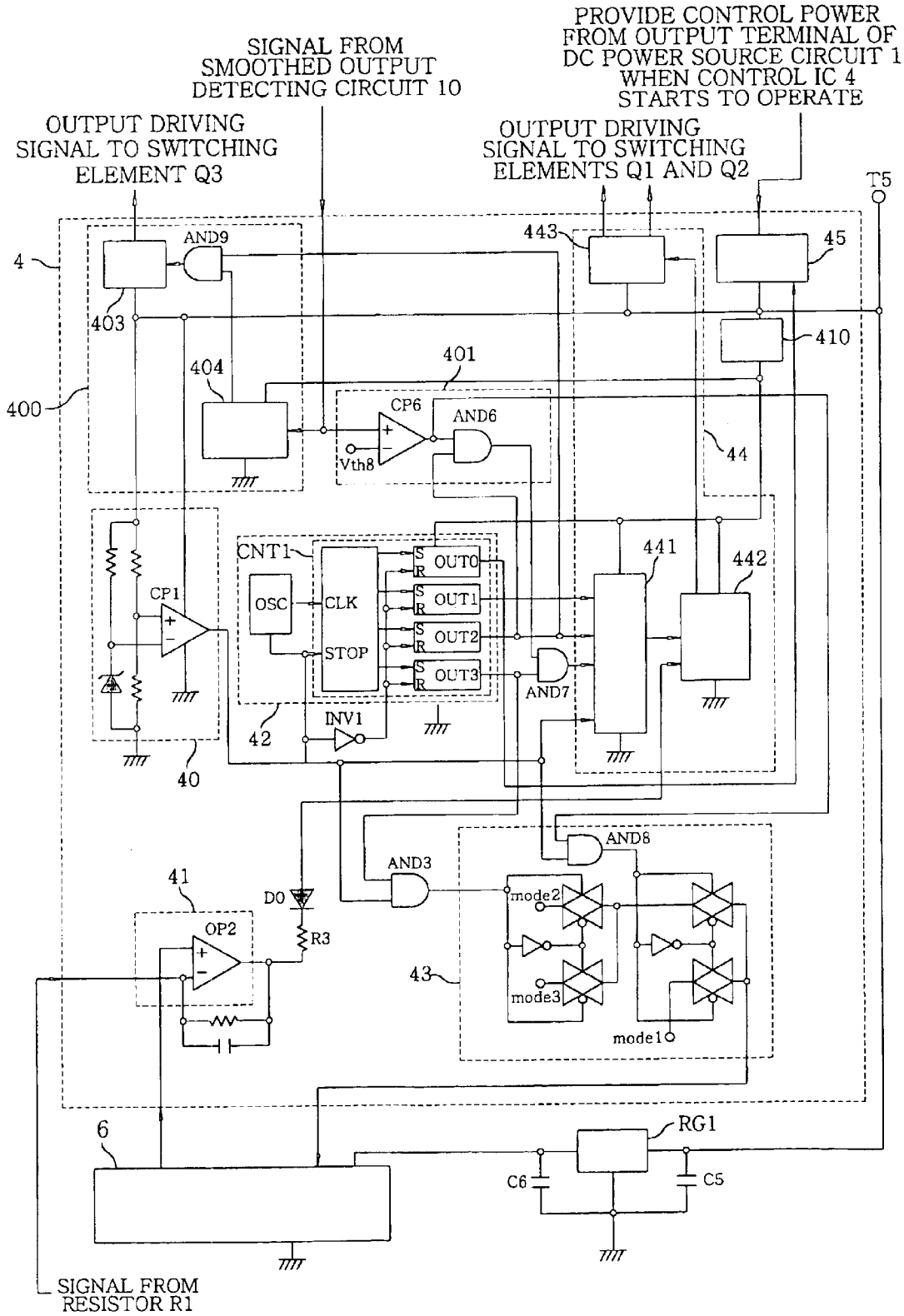
FIG. 29 shows a circuit diagram of a control IC in accordance with the tenth preferred embodiment of the present invention.
Figure 30:
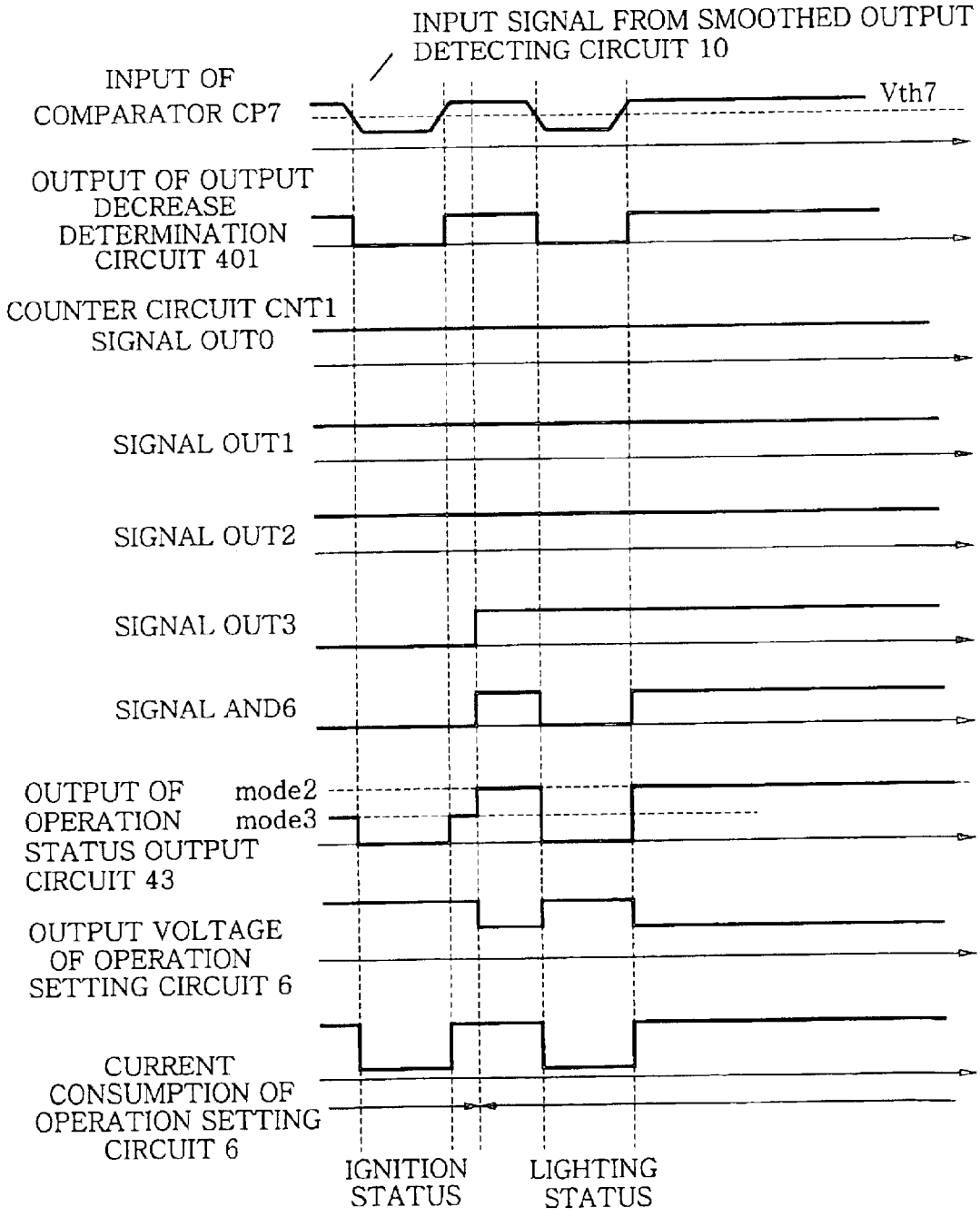
FIG. 30 charts operational waveforms describing an operation of the control IC in accordance with the tenth preferred embodiment of the present invention.

FIG. 29 shows the control IC 4 in accordance with the tenth embodiment and FIG. 30 describes operation waveforms thereof. The basic operations of the control IC 4 in this embodiment are identical to those described in the fifth to ninth embodiments explained above. That is, a driving circuit 45 is operated in accordance with an output signal OUT0 provided from a timer circuit 42 and an INV control circuit 44 starts to operate when a signal OUT1 becomes "H", thereby initiating an operation of an inverter circuit 2. Further, a dimming control is performed on the basis of a signal level outputted from an operation setting circuit 6 to an output control circuit 41 of the control IC 4.

Furthermore, in accordance with this embodiment, an output of an AND element AND9, to which the output signal OUT1 of the timer circuit 42 and an output of a PFC cycle setting circuit 404 for determining an on/off timing of the switching element Q3 are inputted, is inputted to a driving circuit 403 to thereby render the driving circuit 403 to output a driving signal to the switching element Q3. Accordingly, when the output. OUT1 of the timer circuit 42 is "L", i.e., when an operation of an INV control circuit 44 is paused, the output of the AND element AND9 is also set as "L", so that no driving signal is provided to the switching element Q3. When the output OUT1 of the timer circuit 42 is "H", i.e., when the INV control circuit 44 starts to operate, the output of the AND element AND9 becomes identical to that of the PFC cycle setting circuit 404. At this time, a driving signal is outputted to the switching element Q3.

Though not shown in FIG. 29, the PFC cycle setting circuit 404 includes a differential amplifier that compares a signal outputted from the smoothed output detecting circuit 10 with a predetermined threshold value outputted from a reference power source circuit 410 and determines an on/off timing of the switching element Q3 based on the comparison result. The PFC cycle setting circuit 404 can have any configuration as long as it realizes such a function as described.

The output signal of the smoothed output detecting circuit 10 is inputted to a comparator CP6 of the output decrease determination circuit 401 to be compared with a predetermined threshold value Vth8. An output of an AND element AND6, to which an output of the comparator CP6 and an output OUT2 of the timer circuit 42 are inputted, is inputted to one input terminal of a 2-input AND element AND7. Inputted to another input terminal of the 2-input AND element AND7 is an output OUT3 of the timer circuit 42. In a preheating status, since an output OUT2 of the timer circuit 42 is "L", the output of the AND element AND6 and an output of the AND element 7 are both set as "L". In an ignition status, the output OUT2 is turned into "H" and the output of the AND element AND6 becomes identical to the output of the comparator CP6.

If the output signal of the smoothed output detecting circuit 10 gets higher than the predetermined threshold value Vth8, the output of the AND element AND6 is turned into "H". Accordingly, if an output OUT3 of the timer circuit 42 is "H", the output of the AND element AND7 is set as "H" to thereby have a lighting status to be initiated.

Since the output of the AND element AND7 is maintained to be "L" in case an output level of the DC power source circuit 1 is lowered and thus an output level of the smoothed output detecting circuit 10 is decreased to become lower than the threshold value Vth8, a signal outputted from an INV cycle setting circuit 442 becomes same as that in the ignition status. Accordingly, the operational frequency of the inverter circuit 2 increases so that a generation of an output of the inverter circuit 2 is suppressed.

In the tenth embodiment, inputted to the operation status output circuit 43 are the output of the comparator CP6 of the output decrease determination circuit 401, an output of a control power detecting circuit 40 and an output of an AND element AND3 to which the output of the control power detecting circuit 40 and the output OUT3 of the timer circuit 42 are inputted. Further, in the operation status output circuit 43, the outputs of the comparator CP6 and the control power detecting circuit 40 are inputted to an AND element AND8. The operation status output circuit 43 outputs a predetermined threshold value mode1 when respective outputs of the AND elements AND3 and AND8 are "L"; outputs a preset threshold value mode3 when the output of the AND element AND3 is "L" while the output of the AND element AND8 is "H"; outputs a prescribed threshold value mode2 when respective outputs of the AND elements AND3 and AND8 are "H"; and outputs the predetermined threshold value mode1 when the output of the AND element AND3 is "H" while the output of the AND element AND8 is "L".

That is, when the inverter circuit 2 operates in a preheating status and an ignition status, the operation status output circuit 43 outputs the output signal mode1 in a state where the output power level of the DC power source circuit 1 is lowered, but outputs the output signal mode3 when the output power level of the DC power source circuit 1 is in a normal state. In a lighting status, on the other hand, the output status output circuit 43 outputs the output signal mode1 when the output power level of the DC power source circuit 1 is lowered, but outputs the output signal mode2 when the output power level of the DC power source circuit 1 is in the normal state.

Furthermore, in case the lifetime of the discharge lamp La has elapsed, the output signal of the operation status output circuit 43 is found to be mode2. In the tenth embodiment, it is preferable to stop the operation of the operation setting circuit 6 by way of, e.g., measuring a duration period of a state where the status signal mode2 is inputted, i.e., a time period of the lighting status, by counting and storing the number of the status signal mode3 inputted thereto.

Hereinafter, there will be described a method for setting the status signals mode1, mode2 and mode3 and a threshold value for use in detecting them. As shown in FIG. 29, a control power source of the control IC 4 is connected to the reference power source circuit 410. The reference power source circuit 410 includes, e.g., a zener diode and a buffer circuit and serves to supply a power to each controller part by providing a power at a stable output power level regardless of the control power level. By connecting in series a plurality of resistors to an output terminal of such a reference power source whose output power level is stable, desired DC signals can be obtained. Preferably, the DC signals obtained by such a resistance type potential division may be used as the threshold value for use in detecting the status signals mode 1, mode2 and mode 3.

As in the ninth embodiment, the tenth embodiment is capable of preventing an occurrence of a malfunctioning of the operation setting circuit 6 that is caused by a shortage in a supply of a control power therefor as the output power level of the DC power source circuit 1 is lowered. Further, the tenth embodiment also realizes a size reduction of the discharge lamp lighting device as in the other embodiments describe above.

Eleventh Preferred Embodiment

Figure 31:
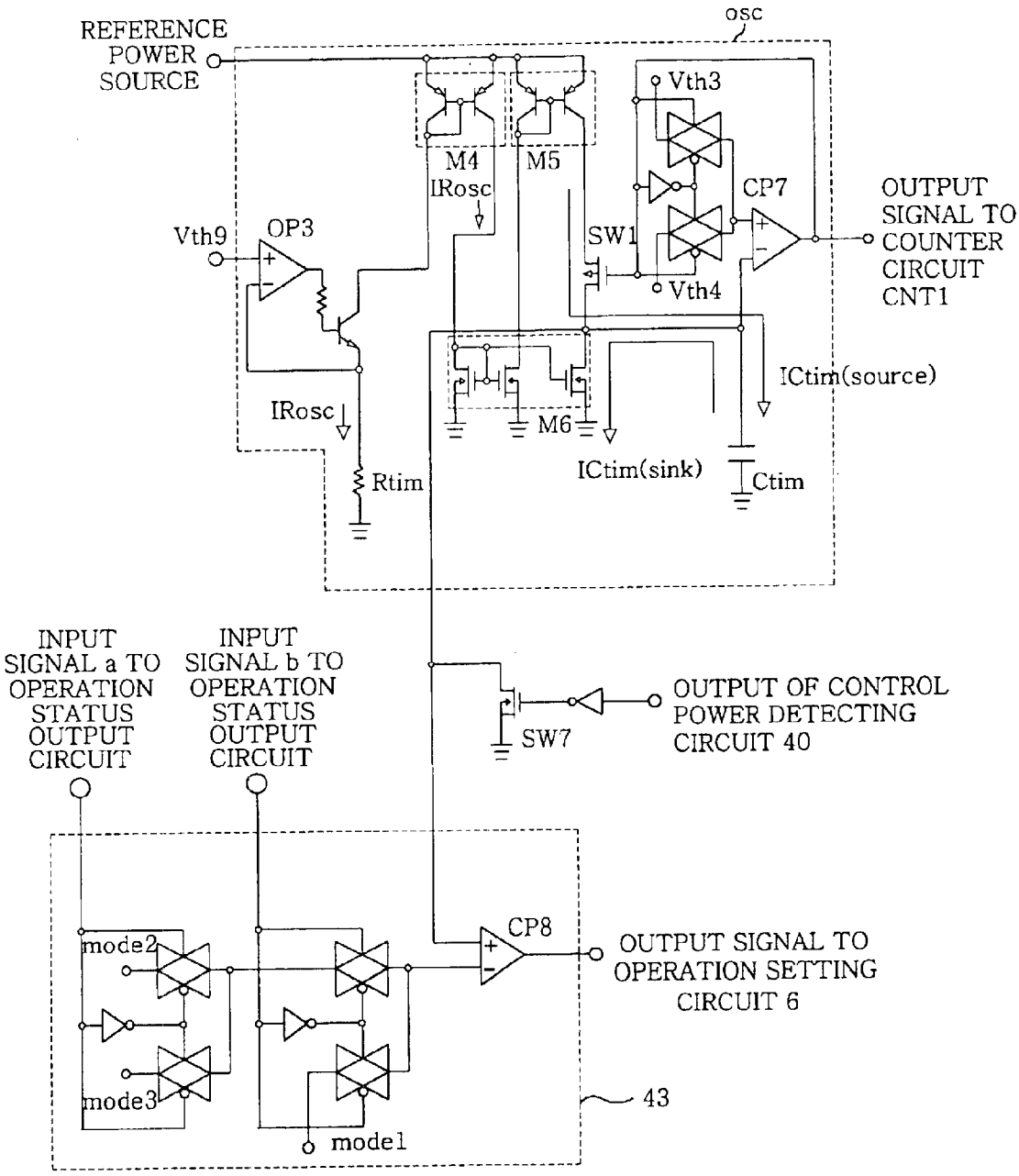
FIG. 31 exhibits a circuit diagram of an oscillator included in a timer circuit of a control IC in accordance with an eleventh preferred embodiment of the present invention.

Referring to FIG. 31, there is described a detailed configuration of an oscillator OSC of a timer circuit 42 incorporated in a control IC 4 in accordance with an eleventh preferred embodiment of the present invention. A circuit configuration and a basic operation thereof are identical to those of an inverter cycle setting circuit 442 shown in FIGS. 3 and 9. Specifically, a cycle of a clock signal outputted from the oscillator OSC is determined based on a resistance value of a resistor Rtim and a capacity of a capacitor Ctim, which are connected to an interior or an exterior of the control IC 4. A waveform of a voltage across both ends of the capacitor Ctim is found to be of a chopping type as in the capacitor Cpls shown in FIG. 4. An output signal of a comparator CP7 is utilized as the clock signal. Further, for example, by inputting an output signal of a control power detecting circuit 40 to a switch element SW7 connected in parallel to the capacitor Ctim via an inverting element (NOT circuit), a clock signal is outputted by oscillating the chopping voltage waveform of the capacitor Ctim depending on the output signal of the control power detecting circuit 40. Or, by stopping a charging of the capacitor Ctim, the oscillation can be stopped.

Herein, it is also preferred that the status signal outputted from the operation status output circuit 43 is set to have a rectangular waveform with a regular cycle and, thus, a variable duty ratio in case the chopping voltage waveform of the capacitor Ctim is inputted to the comparator CP8 to which an output of an analog switch circuit is inputted through another input terminal thereof.

In case the status signal outputted from the operation status output circuit 43 is a DC signal, a microcomputer employed in the operation setting circuit 6 is required to have an A/D converter for converting an analog value of the DC signal to a digital value. However, in case a duty signal is inputted to the operation setting circuit 6 as the status signal, the A/D converter is not needed and it becomes possible to determine the state of the status signal between "H" and "L" and obtain a lasting period of the "L" or the "H" state. In such a case, a use of a low price microcomputer may be sufficient for that purpose.

Twelfth Preferred Embodiment

Figure 32:
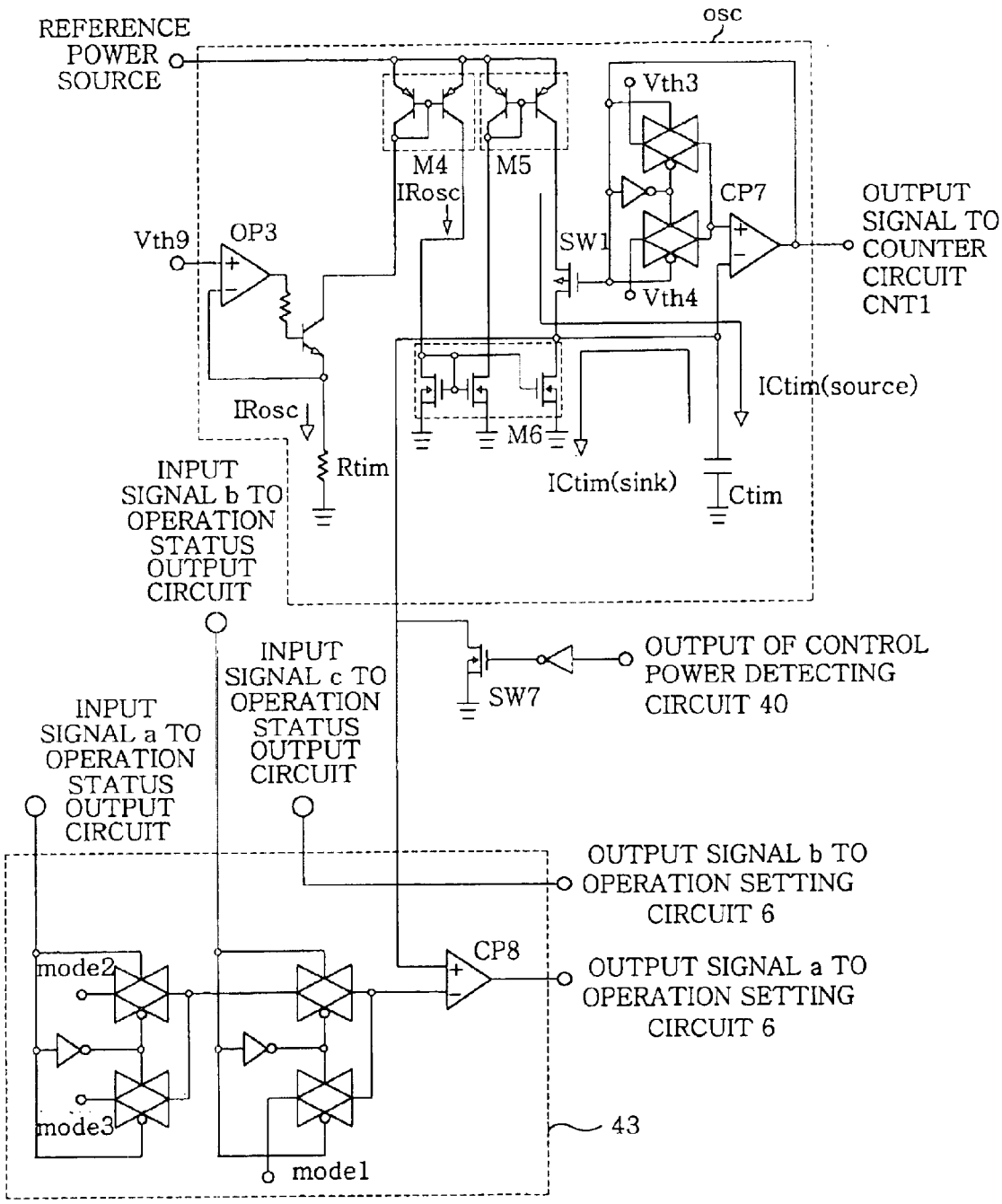
FIG. 32 presents a circuit diagram of an oscillator included in a timer circuit of a control IC in accordance with a twelfth preferred embodiment of the present invention.

FIG. 32 shows a detailed configuration of an oscillator OSC of a timer circuit 42 employed in a control IC 4 in accordance with a twelfth preferred embodiment of the present invention. A configuration and an operation of this embodiment are almost identical to those described in the eleventh embodiment. Specifically, a duty ratio of a status signal a, which is outputted from a comparator CP8, is varied depending on input signals a and b inputted to an operation status output circuit 43. Furthermore, in this embodiment, an input signal c inputted to the operation status output circuit 43 is outputted as a status b without being processed. The input signals a, b, and c inputted to the operation status output circuit 43 are "H" or "L" signals outputted from logic circuits described in the preferred embodiments explained so far.

Though the first to the eleventh embodiments employ a single line in order to output a status signal from the operation status output circuit 43 to the operation setting circuit 6, the twelfth embodiment employs two lines therefor, thereby making it possible to conduct a control corresponding to a plurality of statuses.

Thirteenth Preferred Embodiment

Figure 33:
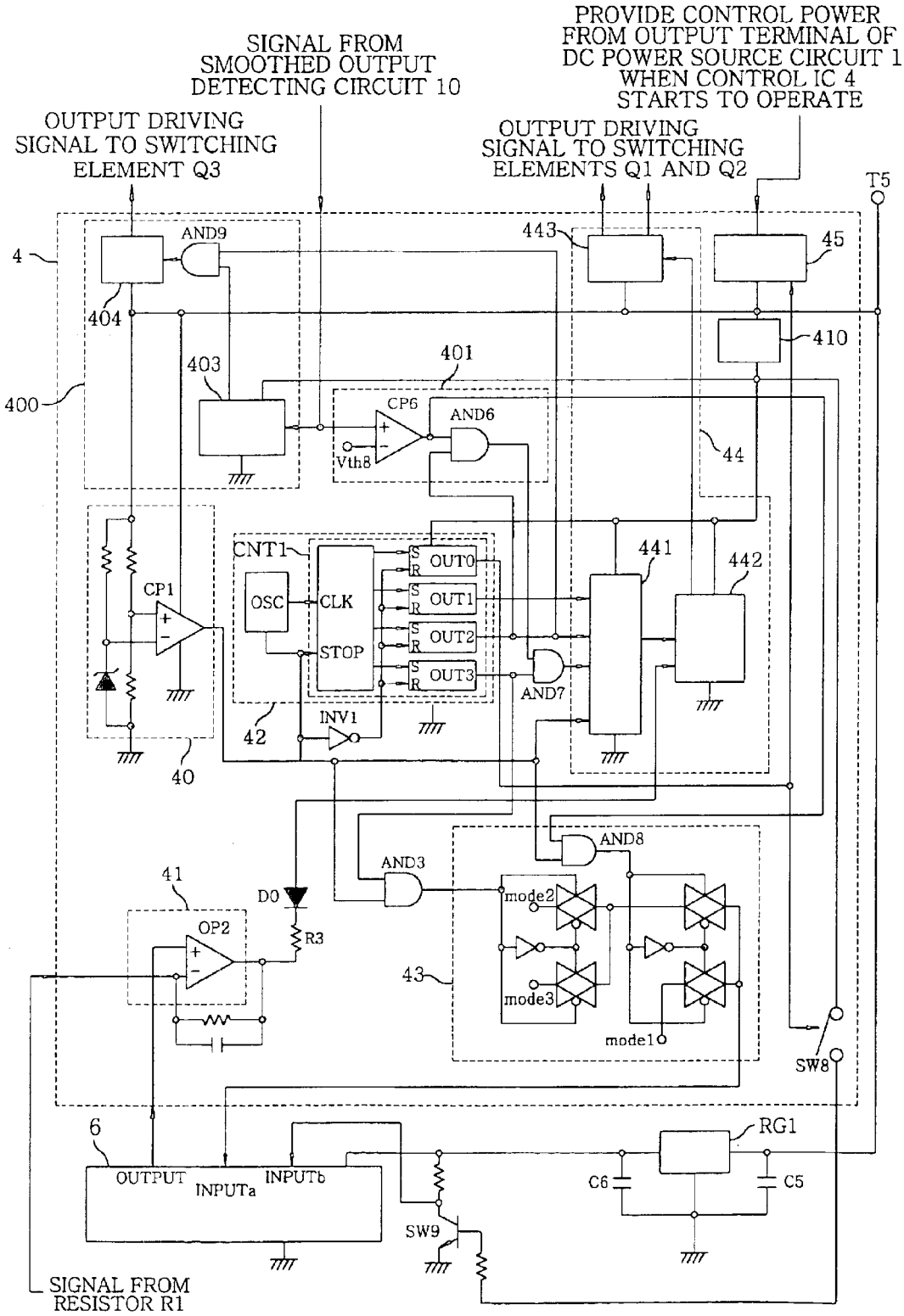
FIG. 33 illustrates a circuit diagram of a control IC in accordance with a thirteenth preferred embodiment of the present invention.

FIG. 33 describes a control IC 4 in accordance with a thirteenth preferred embodiment of the present invention. A configuration and an operation thereof are almost identical to those described in the tenth embodiment. The control IC 4 outputs an output of a reference power source to the exterior via a switch element SW8. The switch element SW8 is on-off operated on the basis of an output OUT0 of a timer circuit 42. To be more specific, it is turned off when the output OUT0 is "L" and turned on when the output OUT0 is "H". A reference voltage from the reference power source is inputted to an input b of an operation setting circuit 6 via a switch element SW9 to be used as a status signal during an operation of a driving circuit 45. Thus, it is preferred to control a microcomputer of the operation setting circuit 6 to be in a sleep state when the output OUT0 is "L", i.e., while the driving circuit 45 of the control IC 4 is operating. Since status signals are outputted from an operation status output circuit 43 to the operation setting circuit 6 through two lines as in the twelfth embodiment, a control can be performed corresponding to a plurality of statuses.

Fourteenth Preferred Embodiment

Figure 34:
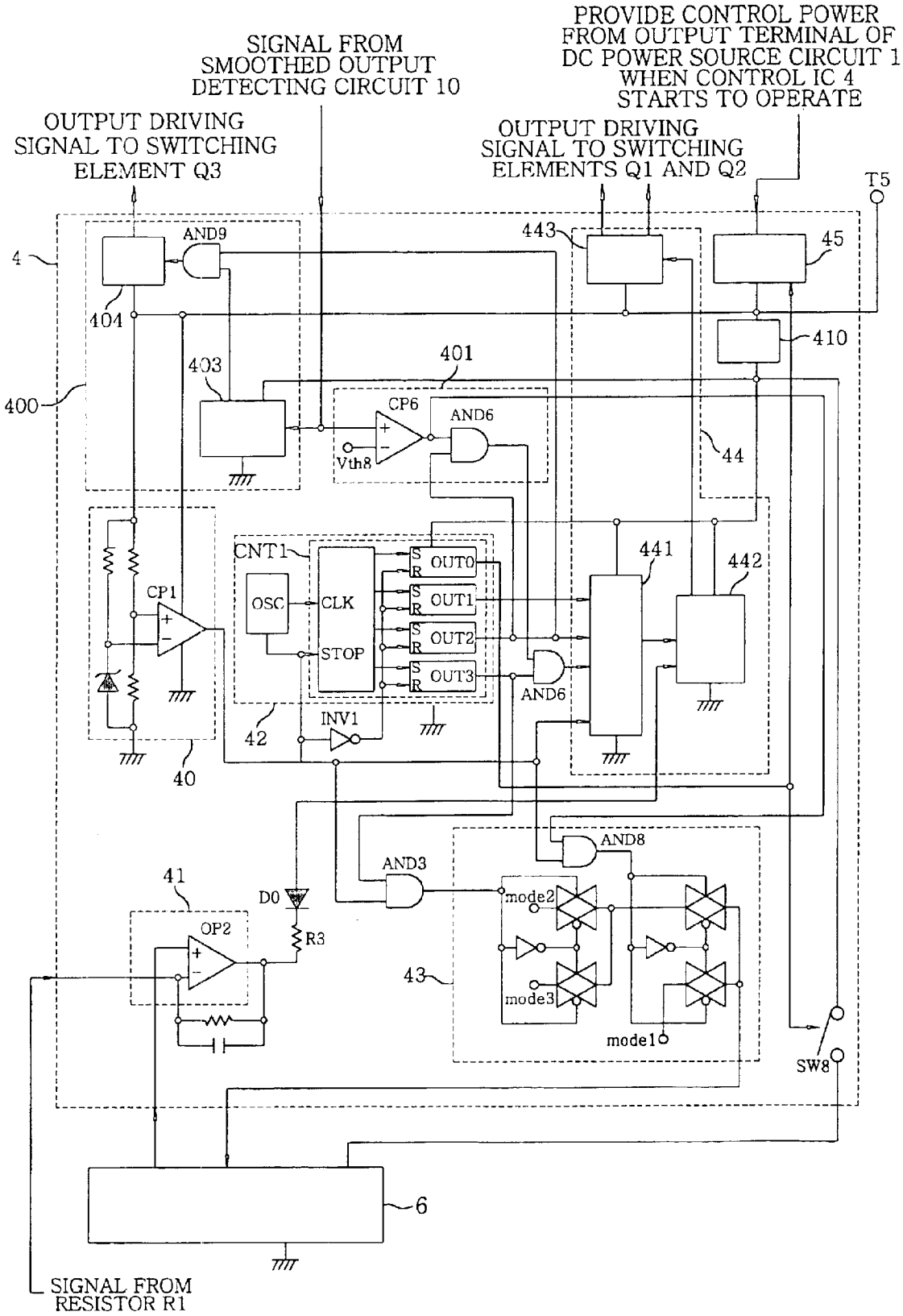
FIG. 34 is a circuit diagram of a control IC in accordance with a fourteenth preferred embodiment of the present invention.

Referring to FIG. 34, there is illustrated a control IC 4 in accordance with a fourteenth preferred embodiment of the present invention. A circuit configuration and an operation employed in this embodiment are also identical to those described in the thirteenth embodiment, and a basic configuration thereof is similar to that in the tenth embodiment. The control IC 4 in this embodiment outputs an output of a reference power source to the exterior via a switch element SW8, as in the thirteenth embodiment, to thereby employ it as a control power for an operation setting circuit 6.

For example, in case of resetting the timer circuit 42 in response to a detection of a no-load state, an output OUT0 of the timer circuit is maintained as "L" so that a power supply to the operation setting circuit 6 is stopped, thereby minimizing a current consumption in the control IC 4 and the operation setting circuit 6.

In the thirteenth embodiment, a reduction of the current consumption can be achieved by controlling the microcomputer to be in a sleep state by using a status signal inputted thereto. In this embodiment, however, same effect can be obtained by stopping the power supply to the operation setting circuit 6.

Since the fourteenth embodiment employs a single line to output a status signal from an operation status output circuit 43 to the operation setting circuit 6, the same effect as obtained in the first to the eleventh embodiment can be accomplished.

Fifteenth Preferred Embodiment

Figure 35:
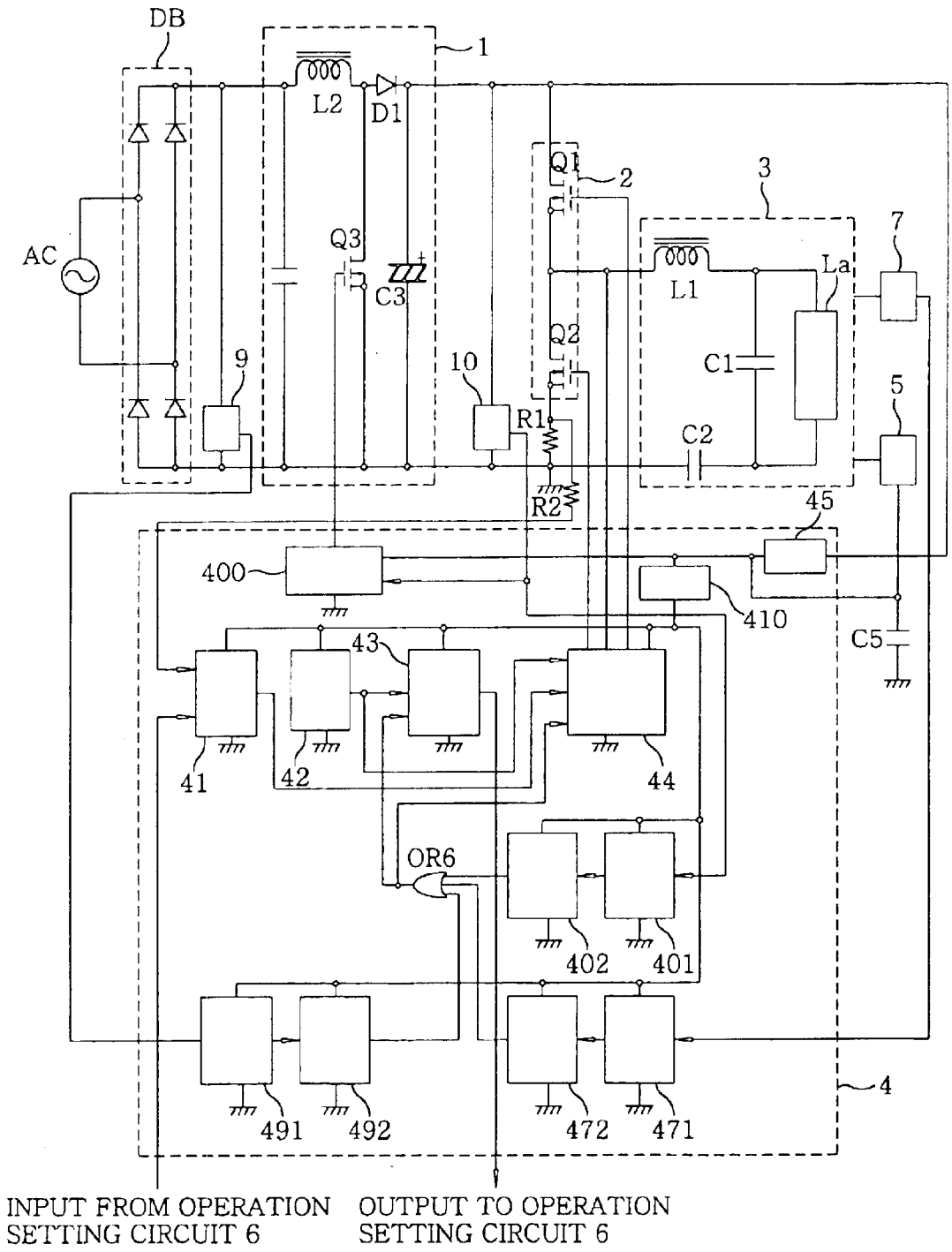
FIG. 35 provides a circuit diagram of a discharge lamp lighting device in accordance with a fifteenth preferred embodiment of the present invention.

FIG. 35 provides a circuit diagram of a discharge lamp lighting device in accordance with a fifteenth preferred embodiment of the present invention. The fifteenth embodiment employs a no-load detecting circuit 7, a low power detecting circuit 9 and a smoothed output detecting circuit 10 described in the sixth, the ninth and the tenth embodiment, respectively. A control IC 4 employed therein includes a no-load determination circuit 471; a no-load suppressing circuit 472; a low power determination circuit 491; a low power suppressing circuit 492; an output decrease determination circuit 401 and an output decrease suppressing circuit 402 for stopping an INV control circuit 44 when an abnormality is detected from a signal inputted from each of the detecting circuits.

Outputs of the no-load suppressing circuit 472, the low power suppressing circuit 492 and the output decrease suppressing circuit 402 are inputted to an OR element OR6. An output signal of the OR element OR6 serves to stop the operation of the INV control circuit 44 and, at the same time, is inputted to an operation status output circuit 43. Accordingly, status signals outputted from the operation status output circuit 43 in a no-load suppressing status, a low power suppressing status and an output decrease suppressing status are all same signals. A microcomputer is preferably controlled to be in a sleep state in this embodiment as well when such status signals are inputted to the operation setting circuit 6, thereby reducing power consumption.

Sixteenth Preferred Embodiment

Figure 36:
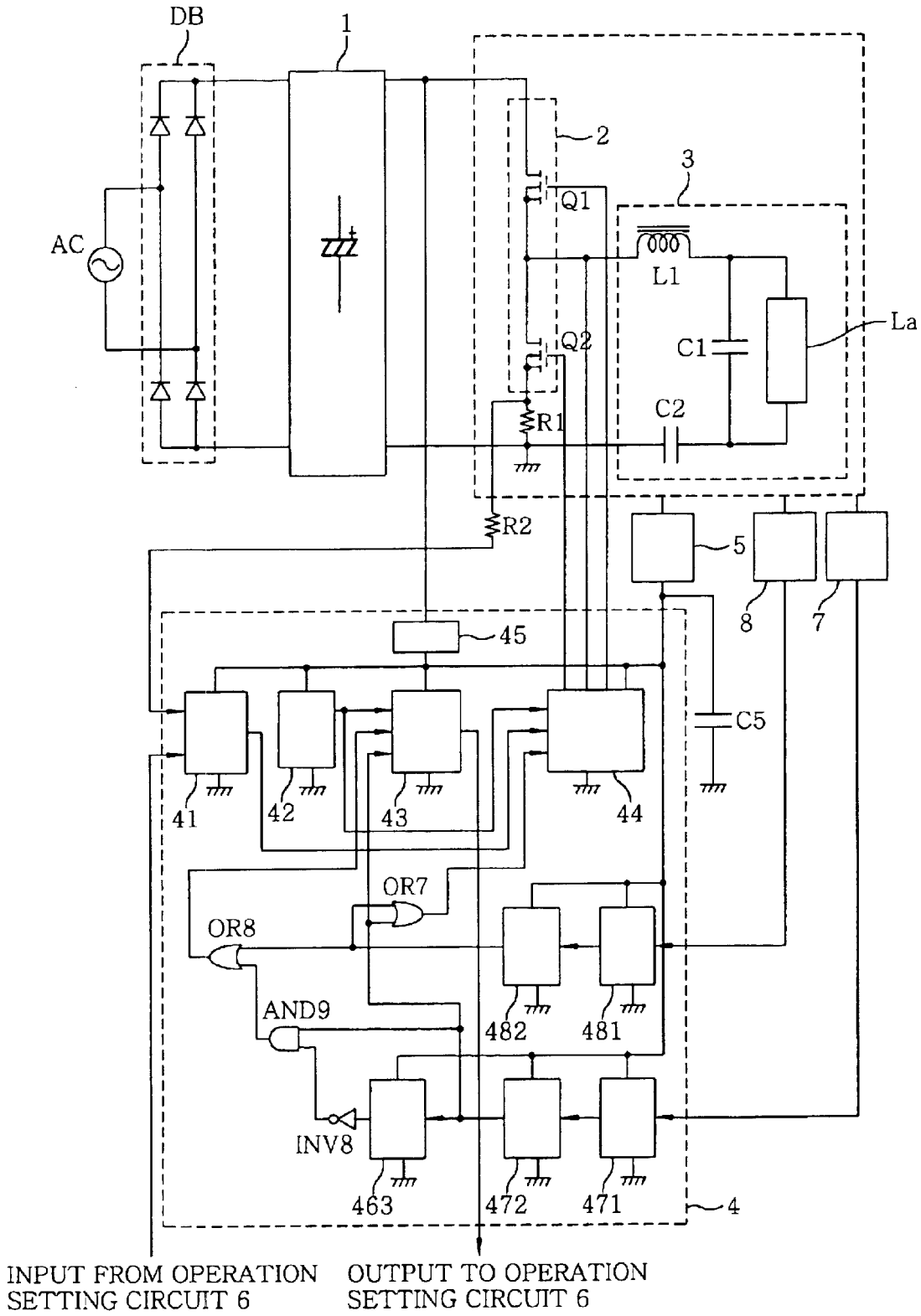
FIG. 36 shows a circuit diagram of a discharge lamp lighting device in accordance with a sixteenth preferred embodiment of the present invention.

Referring to FIG. 36, there is provided a circuit diagram of a discharge lamp lighting device in accordance with a sixteenth preferred embodiment of the present invention. The sixteenth embodiment employs a no-load detecting circuit 7 and a lamp lifetime detecting circuit 8 described in the sixth and the seventh embodiment, respectively. The control IC 4 includes a no-load determination circuit 471, a no-load suppressing circuit 472, a lifetime determination circuit 481 and a lifetime exhaustion suppressing circuit 482 for stopping an inverter circuit 2 or suppressing an output from an inverter circuit 2 when an abnormality is detected based on signals inputted from respective detecting circuits.

Outputs of the no-load suppressing circuit 472 and the lifetime exhaustion suppressing circuit 482 are inputted to an OR element OR7 and an output of the OR element OR7 is inputted to an INV control circuit 44. Accordingly, the operation of the INV control circuit 44 is controlled to pause in a no-load status and a lifetime exhaustion suppressing state in which an elapse of a lamp lifetime is detected.

In the sixteenth embodiment, the output of the no-load suppressing circuit 472 is inputted to a timer circuit 463 and an output of the timer circuit 463 is inputted to an inverting element INV8. An output of an AND element AND9, to which the outputs of the inverting element INV8 and the no-load suppressing circuit 472 are inputted, is inputted to an OR element OR8. Inputted to another input terminal of the OR element OR8 is the output of the lifetime exhaustion suppressing circuit 482, and an output of the OR element OR8 is inputted to an operation status output circuit 43. The timer circuit 463 has the same configuration as that of the timer circuit 42 or 461. Outputs of an oscillator OSC of the timer circuit 42 are inputted to the timer circuit 463 as clock signals. The timer circuit 463 counts the clock signals and outputs an "H" signal if a count number thereof reaches a predetermined value. The output of the no-load suppressing circuit 472 is inputted as a STOP input into a counter circuit of the timer circuit 463 and the counter circuit starts its operation when the output of the no-load suppressing circuit 472 is "H".

Figure 37:
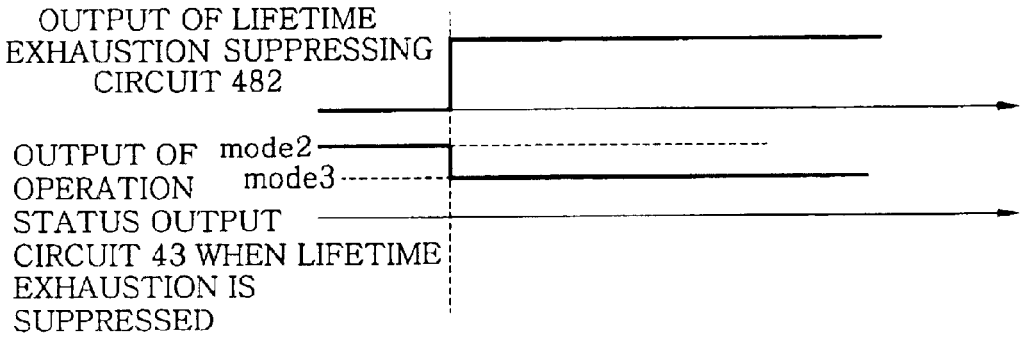
FIG. 37 charts waveforms of operation status output signals in case a lifetime exhaustion suppressing circuit in accordance with the sixteenth preferred embodiment of the present invention starts to operate.
Figure 38:
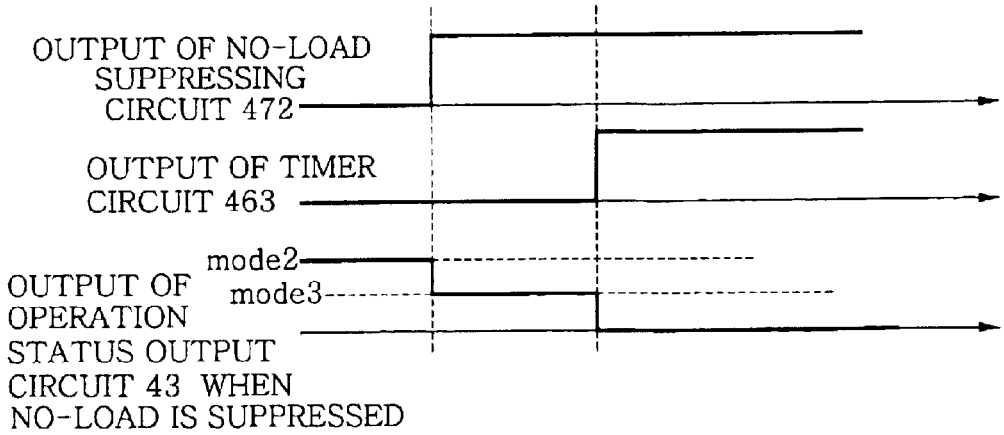
FIG. 38 charts waveforms of operation status output signals in case a no-load suppressing circuit in accordance with the sixteenth preferred embodiment of the present invention starts to operate.

FIG. 37 shows operation status output signals detected at a time when the lifetime exhaustion suppressing circuit 482 is operating. FIG. 38 describes operation status output signals at a time when the no-load suppressing circuit 472 is operating. During the operation of the lifetime exhaustion suppressing circuit 482, the output of the OR element OR8 is set as "H", and the operation status output circuit 43 outputs a predetermined status signal mode3 in accordance with the output of the OR element OR8.

In case the no-load suppressing circuit 472 is operating, the operation of the timer circuit 463 is initiated at the moment when the output signal of the no-load suppressing circuit 472 is turned into "H". Since the output of the timer circuit 463 is "L" at this time, an output of the AND element AND9 is set as "H", so that the output of the OR element OR8 is also set as "H". At this time, the operation status output circuit 43 outputs the predetermined status signal mode3 as in case the lifetime exhaustion suppressing circuit 482 is operating.

If the output of the timer circuit 463 becomes "H" after performing a predetermined number of counting operation, the output of the AND element AND9 is turned into "L" and, accordingly, the output of the OR element OR8 is also changed into "L". At this time, the operation status output circuit 43 outputs a preset status signal mode1 and then an operation setting circuit 6 is controlled to reset time data measured while the status signal mode3 is being inputted thereto.

By performing such an operation as described, if an AC power is supplied in a no-load state in which the discharge lamp La is not connected to the lighting device, the status signal mode3 is outputted from the operation status output circuit 43. For example, if the operation setting circuit 6 detects the status signal of mode3 more than three times every time the AC power is supplied, the measured time data can be simply reset.

Furthermore, as described in the seventh embodiment, when the measured time data is reset in a suspension status, it is preferable that a status signal in the suspension status and a status signal in a no-load status are regarded as a same signal during a predetermined time period when the timer circuit 463 is operating.

Seventeenth Preferred Embodiment

Figure 39:
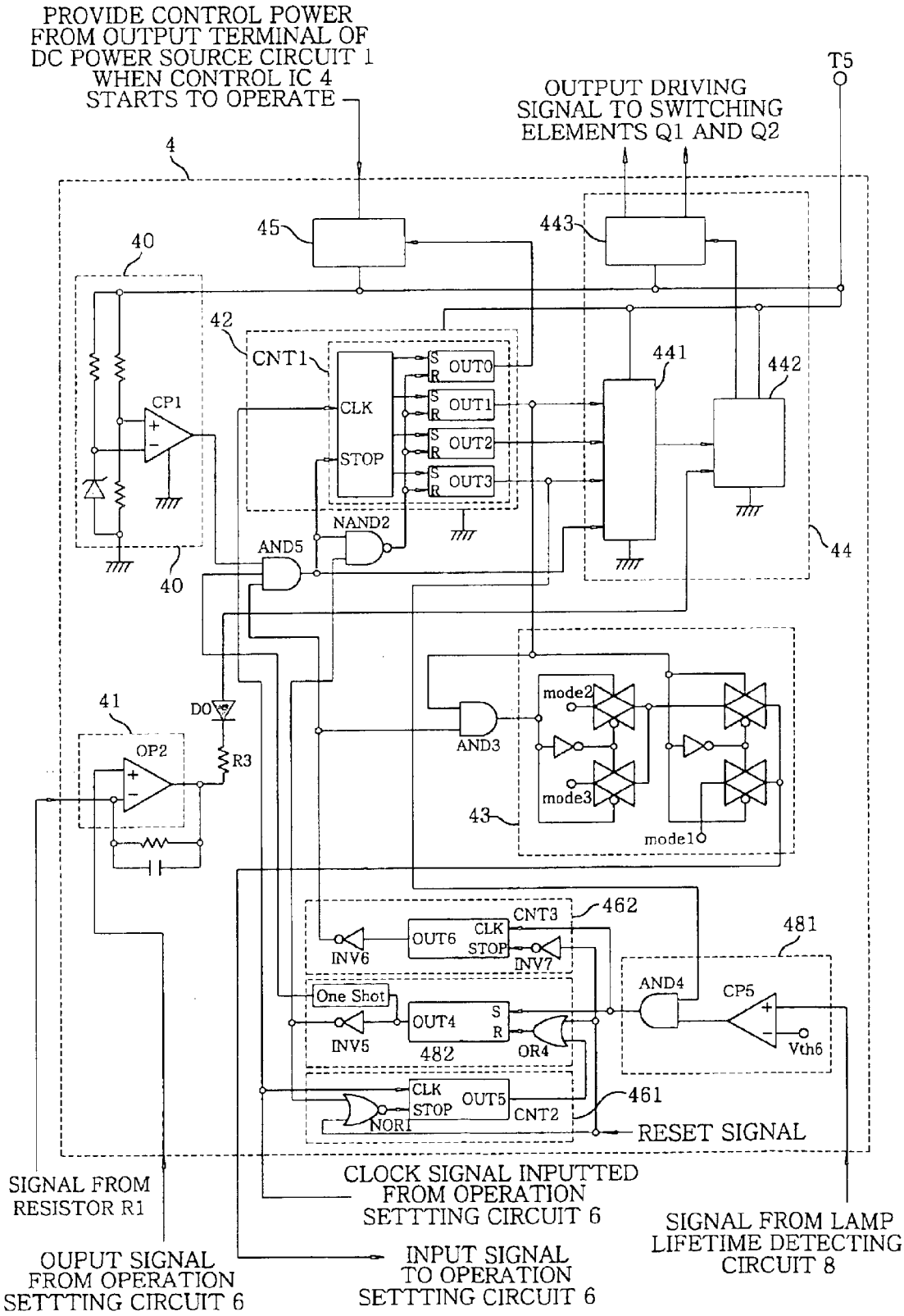
FIG. 39 describes a circuit diagram of a control IC in accordance with a seventeenth preferred embodiment of the present invention.

Referring to FIG. 39, there is provided a control IC 4 in accordance with a seventeenth preferred embodiment of the present invention, in which a clock signal generated in an operation setting circuit 6 is inputted thereto instead of an output of an oscillator OSC of a timer circuit 42. The other configuration and an operation thereof are identical to those described in the eighth embodiment. By using such a configuration, a cycle of the clock signal can be changed in accordance with a status signal outputted from an operation status output circuit 43.

Herein, assume that status signals mode1, mode2 and mode3 are outputted from the operation status output circuit 43 in a preheating status, an ignition status and a lighting status, respectively, and cycles of clock signals generated in the operation setting circuit 6 respectively corresponding to the status signals mode1, mode2 and mode3 are set to be Tpre, Tstr and Tosc, respectively. By changing the cycles of the clock signals, a period (Tpre×n) of the preheating status and a period (Tpre×m) of the ignition status can be determined arbitrarily and also the period of the ignition status may be controlled to be shortened by using an external signal.

For example, in case of using a sensor for detecting an existence of a person, the ignition period can be controlled to be shortened when a detect signal is provided from the sensor, thereby initiating the lighting status earlier.

Eighteenth Preferred Embodiment

Figure 40:
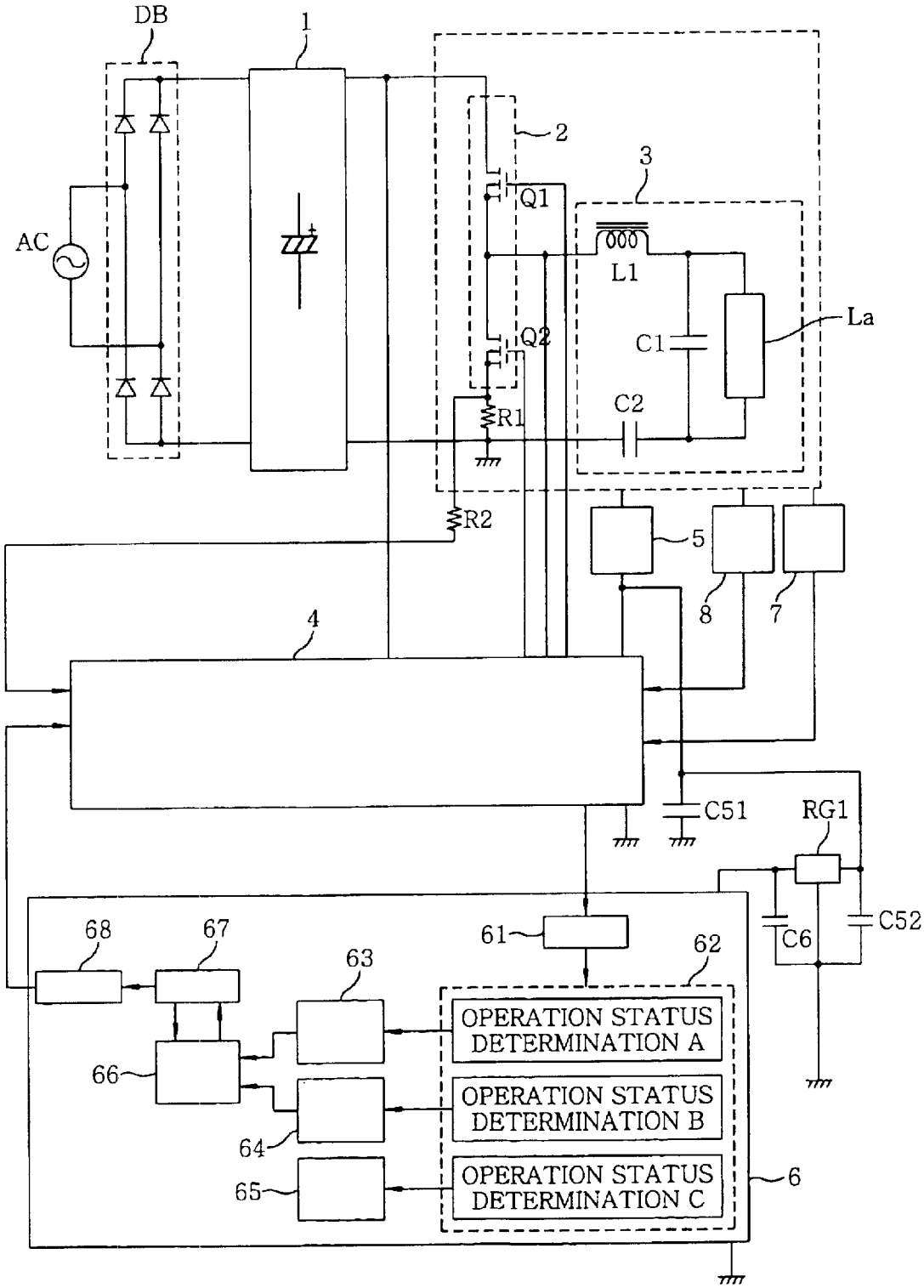
FIG. 40 exhibits a circuit diagram showing a detailed configuration of an operation status output circuit in accordance with an eighteenth preferred embodiment of the present invention.

FIG. 40 describes a detailed configuration of an operation setting circuit 6 in accordance with an eighteenth preferred embodiment of the present invention. An analog status signal outputted from a control IC 4 is inputted to an A/D converter 61 of the operation setting circuit 6 to be converted into a digital signal. Thus obtained digital status signal is processed by a status determination unit 62 to be classified into one of three statuses as follows.

Operational status A: in this status, the control IC 4 is normally operating and a time period of this operation is counted by a lighting period counting unit 63. Then, the counted period data is stored in a non-volatile memory 66.

Operational status B: in this status, a processing for resetting the stored data is performed by the discharge lamp lighting device. That is, the data stored in the non-volatile memory 66 is reset by a lighting period resetting unit 64.

Operational status C: in this status, there is likelihood that a control power is not normally supplied in the discharge lamp lighting device. Therefore, the above-described processing is stopped by a shifting-to-sleep status unit 65, thereby putting the lighting device into a sleep state.

An illumination rate selecting unit 67 selects an illumination rate based on a stored data such as a lighting period data stored in the non-volatile memory 66 in a form of a table. A dimming signal generating unit 68 generates a dimming signal based on the selected illumination rate and then outputs the signal to an output control circuit 41 of the control IC 4. By conducting such an operation, a control mechanism described in the conventional examples can be executed and, at the same time, a malfunctioning or an operation error of the lighting device can be prevented. Furthermore, a size reduction of the discharge lamp lighting device can be accomplished.

Figure 41:
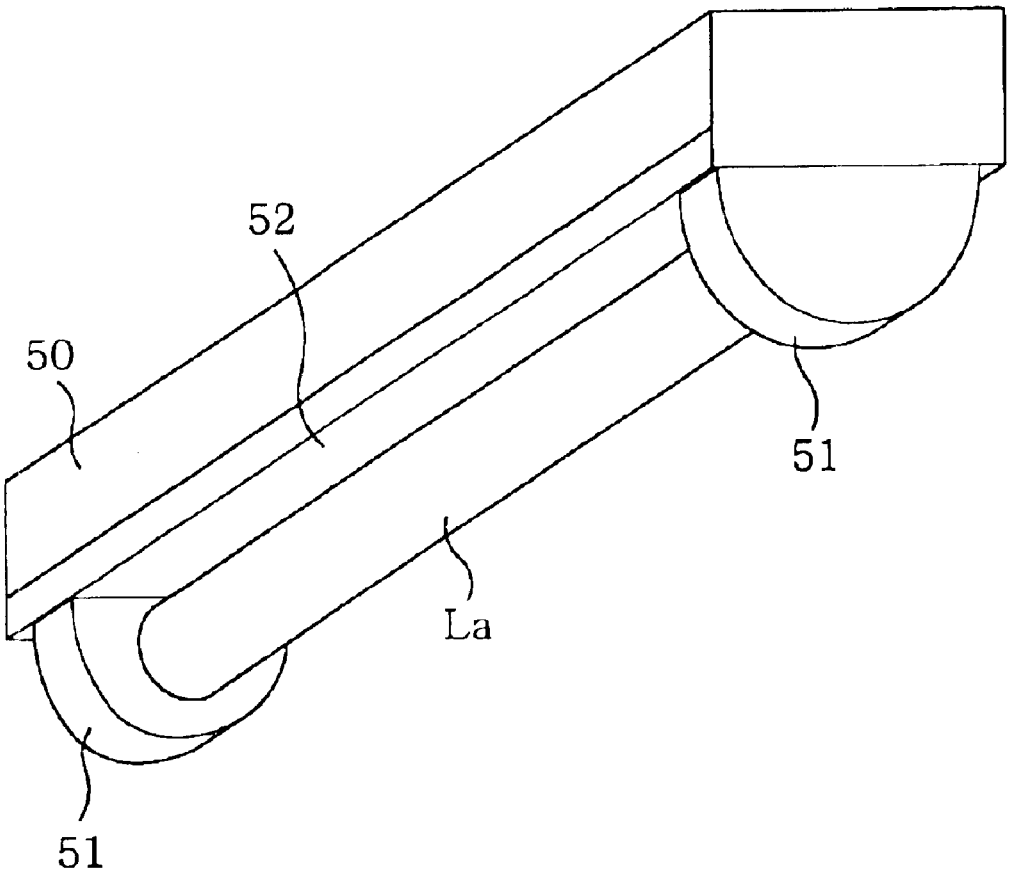
FIG. 41 shows an exterior view of a lighting apparatus employing one of the discharge lamp lighting devices in accordance with the fifth, the eighth and the sixteenth preferred embodiment of the present invention.
Figure 42:
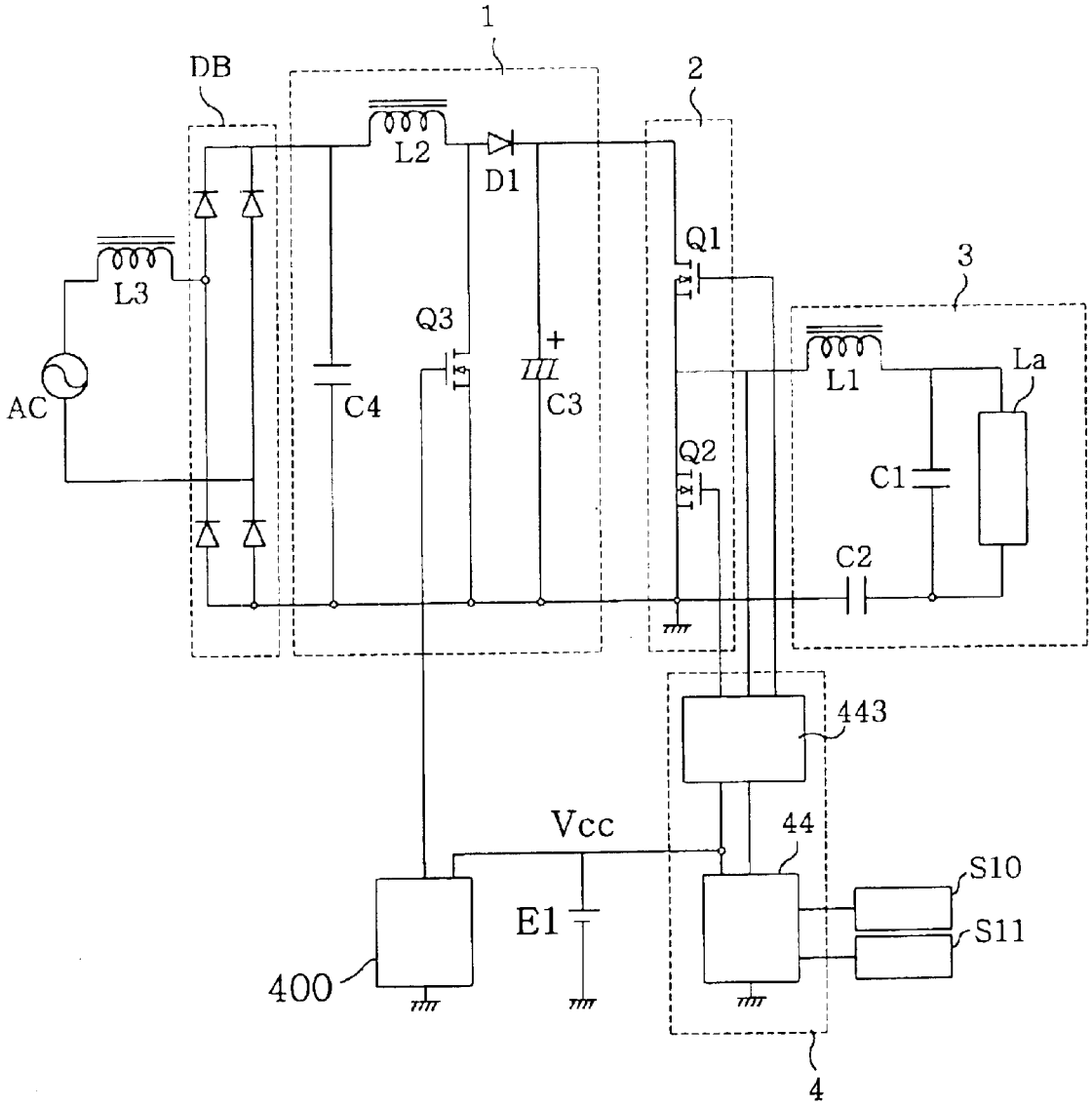
FIG. 42 (PRIOR ART)
FIG. 42 is a circuit diagram of a first example of a discharge lamp lighting device in accordance with the prior art.
Figure 43:
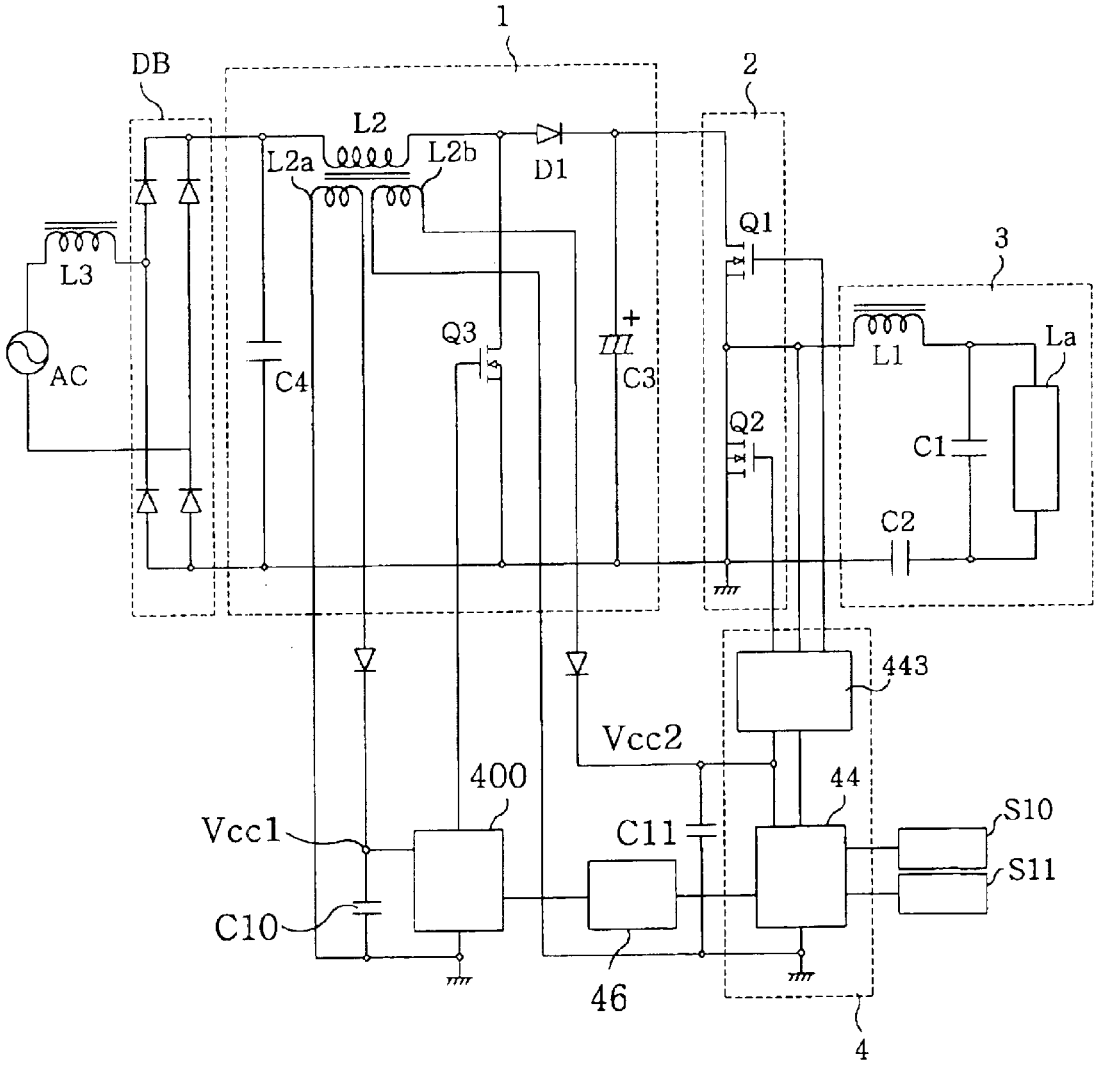
FIG. 43 (PRIOR ART)
FIG. 43 is a circuit diagram of a second example of a discharge lamp lighting device in accordance with the prior art.

Further, in lighting apparatuses using the discharge lamp lighting devices described in the fifth, the eighth and the sixteenth preferred embodiment, operation errors that may frequently occur in the conventional examples can be prevented. Moreover, since a reset switch S2 (See FIG. 47) is not required as shown in FIG. 41, costs for manufacturing the lighting device can be greatly reduced.

While the invention has been shown and described with respect to the preferred embodiments, it will be understood by those skilled in the art that various changes and modifications may be made without departing from the spirit and scope of the invention as defined in the following claims.

What is claimed is:

1. A discharge lamp lighting device comprising:

a rectifier for rectifying an AC power source;

a DC power source circuit including at least one smoothing capacitor and connected to an output terminal of the rectifier;

an inverter circuit, which includes two switching elements coupled in series to each other and is connected to an output terminal of the DC power source circuit, for turning the switching elements on and off alternately;

a load circuit, which includes at least one resonance inductor, one resonance capacitor and one discharge lamp, for lighting the discharge lamp by a resonance generated by using a high frequency voltage inputted from the inverter circuit;

a control IC for controlling operations of the switching elements of the inverter circuit; and a control power source circuit for supplying a control power to the control IC, wherein the control IC includes:

a first timer unit for determining a status conversion timing for performing a shift from a preheating status, where the discharge lamp is preheated, to an ignition status, where an ignition voltage is applied to the discharge lamp, and finally to a lighting status, where the discharge lamp is lighted with a predetermined output power;

a first control unit for determining an on/off timing of the switching elements of the inverter circuit based on a control signal provided from the first timer unit and outputting a driving signal to the switching elements of the inverter circuit;

a second control unit for controlling variations in the cycle of the driving signal and generation of the driving signal provided from the first control unit based on a control signal inputted from an exterior of the control IC to perform a dimming control of the discharge lamp or a control of the inverter circuit;

an operation status output unit for outputting a predetermined status signal corresponding to an operational status of the IC control circuit; and an operation setting circuit for inputting the status signal provided from the operation status output unit and outputting a control signal to the second control unit, wherein the operation status output unit outputs a status signal corresponding to at least the lighting status.

2. The device of claim 1, wherein the operation status output unit of the control IC outputs status signals corresponding to at least two among the preheating status, the ignition status, the lighting status and a status where the second control unit is operating.

3. The device of claim 2, wherein the control IC includes a driving unit, which is connected to an output terminal of the rectifier or the DC power source circuit, for supplying a control power from the control power source when the operation of the inverter circuit is stopped and the operation status output unit outputs a status signal corresponding to a status in which the driving unit operates to supply the control power source.

4. The device of any one of claims 1 to 3, further comprising a no-load detecting circuit for detecting whether or not the discharge lamp is connected to the lighting device, wherein the control IC includes:

a first abnormality determination unit for determining an occurrence of an abnormal status based on a detection signal inputted from the no-load detecting circuit; and a first output suppression unit for stopping an operation of the inverter circuit when the abnormal status is detected, wherein the operation status output unit outputs a status signal corresponding to a first output suppression status in which the first output suppression unit is operating.

5. The device of claim 1, further comprising a lamp lifetime detection circuit for detecting the remaining lifetime of the discharge lamp, wherein the control IC includes:

a second abnormality determination unit for determining an occurrence of an abnormal status based on a detection signal inputted from the lamp lifetime detection circuit; and a second output suppression unit for restraining or stopping generation of an output of the inverter circuit when the abnormal state is detected, wherein an operation of at least one of the second abnormality determination unit and the second output suppression unit is stopped during a time period from an initial status of the first timer unit to a status conversion stage in which the initial status of the first timer unit is ended, and the operation status output unit outputs a status signal corresponding to a second output suppression status in which the second output suppression unit is operating.

6. The device of claim 5, wherein the control IC further includes:

a second timer unit for determining an output suppression period during which the second output suppression unit is operating; and a suspension maintenance unit for maintaining a suspension of an operation of the inverter circuit in case a count number of operations of the second output suppression unit reaches a predetermined value when the second output suppression status is terminated after the output suppression period has elapsed and an operation of the first timer unit is initiated from the initial status thereof, wherein the operation status output unit outputs a status signal corresponding to the second suppression status in which the second suppression unit is operating and a status signal corresponding to a suspension status in which the suspension maintenance unit is operating.

7. The device of claim 6, wherein a status signal generated during a predetermined time period immediately after entering into the first output suppression status is identical to the status signal corresponding to the second output suppression status or the suspension status, and a status signal outputted after an elapse of the predetermined time period is different from the status signal corresponding to the second output suppression status or the suspension status.

8. The device of claim 6, wherein the first and the second timer unit determine a status conversion timing and an output suppression period by counting the number of reference clock signals inputted thereto, each having a certain frequency, and the reference clock signals are generated by the operation setting circuit and the frequency thereof is varied depending on the status signals.

9. The device of claim 5, wherein the operation setting unit includes:

an A/D converter for converting a status signal to a digital signal, the status signal being inputted from the operation setting circuit;

a time counter for measuring an accumulated time in accordance with the status signal of the control IC indicating at least the lighting status;

a storage unit for storing the accumulated time;

an operation correction unit for outputting a control signal in accordance with the accumulated time stored in the storage unit to the second control unit of the control IC;

a reset unit for initializing the accumulated time stored in the storage unit in accordance with the status signal corresponding to the second output suppression state or the suspension state; and a conversion-to-sleep state unit for stopping an operation of the operation setting unit in accordance with the status signal corresponding to the first output suppression status.

10. The device of claim 1, further comprising a low voltage detection circuit for detecting a decrease of a supply voltage provided from the AC power source, wherein the control IC includes:

a third abnormality determination unit for determining an occurrence of an abnormal status based on a detection signal inputted from the low voltage detection circuit; and a third output suppression unit for restraining or stopping generation of an output of the inverter circuit when the abnormal status is detected, wherein the operation status output unit outputs a status signal corresponding to a third output suppression status in which the third output suppression unit is operating.

11. The device of claim 1, further comprising a smoothed output detection circuit for detecting an output voltage of the DC power source circuit, wherein the DC power source circuit includes at least one switching element and the control IC further includes:

a differential amplifier for comparing a detection signal inputted from the smoothed output detection circuit with a predetermined reference value;

a third control unit for controlling an on/off timing of the switching elements of the DC power source circuit based on an output signal from the differential amplifier and outputting a driving signal to the switching elements of the DC power source circuit;

a fourth abnormality determination unit for determining an occurrence of an abnormal status based on the detection signal inputted from the smoothed output detection circuit; and a fourth output suppression unit for stopping an output of the driving signal to the switching elements of the DC power source circuit or restraining generation of an output of the inverter circuit when the abnormal status is detected, wherein the operation status output unit outputs a status signal corresponding to a fourth output suppression status in which the fourth output suppression unit is operating.

12. The device of claim 1, wherein a status signal outputted from the operation status output unit is a DC voltage signal corresponding to at least one of the three operational statuses of the control IC.

13. The device of claim 1, wherein a status signal outputted from the operation status output unit is a duty signal corresponding to at least one of the three operational statuses of the control IC.

14. The device of claim 1, wherein a status signal outputted from the operation status output unit includes a duty signal and a DC voltage signal.

15. The device of any one of claims 5, 6, 10, 11, 12, 13 or 14, wherein the status signals at least corresponding to the first output suppression status, the third output suppression status and the fourth output status are the same.

16. The device of claim 1, wherein the control IC further includes a reference voltage generator, and a voltage outputted to the exterior of the control IC from the reference voltage generator is inputted to the operation setting unit after entering the preheating status.

17. The device of claim 16, wherein the voltage outputted to the exterior of the control IC from the reference voltage generator is supplied as a control source power for the operation setting circuit.

18. A lighting apparatus comprising the discharge lighting device described in any one of claims 1 to 3.

* * * * *